US008328600B2

(12) United States Patent
Duescher

(10) Patent No.: US 8,328,600 B2
(45) Date of Patent: Dec. 11, 2012

(54) WORKPIECE SPINDLES SUPPORTED FLOATING ABRASIVE PLATEN

(76) Inventor: Wayne O. Duescher, Roseville, MN (US)

( * ) Notice: Subject to any disclaimer, the term of this patent is extended or adjusted under 35 U.S.C. 154(b) by 0 days.

(21) Appl. No.: 13/207,871

(22) Filed: Aug. 11, 2011

(65) Prior Publication Data

US 2011/0294405 A1 Dec. 1, 2011

Related U.S. Application Data

(63) Continuation-in-part of application No. 12/807,802, filed on Sep. 14, 2010, which is a continuation-in-part of application No. 12/799,841, filed on May 3, 2010, which is a continuation-in-part of application No. 12/661,212, filed on Mar. 12, 2010.

(51) Int. Cl.
*B24B 7/22* (2006.01)
*B24B 53/00* (2006.01)

(52) U.S. Cl. ..... 451/11; 451/5; 451/288

(58) Field of Classification Search ..... 451/5, 11, 451/28, 36, 37, 41, 59, 64, 259, 260, 270, 451/271, 280, 283, 285, 288, 287
See application file for complete search history.

(56) References Cited

U.S. PATENT DOCUMENTS

| | | | |
|---|---|---|---|
| 1,989,074 | A | 1/1935 | Bullard |
| 2,410,752 | A | 11/1946 | Sells et al. |
| 2,696,067 | A | 12/1954 | Leach |
| 2,973,605 | A | 3/1961 | Carman et al. |
| 2,979,868 | A | 4/1961 | Emeis |
| 3,342,652 | A | 9/1967 | Reisman et al. |
| 3,475,867 | A | 11/1969 | Walsh |
| 3,662,498 | A | 5/1972 | Caspers |
| 4,104,099 | A | 8/1978 | Scherrer |
| 4,165,584 | A | 8/1979 | Scherrer |
| 4,256,535 | A | 3/1981 | Banks |
| 4,315,383 | A | 2/1982 | Day |
| 4,588,473 | A | 5/1986 | Hisatomi et al. |
| 4,593,495 | A | 6/1986 | Kawakami et al. |
| 4,720,938 | A | 1/1988 | Gosis |
| 4,735,679 | A | 4/1988 | Lasky |
| 4,910,155 | A | 3/1990 | Cote et al. |
| 4,918,870 | A | 4/1990 | Torbert et al. |

(Continued)

OTHER PUBLICATIONS

International Search Report from related International Application No. PCT/US2011/028088 (13 sheets).

*Primary Examiner* — Robert Rose
(74) *Attorney, Agent, or Firm* — Mark A. Litman & Associates, P.A.

(57) ABSTRACT

A method and apparatus for releasably attaching flexible abrasive disks to a flat-surfaced platen that floats in three-point abrading contact with three rigid flat-surfaced rotatable fixed-position workpiece spindles that are mounted on a flat surface of an abrading machine base where the spindle surfaces are in a common plane. Three spindles are positioned to form a three-point triangle of platen supports where the rotational-centers of each of the spindles are positioned at the center of the annular width of the platen abrading surface. The spindles are supported by two-piece spindle-mount devices having a common-radius spherical joint that allows the spindles to be rotated to co-planar align the top flat surfaces of the rotatable spindle-tops and then to be locked into this aligned position. Spindle-mount spherical-action locking devices include mechanical fasteners and stress-free adhesive tabs. Precision-flat platens can be used as an alignment jig for co-planar alignment of the spindles.

20 Claims, 16 Drawing Sheets

U.S. PATENT DOCUMENTS

| | | | |
|---|---|---|---|
| 5,014,468 | A | 5/1991 | Ravipati et al. |
| 5,032,544 | A | 7/1991 | Ito et al. |
| 5,137,542 | A | 8/1992 | Buchanan et al. |
| 5,191,738 | A | 3/1993 | Nakazato et al. |
| 5,205,082 | A | 4/1993 | Shendon et al. |
| 5,274,960 | A | 1/1994 | Karlsrud |
| 5,314,513 | A | 5/1994 | Miller et al. |
| 5,364,655 | A | 11/1994 | Nakamura et al. |
| 5,422,316 | A | 6/1995 | Desai et al. |
| 5,454,844 | A | 10/1995 | Hibbard et al. |
| 5,456,627 | A | 10/1995 | Jackson et al. |
| 5,538,460 | A | 7/1996 | Onodera |
| 5,569,062 | A | 10/1996 | Karlsrud |
| 5,643,067 | A | 7/1997 | Katsuoka et al. |
| 5,769,697 | A | 6/1998 | Nishio |
| 5,800,254 | A | 9/1998 | Motley et al. |
| 5,833,519 | A | 11/1998 | Moore |
| 5,840,629 | A | 11/1998 | Carpio |
| 5,857,898 | A | 1/1999 | Hiyama et al. |
| 5,860,847 | A | 1/1999 | Sakurai et al. |
| 5,863,306 | A | 1/1999 | Wei et al. |
| 5,882,245 | A | 3/1999 | Popovich et al. |
| 5,910,041 | A | 6/1999 | Duescher |
| 5,916,009 | A | 6/1999 | Izumi et al. |
| 5,938,506 | A | 8/1999 | Fruitman et al. |
| 5,964,651 | A | 10/1999 | Hose |
| 5,967,882 | A | 10/1999 | Duescher |
| 5,972,792 | A | 10/1999 | Hudson |
| 5,975,997 | A | 11/1999 | Minami |
| 5,981,454 | A | 11/1999 | Small |
| 5,989,104 | A | 11/1999 | Kim et al. |
| 5,993,298 | A | 11/1999 | Duescher |
| 6,001,008 | A | 12/1999 | Fujimori et al. |
| 6,007,407 | A | 12/1999 | Rutherford et al. |
| 6,022,266 | A | 2/2000 | Bullard et al. |
| 6,048,254 | A | 4/2000 | Duescher |
| 6,077,153 | A | 6/2000 | Fujita et al. |
| 6,089,959 | A | 7/2000 | Nagahashi |
| 6,102,777 | A | 8/2000 | Duescher et al. |
| 6,120,352 | A | 9/2000 | Duescher |
| 6,139,428 | A | 10/2000 | Drill et al. |
| 6,149,506 | A | 11/2000 | Duescher |
| 6,165,056 | A | 12/2000 | Hayashi et al. |
| 6,168,506 | B1 | 1/2001 | McJunken |
| 6,217,433 | B1 | 4/2001 | Herrman et al. |
| 6,273,786 | B1 | 8/2001 | Chopra et al. |
| 6,371,838 | B1 | 4/2002 | Holzapfel |
| 6,398,906 | B1 | 6/2002 | Kobayashi et al. |
| 6,425,809 | B1 | 7/2002 | Ichimura |
| 6,439,965 | B1 | 8/2002 | Ichino et al. |
| 6,506,105 | B1 | 1/2003 | Kajiwara et al. |
| 6,520,833 | B1 | 2/2003 | Saldana et al. |
| 6,607,157 | B1 | 8/2003 | Duescher |
| 6,632,127 | B1 | 10/2003 | Zimmer et al. |
| 6,652,764 | B1 | 11/2003 | Blalock |
| 6,702,866 | B2 | 3/2004 | Kamboj |
| 6,752,700 | B2 | 6/2004 | Duescher |
| 6,769,969 | B1 | 8/2004 | Duescher |
| 6,786,810 | B2 | 9/2004 | Muilenburg et al. |
| 6,893,332 | B2 | 5/2005 | Castor |
| 6,896,584 | B2 | 5/2005 | Perlov et al. |
| 6,899,603 | B2 | 5/2005 | Homma et al. |
| 6,935,013 | B1 | 8/2005 | Markevitch et al. |
| 7,001,251 | B2 | 2/2006 | Doan et al. |
| 7,008,303 | B2 | 3/2006 | White et al. |
| 7,014,535 | B2 | 3/2006 | Custer et al. |
| 7,029,380 | B2 | 4/2006 | Horiguchi et al. |
| 7,033,251 | B2 | 4/2006 | Elledge |
| 7,044,838 | B2 | 5/2006 | Maloney et al. |
| 7,125,313 | B2 | 10/2006 | Zelenski et al. |
| 7,144,304 | B2 | 12/2006 | Moore |
| 7,147,541 | B2 | 12/2006 | Nagayama et al. |
| 7,166,016 | B1 | 1/2007 | Chen |
| 7,214,125 | B2 | 5/2007 | Sharples et al. |
| 7,250,368 | B2 | 7/2007 | Kida et al. |
| 7,276,446 | B2 | 10/2007 | Robinson et al. |
| 7,357,699 | B2 | 4/2008 | Togawa et al. |
| 7,364,495 | B2 | 4/2008 | Tominaga et al. |
| 7,367,867 | B2 | 5/2008 | Boller |
| 7,393,790 | B2 | 7/2008 | Britt et al. |
| 7,422,634 | B2 | 9/2008 | Powell et al. |
| 7,446,018 | B2 | 11/2008 | Brogan et al. |
| 7,449,124 | B2 | 11/2008 | Webb et al. |
| 7,456,106 | B2 | 11/2008 | Koyata et al. |
| 7,470,169 | B2 | 12/2008 | Taniguchi et al. |
| 7,491,342 | B2 | 2/2009 | Kamiyama et al. |
| 7,507,148 | B2 | 3/2009 | Kitahashi et al. |
| 7,520,800 | B2 | 4/2009 | Duescher |
| 7,527,722 | B2 | 5/2009 | Sharan |
| 7,582,221 | B2 | 9/2009 | Netsu et al. |
| 7,585,425 | B2 | 9/2009 | Ward |
| 7,588,674 | B2 | 9/2009 | Frodis et al. |
| 7,614,939 | B2 | 11/2009 | Tolles et al. |
| 7,632,434 | B2 | 12/2009 | Duescher |
| 7,635,291 | B2 | 12/2009 | Muldowney |
| 7,648,409 | B1 | 1/2010 | Horiguchi et al. |
| 2005/0118939 | A1 | 6/2005 | Duescher |
| 2008/0182413 | A1 | 7/2008 | Menk et al. |
| 2008/0299875 | A1 | 12/2008 | Duescher |
| 2010/0003904 | A1 | 1/2010 | Duescher |

WORKPIECE SPINDLES SUPPORTED FLOATING ABRASIVE PLATEN

CROSS REFERENCE TO RELATED APPLICATION

This invention is a continuation-in-part of the U.S. patent application Ser. No. 12/807,802 filed Sep. 14, 2010 that is a continuation-in-part of the U.S. patent application Ser. No. 12/799,841 filed May 3, 2010 that is a continuation-in-part of the U.S. patent application Ser. No. 12/661,212 filed Mar. 12, 2010.

BACKGROUND OF THE INVENTION

Field of the Invention

The present invention relates to the field of abrasive treatment of surfaces such as grinding, polishing and lapping. In particular, the present invention relates to a high speed lapping system that provides simplicity, quality and efficiency to existing lapping technology using multiple floating platens.

Flat lapping of workpiece surfaces used to produce precision-flat and mirror smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy liquid abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

Fixed-Spindle-Floating-Platen System

The present invention relates to methods and devices for a single-sided lapping machine that is capable of producing ultra-thin semiconductor wafer workpieces at high abrading speeds. This is done by providing a flat surfaced granite machine base that is used for mounting three individual rigid flat-surfaced rotatable workpiece spindles. Flexible abrasive disks having annular bands of fixed-abrasive coated raised islands are attached to a rigid flat-surfaced rotary platen. The platen annular abrading surface floats in three-point abrading contact with flat surfaced workpieces that are mounted on the three equal-spaced flat-surfaced rotatable workpiece spindles. Water coolant is used with these raised island abrasive disks.

Presently, floating abrasive platens are used in double-sided lapping and double-sided micro-grinding (flat-honing) but the abrading speeds of both of these systems are very low. The upper floating platen used with these systems are positioned in conformal contact with multiple equal-thickness workpieces that are in flat contact with the flat abrading surface of a lower rotary platen. Both the upper and lower abrasive coated platens are typically concentric with each other and they are rotated independent of each other. Often the platens are rotated in opposite directions to minimize the net abrading forces that are applied to the workpieces that are sandwiched between the flat annular abrading surfaces of the two platens.

In order to compensate for the different abrading speeds that exist at the inner and outer radii of the annular band of abrasive that is present on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece rotation and is unfavorable for the other platen that rotates in a direction that opposes the workpiece rotation direction. Here, the speed differential provided by the rotated workpiece acts against the abrading speed of the opposed rotation direction platen. Because the localized abrading speed represents the net speed difference between the workpieces and the platen, rotating them in opposite directions increases the localized abrading speeds to where it is too fast. Providing double-sided abrading where the upper and lower platens are rotated in opposed directions results over-speeding of the abrasive on one surface of a workpiece compared to an optimum abrading speed on the opposed workpiece surface.

In double-sided abrading, rotation of the workpieces is typically done with thin gear-driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens. Also, because the workholder disks are fragile, the upper and lower platens are often rotated in opposite directions to minimize the net abrading forces on individual workpieces because a portion of this net workpiece abrading force is applied to the fragile disk-type workholders. It is not practical to abrade very thin workpieces with double-sided platen abrasive systems because the required very thin planetary workholder disks are so fragile.

Multiple workpieces are often abrasive slurry lapped using flat-surfaced single-sided platens that are coated with a layer of loose abrasive particles that are in a liquid mixture. Slurry lapping is very slow, and also, very messy.

The platen slurry abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving annular abrasive surface to re-establish the planar flatness of the platen annular band of abrasive.

In single-sided slurry lapping, a rigid rotating platen has a coating of abrasive in an annular band on its planar surface. Floating-type spherical-action workholder spindles hold individual workpieces in flat-surfaced abrading contact with the moving platen slurry abrasive with controlled abrading pressure.

The fixed-spindle-floating-platen abrading system has many unique features that allow it to provide flat-lapped precision-flat and smoothly-polished thin workpieces at very high abrading speeds. Here, the top flat surfaces of the individual spindles are aligned in a common plane where the flat surface of each spindle top is co-planar with each other. Each of the three rigid spindles is positioned with approximately equal spacing between them to form a triangle of spindles that provide three-point support of the rotary abrading platen. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all three rotating workpieces to perform single-sided abrading on the exposed surfaces of the workpieces. The fixed-spindle-floating platen system can be used at high abrading speeds with water cooling to produce precision-flat and mirror-smooth workpieces at very high production rates. There is no abrasive wear of the platen surface because it is protected by the attached flexible abrasive disks. Use of abrasive disks that have annular bands of abrasive coated raised islands prevents the common problem of hydroplaning of workpieces when contacting coolant water-wetted continuous-abrasive coatings. Hydroplaning of workpieces causes non-flat workpiece surfaces.

This abrading system can also be used to recondition the flat surface of the abrasive that is on the abrasive disk that is attached to the platen. A platen annular abrasive surface tends to experience uneven wear across the radial surface of the annular abrasive band after continued abrading contact with the flat surfaced workpieces. When the non-even wear of the abrasive surface becomes excessive and the abrasive can no longer provide precision-flat workpiece surfaces it must be reconditioned to re-establish its precision planar flatness. Reconditioning the platen abrasive surface can be easily accomplished with this fixed-spindle floating-platen system by attaching equal-thickness abrasive disks, or other abrasive devices such as abrasive coated conditioning rings, to the flat surfaces of the rotary spindle tops in place of the workpieces. Here, the platen annular abrasive surface reconditioning takes place by rotating the spindle abrasive disks, or conditioning rings, while they are in flat-surfaced abrading contact with the rotating platen abrasive annular band.

Also, the bare platen (no abrasive coating) annular abrading surface can be reconditioned with this fixed-spindle floating-platen system by attaching equal-thickness abrasive disks, or other abrasive devices such as abrasive coated conditioning rings, to the flat surfaces of the rotary spindle tops in place of the workpieces. Here, the platen annular abrading surface reconditioning takes place by rotating the spindle abrasive disks, or conditioning rings, while they are in flat-surfaced abrading contact with the rotating platen annular abrading surface. Most conventional platen abrading surfaces have original-condition flatness tolerances of 0.0001 inches (3 microns) that typically wear down into a non-flat condition during abrading operations to approximately 0.0006 inches (15 microns) before they are reconditioned to re-establish the original flatness variation of 0.0001 inches (3 microns).

Furthermore, the system can be used to recondition the flat surfaces of the spindles or the surfaces of workpiece carrier devices that are attached to the spindle tops by bringing an abrasive coated floating platen into abrading contact with the bare spindle tops, or into contact with the workpiece carrier devices that are attached to the spindle tops, while both the spindles and the platen are rotated.

This fixed-spindle-floating-platen system is particularly suited for flat-lapping large diameter semiconductor wafers. High-value large-sized workpieces such as 12 inch diameter (300 mm) semiconductor wafers can be attached with vacuum or by other means to ultra-precise flat-surfaced air bearing spindles for precision lapping of the wafers. Commercially available abrading machine components can be easily assembled to construct these lapper machines. Ultra-precise 12 inch diameter air bearing spindles can provide flat rotary mounting surfaces for flat wafer workpieces. These spindles typically provide spindle top flatness accuracy of 5 millionths of an inches (or less, if desired) during rotation. They are also very stiff for resisting abrading load deflections and can support loads of 900 lbs. A typical air bearing spindle having a stiffness of 4,000,000 lbs/inch is more resistant to deflections from abrading forces than a mechanical spindle having steel roller bearings.

The thicknesses of the workpieces can be measured during the abrading or lapping procedure by the use of laser, or other, measurement devices that can measure the workpiece thicknesses. These workpiece thickness measurements can be made by direct workpiece exposed-edge side measurements. They also can be made indirectly by measuring the location of the bottom position of the moving abrasive surface that makes contact with the workpiece surfaces as the abrasive surface location measurement is related to an established reference position.

Air bearing workpiece spindles can be replaced or extra units added as needed. These air bearing spindles are preferred because of their precision flatness of the spindle surfaces at all abrading speeds and their friction-free rotation. Commercial 12 inch (300 mm) diameter air bearing spindles that are suitable for high speed flat lapping are available from Nelson Air Corp, Milford, N.H. Air bearing spindles are preferred for high speed flat lapping but suitable rotary flat-surfaced spindles having conventional roller bearings can also be used.

Thick-section granite bases that have the required surface flatness accuracy, structural stiffness and dimensional stability to support these heavy air bearing spindles without distortion are also commercially available from numerous sources. Fluid passageways can be provided within the granite bases to allow the circulation of heat transfer fluids that thermally stabilize the bases. This machine base temperature control system provides long-term dimensional stability of the precision-flat granite bases and isolates them from changes in the ambient temperature changes in a production facility. Floating platens having precision-flat planar annular abrading surfaces can also be fabricated or readily purchased.

The flexible abrasive disks that are attached to the platen annular abrading surfaces typically have annular bands of fixed-abrasive coated rigid raised-island structures. There is insignificant elastic distortion of the individual raised islands through the thickness of the raised island structures or elastic distortion of the complete thickness of the raised island abrasive disks when they are subjected to typical abrading pressures. These abrasive disks must also be precisely uniform in thickness across the full annular abrading surface of the disk. This is necessary to assure that uniform abrading takes place over the full flat surface of the workpieces that are attached onto the top surfaces of each of the three spindles. The term "precisely" as used herein refers to within ±5 wavelengths planarity and within ±0.01 degrees of perpendicular or parallel, and precisely coplanar means within ±0.01 degrees of parallel, thickness or flatness variations of less than 0.0001 inches (3 microns) and with a standard deviation between planes that does not exceed ±20 microns.

During an abrading or lapping procedure, both the workpieces and the abrasive platens are rotated simultaneously. Once a floating platen "assumes" a position as it rests conformably upon workpieces attached to the spindle tops and the platen is supported by the three spindles, the planar abrasive surface of the platen retains this nominal platen alignment even as the floating platen is rotated. The three-point spindles are located with approximately equal spacing between them circumferentially around the platen and their rotational centers are in alignment with the radial centerline of the platen annular abrading surface. A controlled abrading pressure is applied by the abrasive platen to the equal-thickness workpieces that are attached to the three rotary workpiece spindles. Due to the evenly-spaced three-point support of the floating platen, the equal-sized workpieces attached to the spindle tops experience the same shared platen-imposed abrading forces and abrading pressures. Here, precision-flat and smoothly polished semiconductor wafer surfaces can be simultaneously produced at all three spindle stations by the fixed-spindle-floating platen abrading system.

Because the floating-platen and fixed-spindle abrading system is a single-sided process, very thin workpieces such as semiconductor wafers or flat-surfaced solar panels can be attached to the rotatable spindle tops by vacuum or other attachment means. To provide abrading of the opposite side of a workpiece, it is removed from the spindle, flipped over and abraded with the floating platen. This is a simple two-step procedure. Here, the rotating spindles provide a workpiece surface that is precisely co-planar with the opposed workpiece surface.

The spindles and the platens can be rotated at very high speeds, particularly with the use of precision-thickness raised-island abrasive disks. These abrading speeds can exceed 10,000 surface feet per minute (SFPM) or 3,048 surface meters per minute. The abrading pressures used here for flat lapping are very low because of the extraordinary high material removal rates of superabrasives (including diamond or cubic boron nitride (CBN)) when operated at very high abrading speeds. The abrading pressures are often less than 1 pound per square inch (0.07 kilogram per square cm) which is a small fraction of the abrading pressures commonly used in abrading. Flat honing (micro-grinding) uses extremely high abrading pressures which can result in substantial sub-surface damage of high value workpieces. The low abrading pressures used here result in highly desired low subsurface damage. In addition, low abrading pressures result in lapper machines that have considerably less weight and bulk than conventional abrading machines.

Use of a platen vacuum disk attachment system allows quick set-up changes where abrasive disks having different sizes of abrasive particles and different types of abrasive material can be quickly attached to the flat platen annular abrading surfaces. Changing the sized of the abrasive particles on all of the other abrading systems is slow and tedious. Also, the use of messy loose-abrasive slurries is avoided by using the fixed-abrasive disks.

A minimum of three evenly-spaced spindles are used to obtain the three-point support of the upper floating platen by contacting the spaced workpieces. However, additional spindles can be mounted between any two of the three spindles that form three-point support of the floating platen. Here all of the workpieces attached to the spindle-tops are in mutual flat abrading contact with the rotating platen abrasive.

Semiconductor wafers or other workpieces can be processed with a fully automated easy-to-operate process that is especially easy to incorporate into the fixed-spindle floating-platen lapping or abrading system. Here, individual semiconductor wafers, workpieces or workpiece carriers can be changed on all three spindles with a robotic arm extending through a convenient gap-opening between two adjacent stand-alone workpiece rotary spindles. Flexible abrasive disks can be changed on the platen by using a robotic arm extending through a convenient gap-opening between two adjacent stand-alone workpiece rotary spindles.

This three-point fixed-spindle-floating-platen abrading system can also be used for chemical mechanical planarization (CMP) abrading of semiconductor wafers that are attached to the spindle-tops by using liquid abrasive slurry and chemical mixtures with resilient backed pads that are attached to the floating platen. The system can also be used with CMP-type fixed-abrasive shallow-island abrasive disks that are backed with resilient support pads. These abrasive shallow-islands can either be mold-formed on the surface of flexible backings or the abrasive shallow-islands can be coated on the backings using gravure-type coating techniques.

This three-point fixed-spindle-floating-platen abrading system can also be used for slurry lapping of the workpieces that are attached to the rotary spindle-tops by applying a coating of liquid abrasive slurry to the abrading surface of the platen. Also, a flat-surfaced annular metal or other material disk can be attached to the platen abrading surface and a coating of liquid abrasive slurry can be applied to the flat abrading surface of the attached annular disk.

The system has the capability to resist large mechanical abrading forces that can be present with abrading processes while maintaining unprecedented rotatable workpiece spindle tops flatness accuracies and minimum mechanical flatness out-of-planar variations, even at very high abrading speeds. There is no abrasive wear of the flat surfaces of the spindle tops because the workpieces are firmly attached to the spindle tops and there is no motion of the workpieces relative to the spindle tops. Rotary abrading platens are inherently robust, structurally stiff and resistant to deflections and surface flatness distortions when they are subjected to substantial abrading forces. Because the system is comprised of robust components, it has a long production usage lifetime with little maintenance even in the harsh abrading environment present with most abrading processes. Air bearing spindles are not prone to failure or degradation and provide a flexible system that is quickly adapted to different polishing processes. Drip shields can be attached to the air bearing spindles to prevent abrasive debris from contaminating the spindle.

All of the precision-flat abrading processes presently in commercial lapping use typically have very slow abrading speeds of about 5 mph (8 kph). By comparison, the high speed flat lapping system operates at or above 100 mph (160 kph). This is a speed difference ratio of 20 to 1. Increasing abrading speeds increase the material removal rates. High abrading speeds result in high workpiece production rates and large cost savings.

To provide precision-flat workpiece surfaces, it is important to maintain the required flatness of annular band of fixed-abrasive coated raised islands during the full abrading life of an abrasive disk. This is done by selecting abrasive disks where the full surface of the abrasive is contacted by the workpiece surface. This results in uniform wear-down of the abrasive.

The many techniques already developed to maintain the abrasive surface flatness are also very effective for the fixed-spindle floating-platen lapping system. The primary technique is to use the abraded workpieces themselves to keep the abrasive flat during the lapping process. Here large workpieces (or small workpieces grouped together) are also rotated as they span the radial width of the rotating annular abrasive band. Another technique uses driven planetary workholders that move workpieces in constant orbital spiral path motions across the abrasive band width. Other techniques include the periodic use of annular abrasive coated conditioning rings to abrade the non-flat surfaces of the platen abrasive or the platen body abrading surface. These conditioning rings can be rotated while remaining at stationary positions. They also can be moved around the circumference of the platen while they are rotated by planetary circulation mechanism devices. Conditioning rings have been used for years to maintain the flatness of slurry platens that utilize loose abrasive particles. These same types of conditioning rings are also used to periodically re-flatten the fixed-abrasive continuous coated platens used in micro-grinding (flat-honing).

Workpieces are often rotated at rotational speeds that are approximately equal to the rotational speeds of the platens to provide approximately equal localized abrading speeds across the full radial width of the platen abrasive when the workpiece spindles are rotated in the same rotation direction as the platens.

Unlike slurry lapping, there is no abrasive wear of raised island abrasive disk platens because only the non-abrasive flexible disk backing surface contacts the platen surface. Here, the abrasive disk is firmly attached to the platen flat annular abrading surface. Also, the precision flatness of the high speed flat lapper abrasive surfaces can be completely re-established by simply and quickly replacing an abrasive disk having a non-flat abrasive surface with another abrasive disk that has a precision-flat abrasive surface.

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Small and medium diameter disks are very light in weight and have very little bulk thickness. They can be stored or shipped flat where individual disks lay in layers in flat contact with other companion disks. Large and very large raised island fixed-abrasive disks can be rolled and stored or shipped in polymer protective tubes. Abrasive disk and floating platens can have a wide range of abrading surface diameters that range from 2 inches (5 cm) to 72 inches (183 cm) or even much greater diameters. Abrasive disks that have non-island continuous coatings of abrasive material can also be used on the fixed-spindle floating-platen abrading system The abrasive disk quick change capability is especially desirable for laboratory lapping machines but it is also very useful for prototype lapping and for full-scale production lapping machines. This abrasive disk quick-change capability also provides a large advantage over micro-grinding (flat-honing) where it is necessary to change-out a worn heavy rigid platen or to replace it with one having different sized particles. Changing the non-flat fixed abrasive surface of a micro-grinding (flat-honing) thick abrasive wheel can not be done quickly because it is a bolted-on integral part of the rotating platen that supports it. Often, the abrasive particle sizes are sequentially changed from coarse to medium to fine during a flat lapping or abrading operation.

Hydroplaning of workpieces occurs when smooth abrasive surfaces, having a continuous thin-coated abrasive, are in fast-moving contact with a flat workpiece surface in the presence of surface water. However, hydroplaning does not occur when interrupted-surfaces, such as abrasive coated raised islands, contact a flat water-wetted workpiece surface. An analogy to the use of raised islands in the presence of coolant water films is the use of tread lugs on auto tires which are used on rain slicked roads. Tires with lugs grip the road at high speeds while bald smooth-surfaced tires hydroplane. In the same way, the abrasive coatings of the flat-surface tops of the raised islands remain in abrading contact with water-wetted flat-surfaced workpieces, even at very high abrading speeds.

A uniform thermal expansion and contraction of air bearing spindles occurs on all of the air bearing spindles mounted on the granite or other material machine bases when each of individual spindles are mounted with the same methods on the bases. The spindles can be mounted on spindle legs attached to the bottom of the spindles or the spindles can be mounted to legs that are attached to the upper portion of the spindle bodies and the length expansion or shrinkage of all of the spindles will be the same. This insures that precision abrading can be achieved with these fixed-spindle floating-platen abrading systems.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring.

U.S. Pat. No. 6,506,105 (Kajiwara et al) describes a CMP wafer polishing apparatus that uses a CMP with a separate retaining ring and wafer pr3essure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

Various abrading machines and abrading processes are described in U.S. Pat. Nos. 5,364,655 (Nakamura et al). 5,569,062 (Karlsrud), 5,643,067 (Katsuoka et al), 5,769,697 (Nisho), 5,800,254 (Motley et al), 5,916,009 (Izumi et al), 5,964,651 (hose), 5,975,997 (Minami, 5,989,104 (Kim et al), 6,089,959 (Nagahashi, 6,165,056 (Hayashi et al), 6,168,506 (McJunken), 6,217,433 (Herrman et al), 6,439,965 (Ichino), 6,893,332 (Castor), 6,896,584 (Perlov et al), 6,899,603 (Homma et al), 6,935,013 (Markevitch et al), 7,001,251

(Doan et al), 7,008,303 (White et al), 7,014,535 (Custer et al), 7,029,380 (Horiguchi et al), 7,033,251 (Elledge), 7,044,838 (Maloney et al), 7,125,313 (Zelenski et al), 7,144,304 (Moore), 7,147,541 (Nagayama et al), 7,166,016 (Chen), 7,250,368 (Kida et al), 7,367,867 (Boller), 7,393,790 (Britt et al), 7,422,634 (Powell et al), 7,446,018 (Brogan et al), 7,456,106 (Koyata et al), 7,470,169 (Taniguchi et al), 7,491,342 (Kamiyama et al), 7,507,148 (Kitahashi et al), 7,527,722 (Sharan) and 7,582,221 (Netsu et al).

SUMMARY OF THE INVENTION

The presently disclosed technology includes a fixed-spindle, floating-platen system which is a new configuration of a single-sided lapping machine system. This system is capable of producing ultra-flat thin semiconductor wafer workpieces at high abrading speeds. This can be done by providing a precision-flat, rigid (e.g., synthetic, composite or granite) machine base that is used as the planar mounting surface for at least three rigid flat-surfaced rotatable workpiece spindles. Precision-thickness flexible abrasive disks are attached to a rigid flat-surfaced rotary platen that floats in three-point abrading contact with the three equal-spaced flat-surfaced rotatable workpiece spindles. These abrasive coated raised island disks have disk thickness variations of less than 0.0001 inches (3 microns) across the full annular bands of abrasive-coated raised islands to allow flat-surfaced contact with workpieces at very high abrading speeds and to assure that all of the expensive diamond abrasive particles that are coated on the island are fully utilized during the abrading process. Use of a platen vacuum disk attachment system allows quick set-up changes where different sizes of abrasive particles and different types of abrasive material can be quickly attached to the flat platen surfaces.

Water coolant is used with these raised island abrasive disks, which allows them to be used at very high abrading speeds, often in excess of 10,000 SFPM (160 km per minute). The coolant water is typically applied directly to the top surfaces of the workpieces. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading and with continuous-coated abrasive disks.

The fixed-spindle floating-platen flat lapping system has two primary planar references. One planar reference is the precision-flat annular abrading surface of the rotatable floating platen. The other planar reference is the precision co-planar alignment of the flat surfaces of the rotary spindle tops of the three workpiece spindles that provide three-point support of the floating platen.

Flat surfaced workpieces are attached to the spindle tops and are contacted by the abrasive coating on the platen abrading surface. Both the workpiece spindles and the abrasive coated platens are simultaneously rotated while the platen abrasive is in controlled abrading pressure contact with the exposed surfaces of the workpieces. Workpieces are sandwiched between the spindle tops and the floating platen. This lapping process is a single-sided workpiece abrading process. The opposite surfaces of the workpieces can be lapped by removing the workpieces from the spindle tops, flipping them over, attaching them to the spindle tops and abrading the second opposed workpiece surfaces with the platen abrasive.

A granite machine base provides a dimensionally stable platform upon which the three (or more) workpiece spindles are mounted. The spindles must be mounted where their spindle tops are precisely co-planar within 0.0001 inches (3 microns) in order to successfully perform high speed flat lapping. The rotary workpiece spindles must provide rotary spindle tops that remain precisely flat at all operating speeds. Also, the spindles must be structurally stiff to avoid deflections in reaction to static or dynamic abrading forces.

Air bearing spindles are the preferred choice over roller bearing spindles for high speed flat lapping. They are extremely stiff, can be operated at very high rotational speeds and are frictionless. Because the air bearing spindles have no friction, torque feedback signal data from the internal or external spindle drive motors can be used to determine the state-of-finish of lapped workpieces. Here, as workpieces become flatter and smoother, the water wetted adhesive bonding stiction between the flat surfaced workpieces and the flat-type abrasive media increase. The relationship between the state-of-finish of the workpieces and the adhesive stiction is a very predictable characteristic and can be readily used to control or terminate the flat lapping process.

Air bearing or mechanical roller bearing workpiece spindles having equal precision heights can be mounted on precisely flat granite bases to provide a system where the flat spindle tops are precisely co-planar with each other. These precision height spindles and precision flat granite bases are more expensive than commodity type spindles and granite bases. Commodity type air bearing spindles and non-precision flat granite bases can be utilized with the use of adjustable height legs that are attached to the bodies of the spindles. The flat surfaces of the spindle tops can be aligned to be precisely co-planar within the required 0.0001 inches (3 microns) with the use of a rotating leaser beam measurement device supplied by Hamar Laser Inc. of Danbury, Conn.

An alternative method that can be used to attach spindles to granite bases is to provide spherical-action mounts for each spindle. These spherical mounts allow each spindle top to be aligned to be co-planar with the other attached spindles. Workpiece spindles are attached to the rotor portion of the spherical mount that has a spherical-action rotation within a spherical base that has a matching spherical shaped contacting area. The spherical-action base is attached to the flat surface of a granite machine base. After the spindle tops are precisely aligned to be co-planar with each other, a mechanical or adhesive-based fastener device is used to fixture or lock the spherical mount rotor to the spherical mount base. Using these spherical-action mounts, the precision aligned workpiece spindles are structurally attached to the granite base.

Another very simple technique that can be used for co-planar alignment of the spindle-tops is to use the precision-flat surface of a floating platen annular abrading surface as a physical planar reference datum for the spindle tops. Platens must have precision flat surfaces where the flatness variation is less than 0.0001 inches (3 microns) in order to successfully perform high speed flat lapping. Here, the precision-flat platen is brought into flat surfaced contact with the spindle-tops where pressurized air or a liquid can be applied through fluid passageways to form a spherical-action fluid bearing that allows the spherical rotor to freely float without friction within the spherical base. This platen surface contacting action aligns the spindle-tops with the flat platen surface. By this platen-to-spindles contacting action, the spindle tops are also aligned to be co-planar with each other. After co-planar alignment of the spindle tops, vacuum can be applied through the fluid passageways to temporarily lock the spherical rotors to the spherical bases. Then, a mechanical fastener or an adhesive-based fastener device is used to fixture or lock the spherical mount rotor to the spherical mount base. When using an adhesive rotor locking system, an adhesive can be applied in a small gap between a removable bracket that is attached to the spherical rotor and a removable bracket that is attached to the spherical base to rigidly bond the spherical rotor to the spherical base after the adhesive is solidified. If it is desired to re-align the spindle top, the removable spherical mount rotor and spherical base adhesive brackets can be discarded and replaced with new individual brackets that can be adhesively bonded together to again lock the spherical mount rotors to the respective spherical bases.

The fixed-platen floating-spindle lapping system can also be used to recondition the abrasive surface of the abrasive disk that is attached to the platen. This rotary platen annular abrasive surface tends to experience uneven wear across the radial surface of the annular abrasive band after continued abrading contact with the spindle workpieces. When the non-even wear of the abrasive surface becomes excessive and the abrasive can no longer provide precision-flat workpiece surfaces it must be reconditioned to re-establish its planar flatness.

Reconditioning the platen abrasive surface can be easily accomplished with this system by attaching equal-thickness abrasive disks to the flat surfaces of the spindles in place of the workpieces. Here, the abrasive surface reconditioning takes place by rotating the spindle abrasive disks while they are in flat-surfaced abrading contact with the rotating platen abrasive annular band.

In addition, the fixed-platen floating-spindle lapping system can also be used to recondition the platen bare (no abrasive coating) abrading surface by attaching equal-thickness abrasive disks, or other abrasive devices such as abrasive coated conditioning rings, to the flat surfaces of the rotary spindle tops in place of the workpieces. Here, the platen annular abrading surface reconditioning takes place by rotating the spindle abrasive disks, or conditioning rings, while they are in flat-surfaced abrading contact with the rotating platen annular abrading surface.

Automatic robotic devices can be added to the fixed-spindle-floating-platen system to change both the workpieces and the abrasive disks.

The fixed-platen floating-spindle lapping system has the capability to resist large mechanical abrading forces present with abrading processes with unprecedented flatness accuracies and minimum mechanical planar flatness variations. Because the system is comprised of robust components it has a long lifetime with little maintenance even in the harsh abrading environment present with most abrading processes. Air bearing spindles are not prone to failure or degradation and provide a flexible system that is quickly adapted to different polishing processes.

Platen surfaces have patterns of vacuum port holes that extend under the abrasive annular portion of an abrasive disk to assure that the disk is firmly attached to the platen surface. When an abrasive disk is attached to a flat platen surface with vacuum, the vacuum applies in excess of 10 pound per square inch (0.7 kg per square cm) hold-down clamping forces to bond the flexible abrasive disk to the platen. Because the typical abrasive disks have such a large surface area, the total vacuum clamping forces can easily exceed thousands of pounds of force which results in the flexible abrasive disk becoming an integral part of the structurally stiff and heavy platen. Use of the vacuum disk attachment system assures that each disk is in full conformal contact with the platen flat surface. Also, each individual disk can be marked so that it can be remounted in the exact same tangential position on the platen by using the vacuum attachment system. Here, a disk that is "worn-in" to compensate for the flatness variation of a given platen will recapture the unique flatness characteristics of that platen position by orienting the disk and attaching it to the platen at its original platen circumference position. This abrasive disk will not have to be "worn-in" again upon reinstallation. Expensive diamond abrasive particles are sacrificed each time it is necessary to wear-in an abrasive disk to establish a precision flatness of the disk abrasive surface. The original surface-flatness of the abrasive disk is re-established by simply mounting the previously removed abrasive disk in the same circumferential location on the platen that it had before it was removed from that same platen

DETAILED DESCRIPTION OF THE INVENTION

Figure 1:
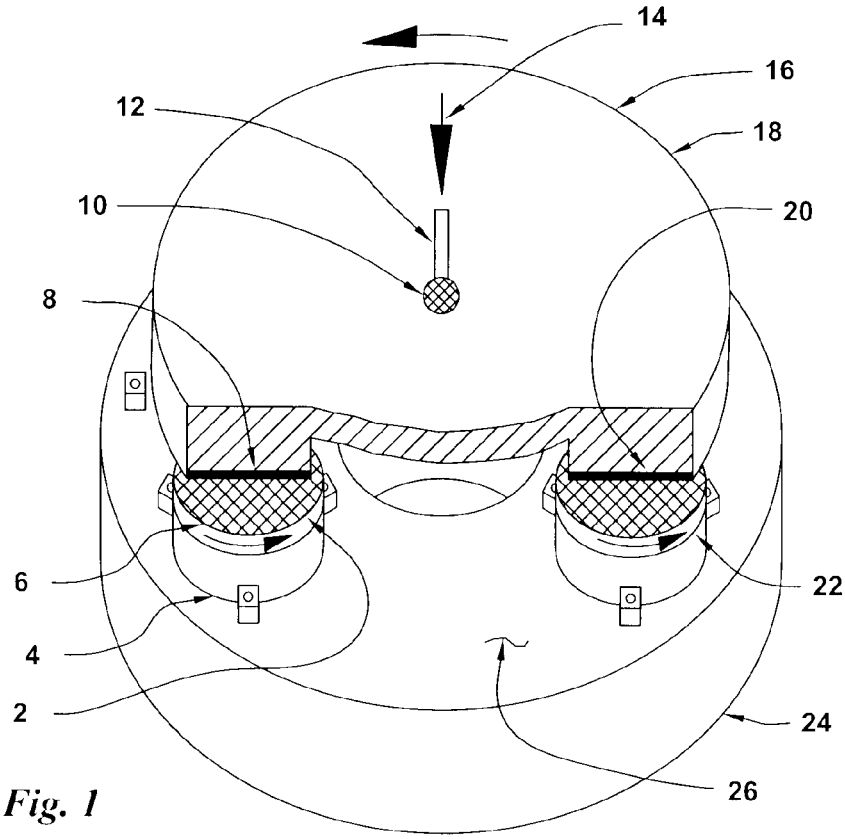
FIG. 1 is an isometric view of three-point spindles supporting a floating abrasive platen.

FIG. 1 is an isometric view of an abrading system 45 having three-point fixed-position rotating workpiece spindles supporting a floating rotating abrasive platen. Three evenly-spaced rotatable spindles 4 (one not shown) having rotating tops 22 that have attached workpieces 6 support a floating abrasive platen 16. The platen 16 has a vacuum, or other, abrasive disk attachment device (not shown) that is used to attach an annular abrasive disk 20 to the precision-flat platen 16 abrasive-disk mounting surface 8. The abrasive disk 20 is in flat abrasive surface contact with all three of the workpieces 6. The rotating floating platen 16 is driven through a spherical-action universal-joint type of device 10 having a platen drive shaft 12 to which is applied an abrasive contact force 14 to control the abrading pressure applied to the workpieces 6. The workpiece rotary spindles 4 are mounted on a granite, or other material, base 24 that has a flat surface 26. The three workpiece spindles 4 have spindle top surfaces that are co-planar. The workpiece spindles 4 can be interchanged or a new workpiece spindle 4 can be changed with an existing spindle 4 where the flat top surfaces of the spindles 4 are co-planar. Here, the equal-thickness workpieces 6 are in the same plane and are abraded uniformly across each individual workpiece 6 surface by the platen 16 precision-flat planar abrasive disk 20 abrading surface. The planar abrading surface 8 of the floating platen 16 is approximately co-planar with the flat surface 26 of the granite base 24.

The spindle 4 rotating surfaces spindle tops 22 can driven by different techniques comprising spindle 4 internal spindle shafts (not shown), external spindle 4 flexible drive belts (not shown) and spindle 4 internal drive motors (not shown). The individual spindle 4 spindle tops 22 can be driven independently in both rotation directions and at a wide range of rotation speeds including very high speeds of 10,000 surface feet per minute (3,048 meters per minute). Typically the spindles 4 are air bearing spindles that are very stiff to maintain high rigidity against abrading forces and they have very low friction and can operate at very high rotational speeds. Suitable roller bearing spindles can also be used in place of air bearing spindles.

Abrasive disks (not shown) can be attached to the spindle 4 spindle tops 22 to abrade the platen 16 annular flat surface 8 by rotating the spindle tops 22 while the platen 16 flat surface 8 is positioned in abrading contact with the spindle abrasive disks that are rotated in selected directions and at selected rotational speeds when the platen 16 is rotated at selected speeds and selected rotation direction when applying a controlled abrading force 14. The top surfaces 2 of the individual three-point spindle 4 rotating spindle tops 22 can be also be abraded by the platen 16 planar abrasive disk 20 by placing the platen 16 and the abrasive disk 20 in flat conformal contact with the top surfaces 2 of the workpiece spindles 4 as both the platen 16 and the spindle tops 22 are rotated in selected directions when an abrading pressure force 14 is applied. The top surfaces 2 of the spindles 4 abraded by the platen 16 results in all of the spindle 4 top surfaces 2 being in a common plane.

The granite base 24 is known to provide a time-stable precision-flat surface 26 to which the precision-flat three-point spindles 4 can be mounted. One unique capability provided by this abrading system 18 is that the primary datum-reference can be the fixed-position granite base 24 flat surface 26. Here, spindles 4 can all have the precisely equal heights where they are mounted on a precision-flat surface 26 of a granite base 24 where the flat surfaces of the spindle tops 2 are co-planar with each other.

When the abrading system is initially assembled it can provide extremely flat abrading workpiece 6 spindle 4 top 22 mounting surfaces and extremely flat platen 16 abrading surfaces 8. The extreme flatness accuracy of the abrading system 18 provides the capability of abrading ultra-thin and large-diameter and high-value workpieces 6, such as semiconductor wafers, at very high abrading speeds with a fully automated workpiece 6 robotic device (not shown).

In addition, the system 18 can provide unprecedented system 18 component flatness and workpiece abrading accuracy by using the system 18 components to "abrasively dress" other of these same-machine system 18 critical components such as the spindle tops 22 and the platen 16 planar-surface 8. These spindle top 22 and the platen 16 annular planar surface 8 component dressing actions can be alternatively repeated on each other to progressively bring the system 18 critical components comprising the spindle tops 22 and the platen 16 planar-surface 8 into a higher state of operational flatness perfection than existed when the system 18 was initially assembled. This system 18 self-dressing process is simple, easy to do and can be done as often as desired to reestablish the precision flatness of the system 18 component or to improve their flatness for specific abrading operations.

This single-sided abrading system 18 self-enhancement surface-flattening process is unique among conventional floating-platen abrasive systems. Other abrading systems use floating platens but these systems are typically double-sided abrading systems. These other systems comprise slurry lapping and micro-grinding (flat-honing) systems that have rigid bearing-supported rotated lower abrasive coated platens. They also have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) often have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface;

and the constant wear-down of the lower platen abrading surface by abrading contact with the workpieces that are in moving abrading contact with the lower platen abrasive surface. The single-sided abrading system 18 is completely different than the double-sided system (not-shown).

The floating platen 16 system 18 performance is based on supporting a floating abrasive platen 16 on the top surfaces 2 of three-point spaced fixed-position rotary workpiece spindles 4 that are mounted on a stable machine base 24 flat surface 26 where the top surfaces 2 of the spindles 4 are precisely located in a common plane. The top surfaces 2 of the spindles 4 can be approximately or substantially co-planar with the precision-flat surface 26 of a rigid fixed-position granite, or other material, base 24 or the top surfaces 2 of the spindles 4 can be precisely co-planar with the precision-flat surface 26 of a rigid fixed-position granite, or other material, base 24. The three-point support is required to provide a stable support for the floating platen 16 as rigid components, in general, only contact each other at three points. As an option, additional spindles 4 can be added to the system 18 by attaching them to the granite base 24 at locations between the original three spindles 4.

This three-point workpiece spindle abrading system 18 can also be used for abrasive slurry lapping (not shown), for micro-grinding (flat-honing) (not shown) and also for chemical mechanical planarization (CMP) (not shown) abrading to provide ultra-flat abraded workpieces 6.

Figure 2:
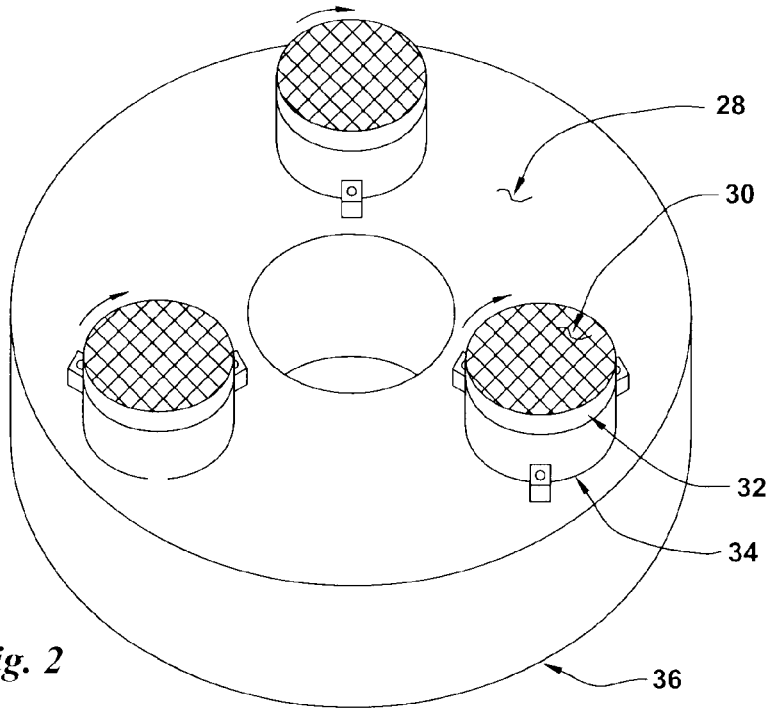
FIG. 2 is an isometric view of three-point fixed-position spindles mounted on a granite base.

FIG. 2 is an isometric view of three-point fixed-position spindles mounted on a granite base. A granite base 36 has a precision-flat top surface 28 that supports three attached workpiece spindles 34 that have rotatable driven tops 32 where flat-surfaced workpieces 30 are attached to the flat-surfaced spindle tops 32.

Figure 3:
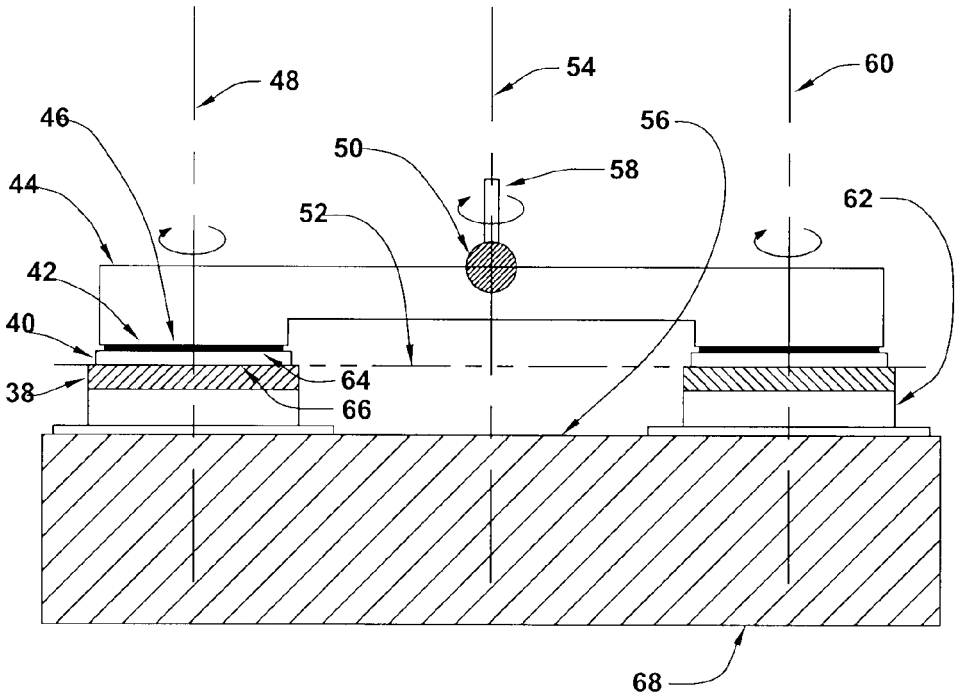
FIG. 3 is a cross section view of three-point spindles supporting a floating abrasive platen.

FIG. 3 is a cross section view of three-point fixed-position spindles supporting a rotating floating abrasive platen. A floating circular platen 44 has a spherical-action rotating drive mechanism 50 having a drive shaft 58 where the platen 44 rotates about an axis 54. Three workpiece spindles 62 (one not shown) having rotatable spindle tops 38 that have flat top surfaces 66 are mounted to the top precision-flat surface 56 of a machine base 68 that is constructed from granite, metal or composite or other materials. The flat top surfaces of the spindle tops 38 are all in a common plane 52 where the spindle plane 52 is precisely co-planar with the top flat surface 56 of the machine base 68. Equal-thickness flat-surfaced workpieces 40 are attached to the spindle top 38 flat surfaces 66 by a vacuum, or other, disk attachment device where the top surfaces of the three workpieces 40 are mutually contacted by the abrading surface 64 of an annular abrasive disk 42 that is attached to the platen 44. The platen 44 disk attachment surface 46 is precisely flat and the precision-thickness abrasive disk 42 annular abrasive surface 64 is precisely co-planar with the platen 44 disk attachment surface 46. The annular abrasive surface 64 is precisely co-planar with the flat top surfaces of each of the three independent spindle top 38 flat surfaces 3 and also, co-planar with the spindle plane 52. The floating platen 44 is supported by the three equally-spaced spindles 62 where the flat disk attachment surface 46 of the platen 44 is co-planar with the top surface 56 of the machine base 68. The three equally-spaced spindles 62 of the three-point set of spindles 62 provide stable support to the floating platen 44. The spherical platen 44 drive mechanism 50 restrains the platen 44 in a circular platen 44 radial direction. The spindle tops 38 are driven (not shown) in either clockwise or counterclockwise directions with rotation axes 48 and 60 while the rotating platen 44 is also driven. Typically, the spindle tops 38 are driven in the same rotation direction as the platen 44. The workpiece spindle 62 tops 38 can be rotationally driven by motors (not shown) that are an integral part of the spindles 62 or the tops 38 can be driven by internal spindle shafts (not shown) that extend through the bottom mounting surface of the spindles 62 and into or through the granite machine base 68 or the spindles 62 can be driven by external drive belts (not shown).

Figure 4:
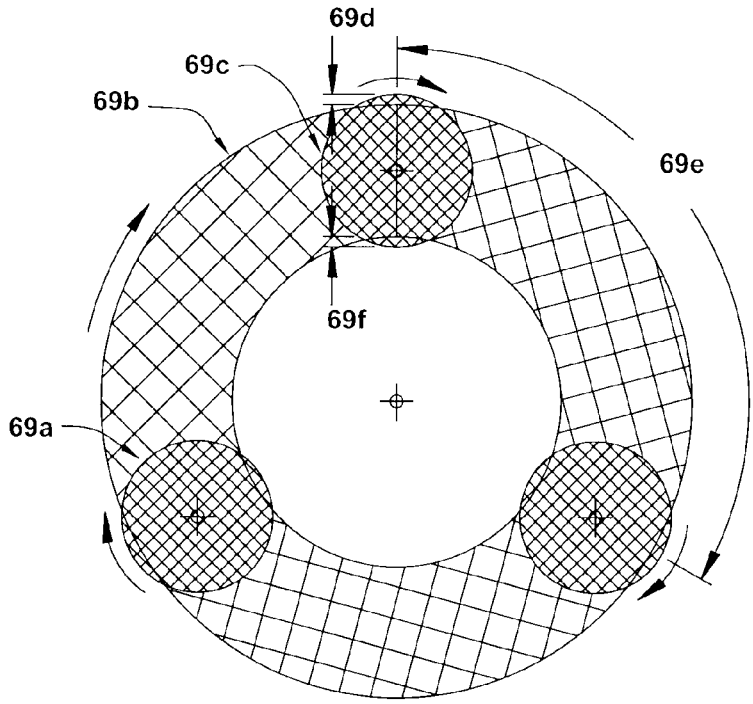
FIG. 4 is a top view of three-point fixed-spindles supporting a floating abrasive platen.

FIG. 4 is a top view of three-point fixed-spindles supporting a floating abrasive platen. Workpieces 69*c* are attached to three rotatable spindles 69*a* where the workpieces 69*c* are in abrading contact with an annular band of abrasive 69*b* where the workpieces 69*c* overhang the outer periphery of the abrasive 69*b* by a distance 69*d* and overhang the inner periphery of the abrasive 69*b* by a distance 69*f*. Each of the three spindles 69*a* are shown separated by an angle 69*e* of approximately 120 degrees to provide three-point support of the rotating platen (not shown) having an annular band of abrasive 69*b*.

Figure 5:
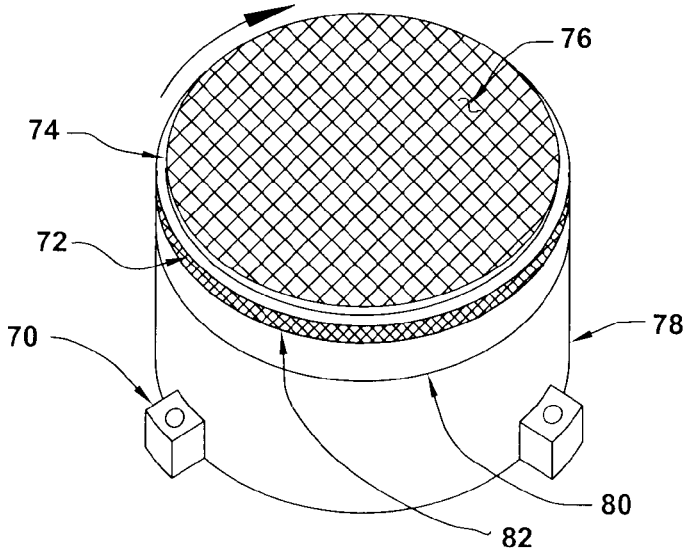
FIG. 5 is an isometric view of a workpiece spindle having three-point mounting legs.
Figure 6:
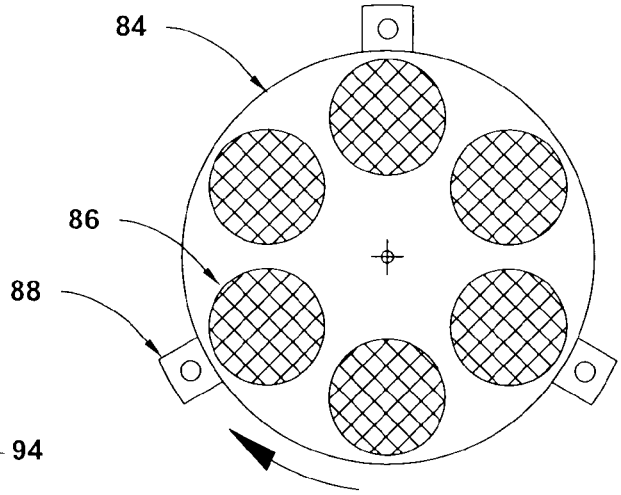
FIG. 6 is a top view of a workpiece spindle having multiple circular workpieces.
Figure 7:
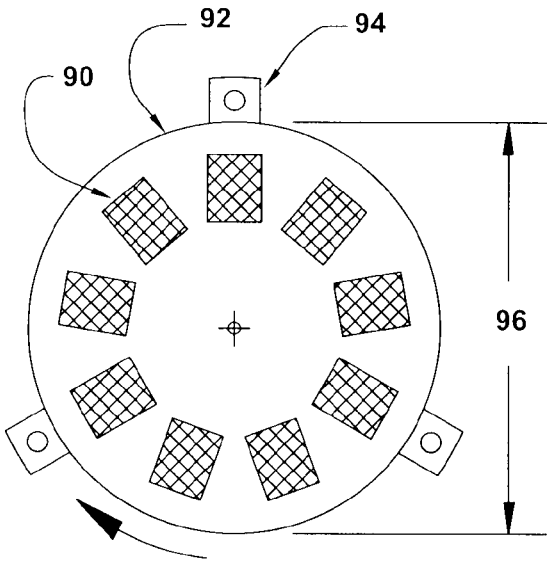
FIG. 7 is a top view of a workpiece spindle having multiple rectangular workpieces.

FIG. 5 is an isometric view of a workpiece spindle having three-point mounting legs. The workpiece rotary spindle 78 has a rotary spindle top 80 that has a precision-flat surface 82 to which is attached a precision-flat vacuum chuck device 72 that has co-planar opposed flat surfaces. A flat-surfaced workpiece 74 has an exposed flat surface 76 that is abraded by an abrasive coated platen (not shown). The workpiece spindle 78 is three-point supported by spindle legs 70. The workpiece 74 shown here has a diameter of 12 inches and is supported by a spindle 78 having a 12 inch diameter and a rotary spindle top 80 top flat surface 82 that has a diameter of 12 inches. FIG. 6 is a top view of a workpiece spindle having multiple circular workpieces. A workpiece rotary spindle 84 having three-point support legs 88 where the spindle 84 supports small circular flat-surfaced workpieces 86 that are abraded by an abrasive coated platen (not shown). FIG. 7 is a top view of a workpiece spindle having multiple rectangular workpieces. A workpiece rotary spindle 92 has a spindle diameter 96 and three-point support legs 94 where the spindle 92 supports small circular flat-surfaced workpieces 90 that are abraded by an abrasive coated platen (not shown).

Figure 8:
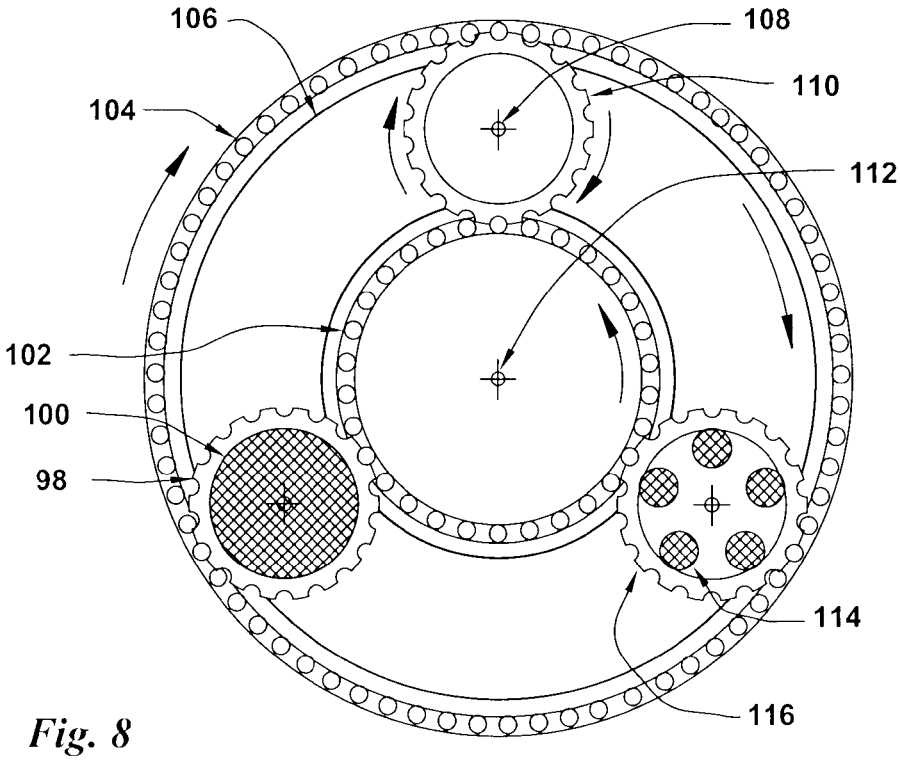
Fig. 8 Prior Art
FIG. 8 is a top view of workpieces and planetary workholders on an abrasive platen.

FIG. 8 is a top view of prior art pin-gear driven planetary workholders and workpieces on an abrasive platen. A rotating annular abrasive coated platen 106 and three planetary workholder disks, 110, 116 and 98 that are driven by a platen 106 outer periphery pin-gear 104 and a platen 106 inner periphery pin-gear 102 are shown. Typically the outer periphery pin-gear 104 and the inner periphery pin-gear 102 are driven in opposite directions where the three planetary workholder disks 110, 116 and 98 rotate about a workholder rotation axis 108 but maintain a stationary position relative to the platen 106 rotation axis 112 or they slowly rotate about the platen 106 rotation axis 112 as the platen 106 rotates about the platen rotation axis 112. The outer pin-gears 104 and the inner pin-gears 102 rotate independently in either rotation direction and at different rotation speeds to provide different rotation speeds of the workholder disks 110, 116 and 98 about the workholder rotation axes 108 and also to provide different rotation directions and speeds of the workholders disks 110, 116 and 98 about the platen 106 rotation axis 112. A single individual large-diameter flat-surfaced workpiece 100 is positioned inside the rotating workholder 98 and multiple small-diameter flat-surfaced workpieces 114 are positioned inside the rotating workholder 116. The workholder 110 does not contain a workpiece.

Figure 9:
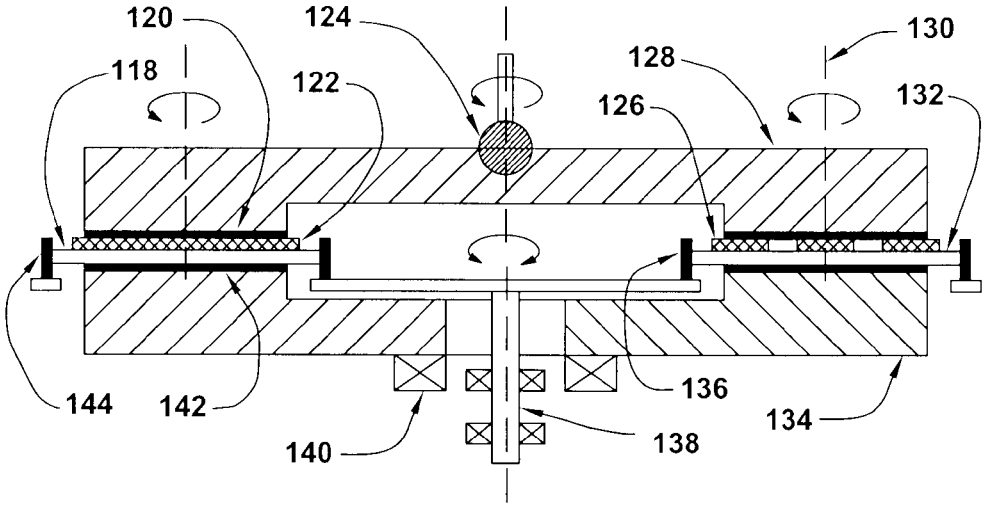
Fig. 9 Prior Art
FIG. 9 is a cross section view of planetary workholders and a double-sided abrasive platen.

FIG. 9 is a cross section view of prior art planetary workholders, workpieces and a double-sided abrasive platen. The abrading surface 120 of a rotating upper floating platen 128 and the abrading surface 142 of a rotating lower rigid platen 134 are in abrading contact with flat-surfaced workpieces 122 and 126. A planetary workholder 118 contains a single large-sized workpiece 122 and the planetary workholder 132 contains multiple small-sized workpieces 126. The planetary flat-surfaced workholder disks 118 and 132 rotate about a workholder axis 130 and the workholder disks 118 and 132 are driven by outer periphery pin-gears 146 and inner periphery pin-gears 136. The inner periphery pin-gears 136 are mounted on a rotary drive spindle that has a spindle shaft 138. The rigid-mounted lower platen 134 is supported by platen bearings 140. The floating upper spindle 128 is driven by a spherical rotation device 124 that allows the platen 128 to be conformably supported by the equal-thickness workpieces 122 and 126 that are supported by the lower rigid platen 134.

Figure 10:
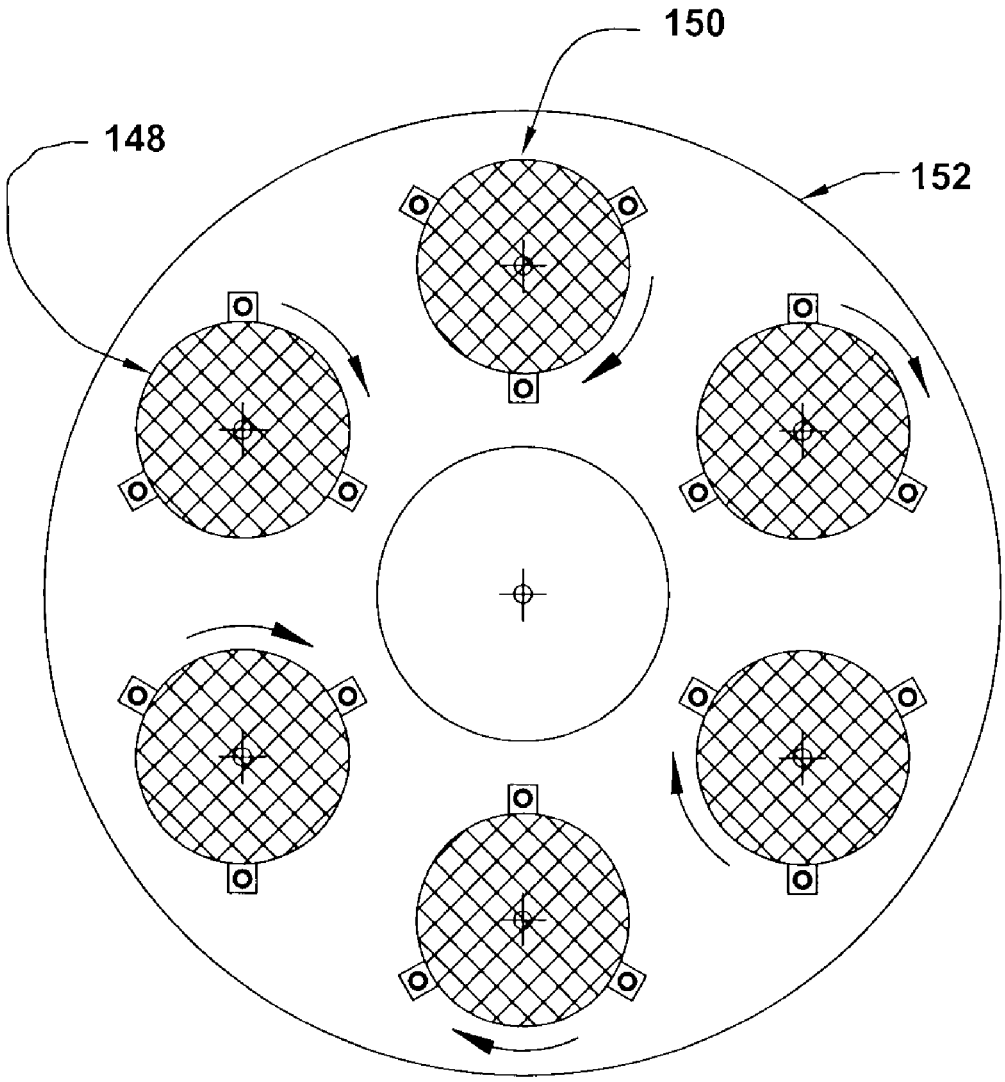
FIG. 10 is a top view of multiple fixed-spindles that support a floating abrasive platen.
Figure 11:
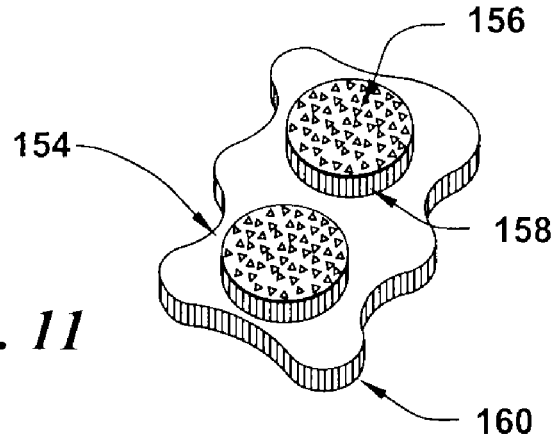
FIG. 11 is an isometric view of fixed-abrasive coated raised islands on an abrasive disk.
Figure 12:
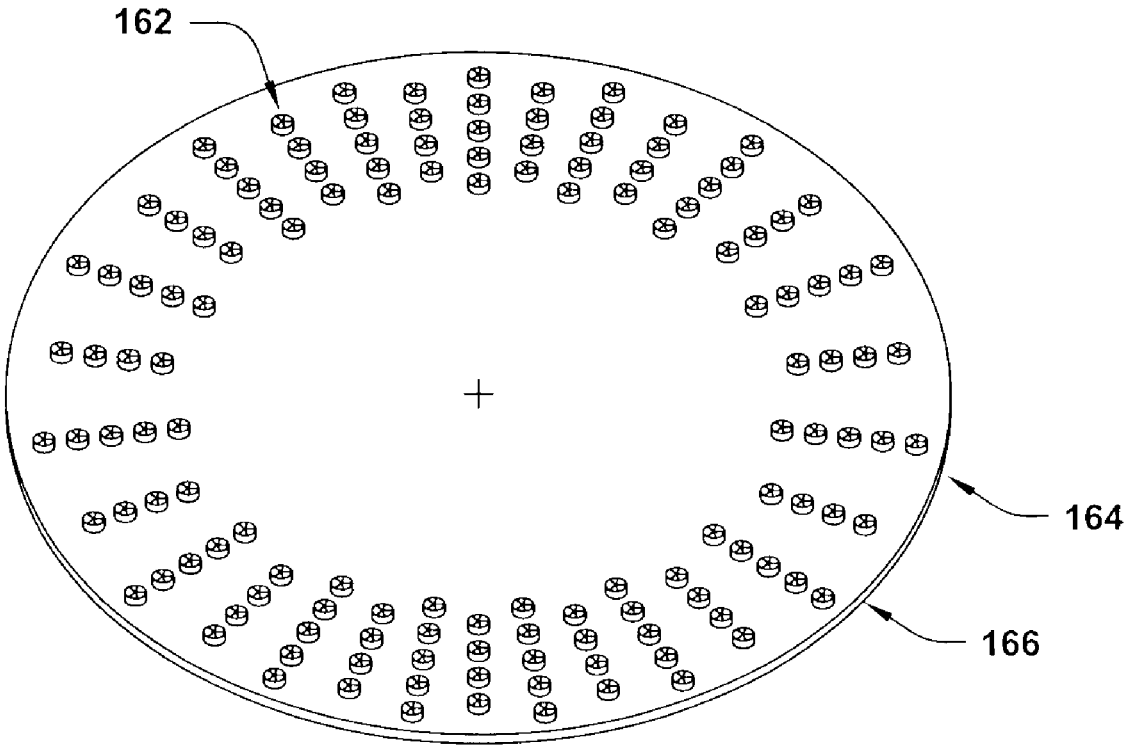
FIG. 12 is an isometric view of a fixed-abrasive coated raised island abrasive disk.

FIG. 10 is a top view of multiple fixed-spindles that support a floating abrasive platen. A flat-surfaced granite base 152 supports multiple fixed-position air bearing spindles 148 that have rotating flat-surfaced tops 150. The multiple spindles 148 support a floating abrasive platen (not shown) flat abrading surface on the multiple spindle top 150 flat surfaces that are all co-planar. FIG. 11 is an isometric view of fixed-abrasive coated raised islands on an abrasive disk. Abrasive particle 156 coated raised islands 158 are attached to an abrasive disk 154 backing 160. FIG. 12 is an isometric view of a flexible fixed-abrasive coated raised island abrasive disk. Abrasive particle coated raised islands 162 are attached to an abrasive disk 166 backing 164.

Figure 13:
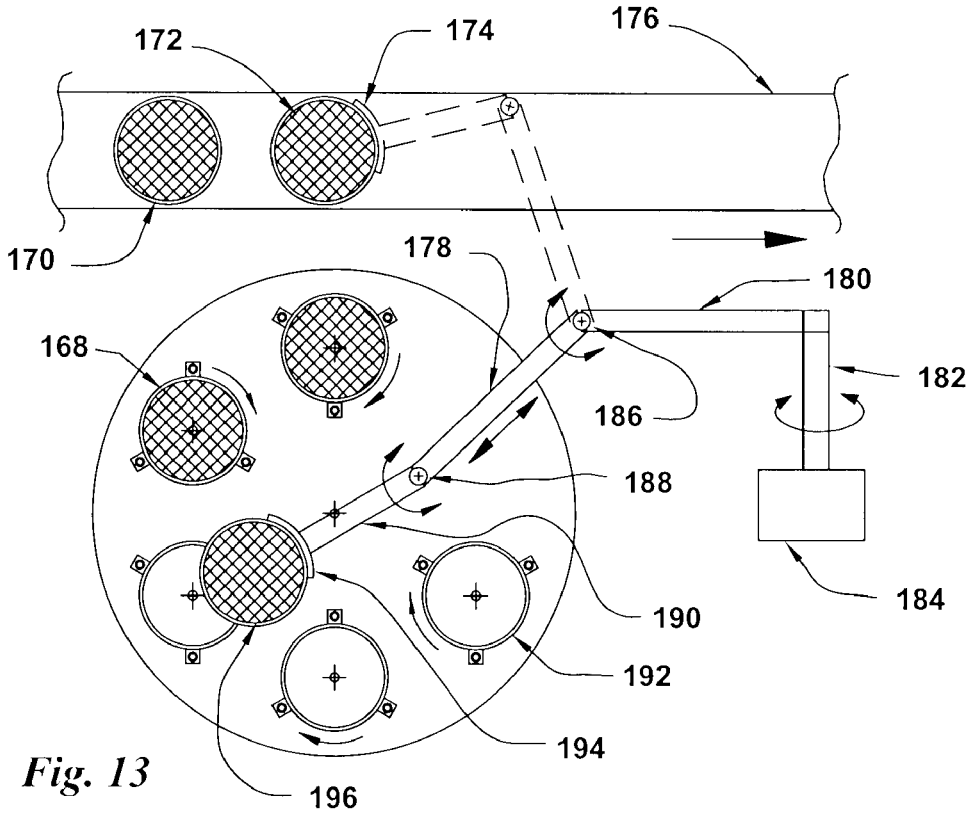
FIG. 13 is a top view of an automatic robotic workpiece loader for multiple spindles.

FIG. 13 is a top view of an automatic robotic workpiece loader for multiple spindles. An automated robotic device 184 has a rotatable shaft 182 that has an arm 180 to which is connected a pivot arm 178 that, in turn, supports another pivot arm 190. A pivot joint 188 joins pivot arms 190 and 178 and pivot joint 186 joins pivot arms 178 and 180. A workpiece carrier holder 194 attached to the pivot arm 190 holds a workpiece carrier 196 that contains a workpiece 168 where the robotic device 184 positions the workpiece 168 and carrier 196 on and concentric with the workpiece rotary spindle 192. Other workpieces 172 and carriers 170 are shown on a moving workpiece transfer belt 176 where they are picked up by the carrier holder 174. The workpieces 168 and 172 and workpiece carriers 196, 170 can also be temporarily stored in other devices comprising cassette storage devices (not shown). The workpieces 168, 172 and workpiece carriers 196, 170 can also be removed from the spindles 192 after the workpieces 196, 170 are abraded and the workpieces 168, 172 and workpiece carriers 196, 170 can then be placed in or on a moving belt (not shown) or a cassette device (not shown). The workpieces 168, 172 can also optionally be loaded directly on the spindles 192 without the use of the workpiece carriers 196, 170. Access for the robotic device 184 is provided in the open access area between two wide-spaced adjacent spindles 192.

Figure 14:
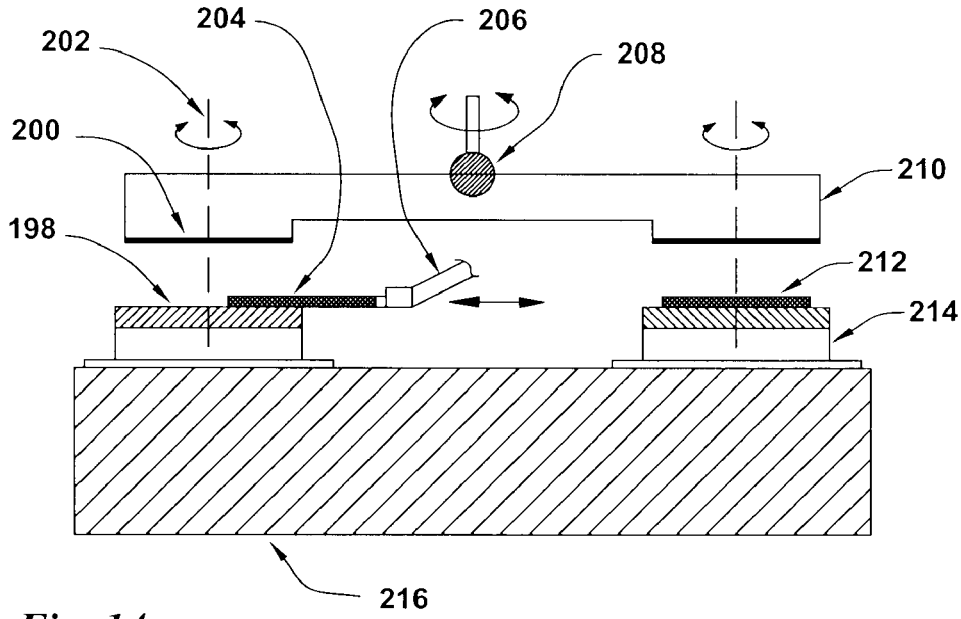
FIG. 14 is a side view of an automatic robotic workpiece loader for multiple spindles.

FIG. 14 is a side view of an automatic robotic workpiece loader for multiple spindles. An automated workpiece loader device 206 (partially shown) can be used to load workpieces 204, 212 onto spindles 214 that have spindle tops that have flat surfaces 198 and where the spindle tops rotate about the spindle axis 202. A floating platen 210 that is rotationally driven by a spherical-action device 208 has an annular abrasive surface 200 that contacts the equal-thickness workpieces 204 and 212 where the platen 210 is partially supported by abrading contact with the three independent three-point spindles 214 and the abrading pressure on the workpieces 204 and 212 is controlled by controlled force-loading of the spherical action device 208. The spindles 214 are supported by a granite machine base 216.

Figure 15:
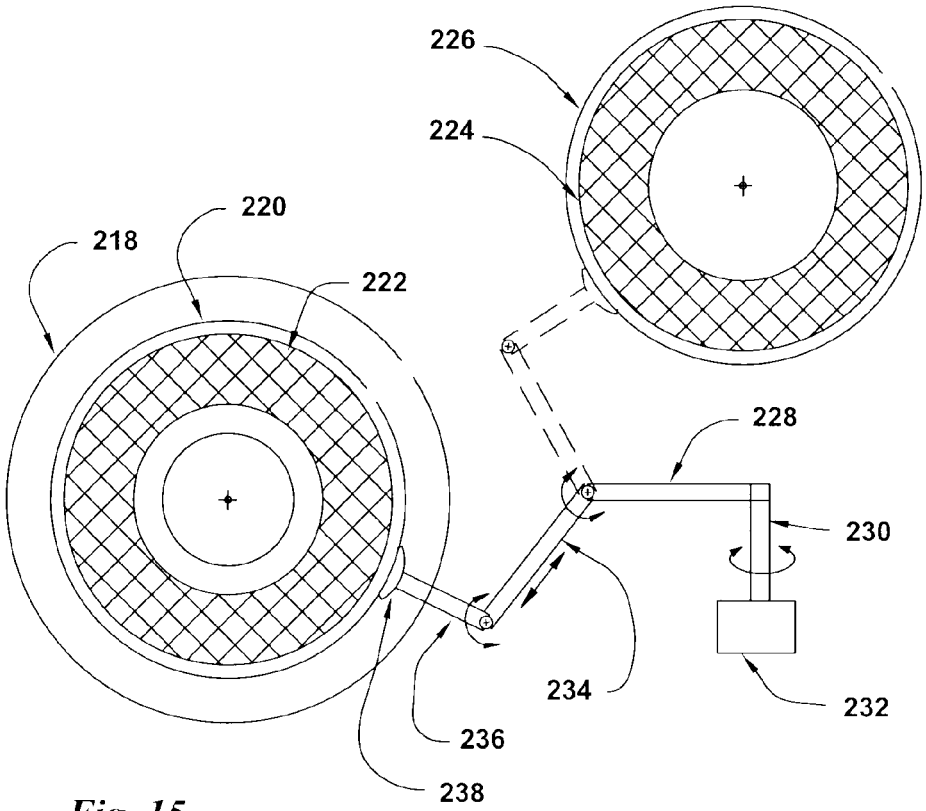
FIG. 15 is a top view of an automatic robotic abrasive disk loader for an upper platen.

FIG. 15 is a top view of an automatic robotic abrasive disk loader for an upper platen. An automated robotic device 232 has a rotatable shaft 230 that has an arm 228 to which is connected a pivot arm 234 that, in turn, supports another pivot arm 236. An abrasive disk carrier holder 238 attached to the pivot arm 236 holds an abrasive disk carrier 220 that contains an abrasive disk 222 where the robotic device 232 positions the abrasive disk 222 and disk carrier 220 on and concentric with the platen 218. Another abrasive disk 224 and abrasive disk carrier plate 226 are shown in a remote location where the abrasive disk 224 can also be temporarily stored in other devices comprising cassette storage devices (not shown). Guide or stop devices (not shown) can be used to aid concentric alignment of the abrasive disk 222 and the platen 218 and the robotic device can position the abrasive disk 222 in flat conformal contact with the flat-surfaced platen 218 after which, vacuum (not shown) is applied to attach the disk 222 to the platen 218 flat abrading surface (not shown). Then the pivot arms 236, 234 and 228 and the carrier holder 238 and the disk carrier 220 are translated back to a location away from the platen 218.

Figure 16:
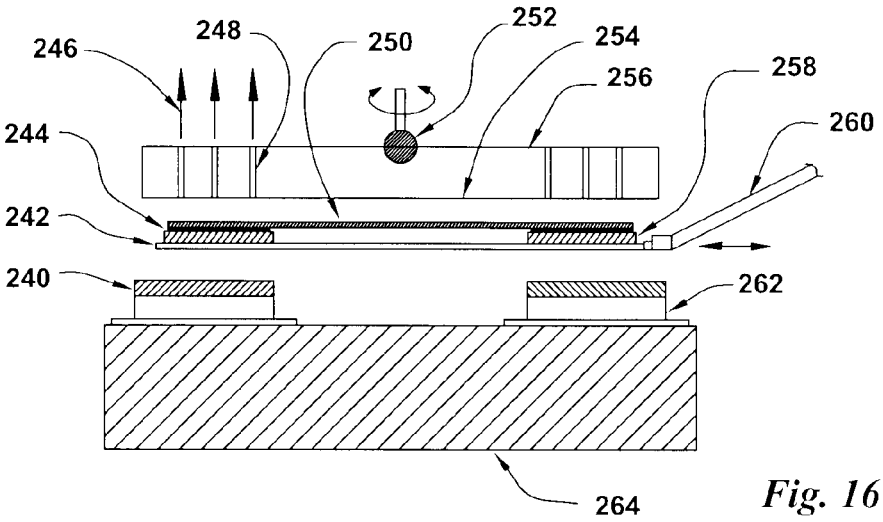
FIG. 16 is a side view of an automatic robotic abrasive disk loader for an upper platen.

FIG. 16 is a side view of an automatic robotic abrasive disk loader for an upper platen. An automated robotic device 260 (partially shown) has a carrier holder plate 242 that has an attached resilient annular disk support pad 258 that supports an abrasive disk 250 that has an abrasive layer 244. The abrasive disk carrier holder 242 that contains an abrasive disk 250 is moved where the robotic device 260 positions the abrasive disk 250 and disk carrier 242 on to and concentric with the platen 256. The resilient layer pad 258 on the carrier holder 242 allows the back-disk-mounting side of the abrasive disk 250 to be in flat conformal contact with the platen 256 abrading surface 254 before the vacuum 246 is activated. The platen has vacuum 246 that is applied through vacuum port holes 248 to attach the abrasive disk 250 to the abrading surface 254 of the platen 256. The floating platen 256 is driven rotationally by a spherical action device 252 to allow the floating platen 256 abrading surface 254 to be in flat contact with equal-thickness flat-surface workpieces (not shown) that are attached with flat surface contact to the flat top rotating component 240 of three three-point spindles 262 (one not shown) that are mounted on a granite base 264. After the abrasive disk 250 is attached to the platen 256 the robotic device 260 carrier holder 242 is withdraw from the platen 256 area.

Figure 17:
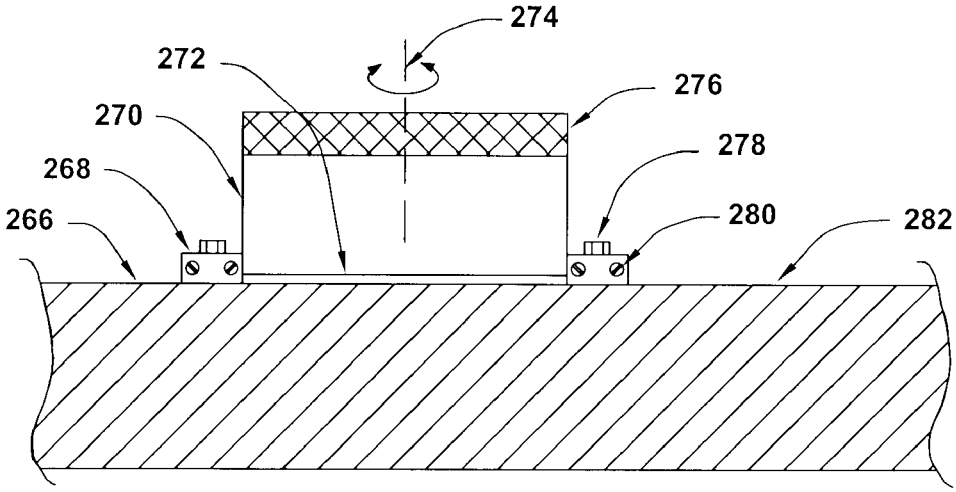
FIG. 17 is a cross section view of adjustable legs on a workpiece spindle.

FIG. 17 is a cross section view of adjustable legs on a workpiece spindle. A rotary workpiece spindle 270 is attached to a granite base 282 by fasteners 278 that are used to bolt the spindle legs 268 to the granite base 282. The spindle 270 has three equally spaced spindle legs 268 that are attached to the bottom portion of the spindle 270 where there is a space gap 272 between the bottom of the spindle and the flat surface 266 of the granite base 282. The spindle 270 has a rotary spindle top 276 that rotates about a spindle axis 274 and the three spindle legs are height-adjusted to align the spindle axis 274 precisely perpendicular with the top surface 266 of the granite base 282. To adjust the height of the spindle leg 268, transverse bolts 280 are tightened to squeeze-adjust the spindle leg 268 where the spindle leg 268 distorts along the spindle axis 274 thereby raising the portion of the spindle 270 located adjacent to the transverse bolts 280 squeeze-adjusted spindle leg 268. After the three spindle legs 268 are adjusted to provide the desired height of the top flat surface of the spindle top 276 and provide the perpendicular alignment of the spindle axis 274 perpendicular with the top surface 266 of the granite base 282, the spindle hold-down attachment bolts 278 are torque-controlled tightened to attach the spindle 270 to the granite base 282.

The hold-down bolts 278 can be loosened and the spindle 270 removed and the spindle 270 then brought back to the same spindle 270 location and position on the granite base 282 for re-mounting on the granite base 282 without affecting the height of the spindle top 276 or perpendicular alignment of the spindle axis 274 because the controlled compressive force applied by the hold-down bolts 278 does not substantially affect the desired size-height distortion of the spindle legs 268 along the spindle rotation axis 274. The height adjustments provided by this adjustable spindle leg 268 can be extremely small, as little as 1 or 2 micrometers, which is adequate for precision alignment adjustments required for air bearing spindles 270 that are typically used for the fixed-spindle floating-platen abrasive system (not shown). Also, these spindle leg 268 height adjustments are dimensionally stable over long periods of time because the squeeze forces produced by the transverse bolts 280 do not stress the spindle leg 268 material past its elastic limit. Here, the spindle leg 268 acts as a compression-spring where the spindle leg 268 height can be reversibly changed by changing the force applied by the transverse bolts 280 which is changed by changing the tightening-torque that is applied to these threaded transverse bolts 280.

Figure 18:
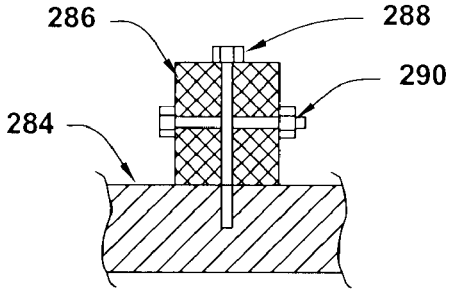
FIG. 18 is a cross section view of an adjustable spindle leg.

FIG. 18 is a cross section view of an adjustable spindle leg. A spindle leg 286 has transverse tightening bolts 290 that compress the spindle leg 286 along the axis of the transverse bolts 290. Spindle (not shown) hold-down bolts 288 are threaded to engage threads (not shown) in the granite base 284 but the compressive action applied on the spindle leg 286 by the hold-down bolts 288 along the axis of the hold-down bolt 288 is carefully controlled in concert with the compressive action of the transverse bolts 290 to provide the desired distortion of the spindle leg 286 along the axis of the hold-down bolts 288.

Figure 19:
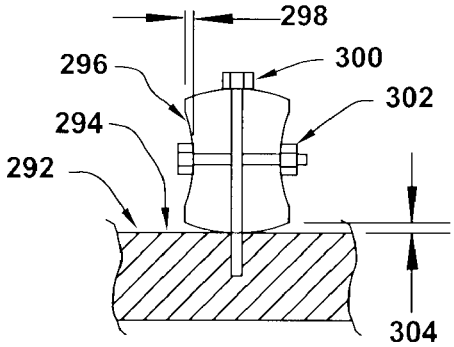
FIG. 19 is a cross section view of a compressed adjustable spindle leg.

FIG. 19 is a cross section view of a compressed adjustable spindle leg. A spindle leg 296 has transverse tightening bolts 302 that compress the spindle leg 296 along the axis of the transverse bolts 302 by a distortion amount 298. Spindle (not shown) hold-down bolts 300 are threaded to engage threads (not shown) in the granite base 292 but the compressive action applied on the spindle leg 296 by the hold-down bolts 300 along the axis of the hold-down bolt 300 is carefully controlled in relationship with the compressive action of the transverse bolts 302 on the spindle leg 296 to provide the desired distortion 304 of the spindle leg 296 along the axis of the hold-down bolts 300. The transverse bolts 302 create a transverse squeezing distortion 298 that is present on the spindle leg 296 and this transverse distortion 298 produces the desired height distortion 304 of the spindle leg 296. When the spindle leg 296 is distorted by the amount 304, the spindle is raised away from the surface 294 of the granite base 292 by this distance amount 304.

Figure 20:
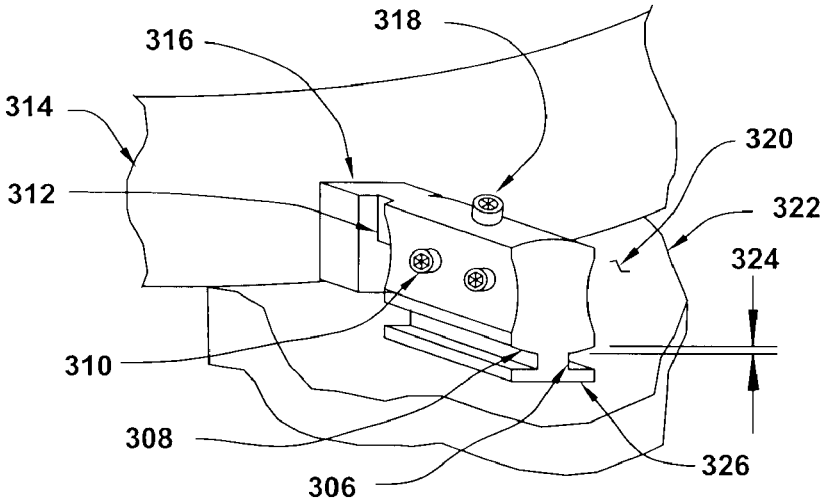
FIG. 20 is an isometric view of a compressed adjustable spindle leg.

FIG. 20 is an isometric view of a compressed adjustable spindle leg. A spindle leg 316 has transverse tightening bolts 310 that compress the spindle leg 308 along the axis of the transverse bolts 310. The spindle 314 has attached spindle legs 316 that have spindle hold-down bolts 318 that are threaded to engage threads (not shown) in the granite base 322. The compressive action applied on the spindle leg 316 by the hold-down bolts 318 along the axis of the hold-down bolt 318 is carefully controlled in concert with the compressive action of the transverse bolts 310 to provide the desired distortion 324 of the spindle leg 316 along the axis of the hold-down bolts 318. The transverse bolts 310 create a transverse squeezing distortion that is present on the spindle leg 316 and this transverse distortion produces the desired height distortion 324 of the spindle leg 316. When the spindle leg 316 is distorted by the amount 324, the spindle 314 is raised away from the surface 320 of the granite base 322 by this distance amount 324. A spindle leg 316 integral flat-base 326 having a distortion-isolation wall 306 provides flat-contact of the spindle leg 316 with the flat surface 320 of the granite base 322. The distortion-curvature 308 of the spindle leg 316 is shown where the spindle leg 316 leg-base 326 remains flat where it contacts the granite base 322 flat surface 320. A narrow but stiff bridge section 312 that is an integral portion of the spindle leg 316 isolates the spindle leg 316 distortion 324 from the body of the spindle 314.

Figure 21:
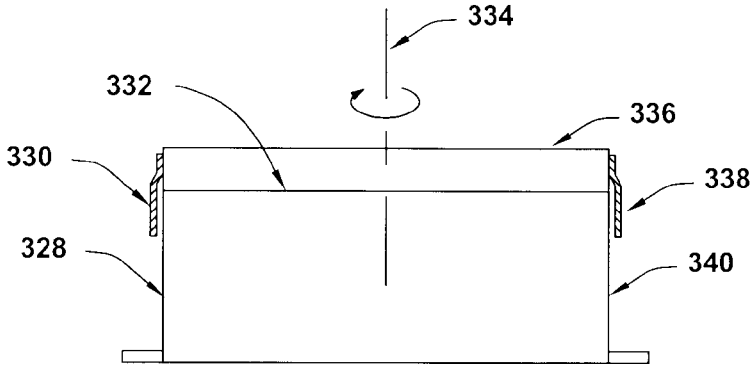
FIG. 21 is a cross section view of a workpiece spindle with a spindle top debris guard.

FIG. 21 is a cross section view of a workpiece spindle with a spindle top debris guard. A cylindrical workpiece spindle 328 has a rotary top 336 that rotates about a spindle axis 334 where the spindle top 336 has a circumferential separation line 332 that separates the spindle top 336 from the spindle 328 base 340. Where these spindles 328 are used in abrading atmospheres, water mist, abrading debris and very small sized abrasive particles are present in the atmosphere surrounding the spindle 328. To prevent entry of this debris, water moisture and abrasive particles in the spindle 328 separation line 332 area, a circumferential drip-shield 330 is provided where the drip shield 330 has a drip lip 338 that extends below the separation line 332. Unwanted debris material and water simply drips off the surface of the drip shield 330. Build-up of debris matter on the drip shield 330 is typically avoided because of the continued presence of abrasive coolant water that continually washes the surface of the drip shield 330. When the workpiece spindles 328 are used in abrading processes, often special chemical additives are added to the coolant water to enhance the abrading action on workpieces (not shown) in abrading procedures such as chemical mechanical planarization. Both the cylindrical spindle 328 cylindrical drip shields 330 and the spindles 328 are constructed from materials that are resistant to materials comprising water coolants, chemical additives, abrading debris and abrasive particles.

Figure 22:
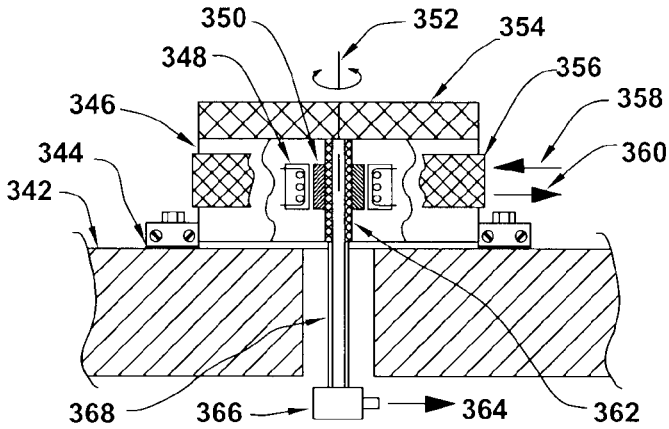
FIG. 22 is a cross section view of a workpiece spindle driven by a cooled internal motor.

FIG. 22 is a cross section view of a workpiece spindle driven by a cooled internal motor. A spindle 346 has a flat-surfaced rotary spindle-top 354 where the spindle-top 354 is rotated about a spindle axis 352. The spindle 346 is mounted on a machine base 342 by fasteners that attach spindle support legs 344 that are attached to the spindle 346 body to the machine base 342. The spindle-top 354 is driven by a hollow shaft 362 that is driven by a motor armature 350 that is driven by an internal motor winding 348. The spindle-top 354 hollow drive shaft 362 has an attached hollow shaft 368 that has an attached to a stationary rotary union 366 that is coupled to a vacuum source 364 that supplies vacuum to the spindle-top 354. A water jacket 356 is shown wrapped around the spindle 346 body where the water jacket 356 has temperature-controlled coolant water 358 that enters the water jacket 356 and exits the water jacket as exit water 360 where the water 358 cools the spindle 346 to remove the heat generated by the motor windings 348 to prevent thermal distortion of the spindle 346 and thermal displacement of the spindle-top 354.

Figure 23:
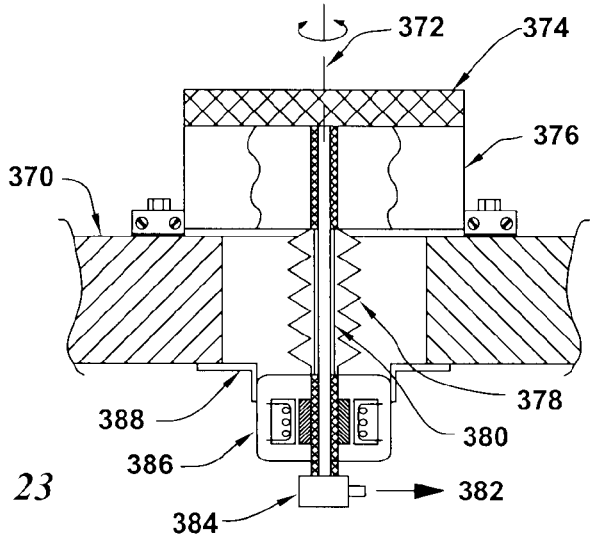
FIG. 23 is a cross section view of a workpiece spindle driven by an external motor.

FIG. 23 is a cross section view of a workpiece spindle driven by an external motor. A spindle 376 having a flat-surfaced spindle-top 374 that rotates about a spindle axis 372 is mounted to a machine base 370. An external motor 386 drives the spindle-top 374 with a bellows-type drive coupler 378 that allows slight misalignments between the motor 386 rotation axis and the spindle-top 374 axis of rotation 372. The bellows-type coupler 378 provides stiff torsional load capabilities for accelerating or decelerating the spindle-top 374. A rotary union device 384 supplies vacuum 382 to the spindle-top 374 through a flexible tube 380. The motor 386 is attached to the machine base 370 with motor brackets 388.

Figure 24:
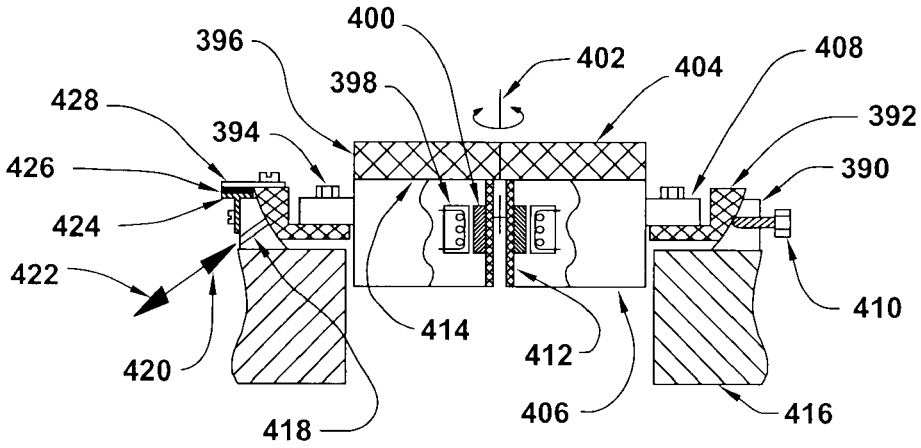
FIG. 24 is a cross section view of a recessed workpiece spindle driven by an internal motor.

FIG. 24 is a cross section view of a recessed workpiece spindle driven by an internal motor. A rotary workpiece air bearing spindle 406 is mounted on a machine base 416 with spindle legs 408 that are attached to the spindle 406 body. The spindle 406 has a flat-surfaced spindle-top 396 that rotates about a spindle axis 402 where the spindle-top 396 has a flat top surface 404. The spindle-top 396 has a hollow spindle shaft 412 that is driven by an internal motor armature 400 that is driven by an electrical motor winding 398. The spindle 406 is recessed into the machine base 416 because the spindle 406 support legs 408 are attached to the spindle 406 body near the top of the spindle 406. The spindle 406 is attached to a spherical rotor 392 with fasteners 394 where the rotor 392 is mounted in a spherical base 390 that is attached to the machine base 416. After co-planar alignment of spindle-tops 396 with other spindle-tops 396 (not shown), the spherical rotor 392 is locked to the spherical base 390 with fasteners 410. This spindle 406 spherical mount system comprising the rotor 392 and base 390, allows inexpensive, but dimensionally stable, machine bases having non-precision flat top surfaces to be used to mount the spindles 406 where the spindle-tops 396 can be precisely aligned to be co-planar with each other.

Here, the separation-line 414 between the spindle-top 396 and the spindle 406 body is a close distance from the spindle 406 mounting surface of the machine base 416. Because the separation distance is short, heat from the motor electrical winding 398 that tends to thermally expand the length of the spindle 406 is minimized and the there is little thermally-induced vertical movement of the spindle-top 396 due to the motor heat. Also, the pressurized air that is supplied to the air bearing spindle 406 expands as it travels through the spindle 406 which lowers the temperature of the spindle air. This cool spindle air exits the spindle body at the separation line 414 where it cools the spindle 406 internally and at the interface between the spindle-top 396 and the spindle 406 which reduces the thermal-expansion effects from the heat generated by the electrical internal motor windings 398. Thermal growth in the length of the spindles 406 tends to be equal for all three spindles 406 used in the fixed-spindle floating platen abrading systems (not shown). Any spindle 406 thermal distortion effects are uniform across all of the system spindles 406 and there is little affect on the abrading process because the floating abrasive platen simply contacts all of these same-expanded spindles 406 in a three-point contact stance. When the spindles 406 are mounted where the bottom of the spindle 406 extends below the surface of the machine base 416 the effect of the thermal growth of the spindles 406 along the spindle length is diminished.

The spindles 406 are attached to spherical rotors 392 that are mounted in a spherical base 390 where pressurized air or a liquid 420 can be applied through a fluid passageways 418 to allow the spherical rotor 392 to float without friction in the spherical base 390 when the spindle-tops 396 (others not shown) are aligned to be co-planar in a common plane after which vacuum 422 can be applied through fluid passageways 418 to lock the spherical rotor 392 to the spherical base 390 and fasteners 410 can be used to attach the spherical rotor 392 to the spherical base 390. The spherical rotor 392 and the spherical base 390 have a mutually common spherical diameter. Another technique of locking the spherical rotor 392 to the spherical base 390 after the spindle-tops 396 are aligned to be co-planar is to apply a liquid adhesive 426 in the gap between a removable bracket 428 that is attached to the spherical rotor 392 and a removable bracket 424 that is attached to the spherical base 390 where the liquid adhesive 426 becomes solidified and provides structural locking attachment of the spherical rotor 392 to the spherical base 390. For future co-planar realignment of the spindle-tops 396 to be co-planar, the brackets 428 and 424 that are adhesively bonded together can be removed by detaching them from the rotor 392 and the housing base 390 and other individual replacement brackets 428 and 424 can be attached to the rotor 392 and the housing base 390. Then, when the spindle-tops 396 are aligned to be co-planar an adhesive 426 is applied in the gap between a removable bracket 428 that is attached to the spherical rotor 392 and a removable bracket 424 that is attached to the spherical base 390 to bond the spherical rotor 392 to the spherical base 390.

The spindle-tops 396 can be aligned to be co-planar with the use of measurement instruments (not shown) or with the use of laser alignment devices (not shown). Also, a very simple technique that can be used for co-planar alignment of the spindle-tops 396 is to bring a precision-flat surface of a floating platen (not shown) annular abrading surface into flat surfaced contact with the spindle-tops 396 where pressurized air or a liquid 420 can be applied through a fluid passageways 418 to form a spherical-action fluid bearing that allows the spherical rotor 392 to float without friction in the spherical base 390. Here, the spindle-tops 396 are aligned to be co-planar in a common plane after which vacuum 422 can be applied through fluid passageways 418 to lock the spherical rotor 392 to the spherical base 390. If desired, pressurized air can be applied to the internal passageways (not shown) connected to the spindle-tops 396 flat surfaces during the procedure of co-planar alignment of the spindle-tops 396. This is done to reduce the friction between the spindle-tops 396 and the platen abrading surface which provides assurance that the spindle-tops 396 and the platen abrading surface are mutually in flat contact with each other. After co-planar alignment of the spindle-tops 396, vacuum can be applied to these spindle-tops 396 flat surfaces to temporarily bond the spindle-tops 396 to the platen before or while vacuum 422 is applied through fluid passageways 418 to lock the spherical rotor 392 to the spherical base 390. Then, when the spindle-tops 396 are aligned to be co-planar, an adhesive 426 is applied in the gap between a removable bracket 428 that is attached to the spherical rotor 392 and a removable bracket 424 that is attached to the spherical base 390 to rigidly bond the spherical rotor 392 to the spherical base 390.

This same technique of applying fluid pressure and vacuum to the fluid passageways 418 to form a spherical-action fluid bearing that allows the spherical rotor 392 to float without friction in the spherical base 390 can be used with the fasteners 410 to attach the spherical rotor 392 to the spherical base 390. Another alternative, but closely related, spindle-tops 396 co-planar alignment technique is to apply pressurized fluid and then vacuum to vacuum abrasive mounting holes in the platen abrading surface to perform the procedure of co-planar alignment of the spindle-tops. Those abrasive disk vacuum holes in the platen that are not in contact with the spindle-tops 396 are temporarily plugged using adhesive tape or by other means during the spindle-tops 396 co-planar alignment procedure.

Figure 25:
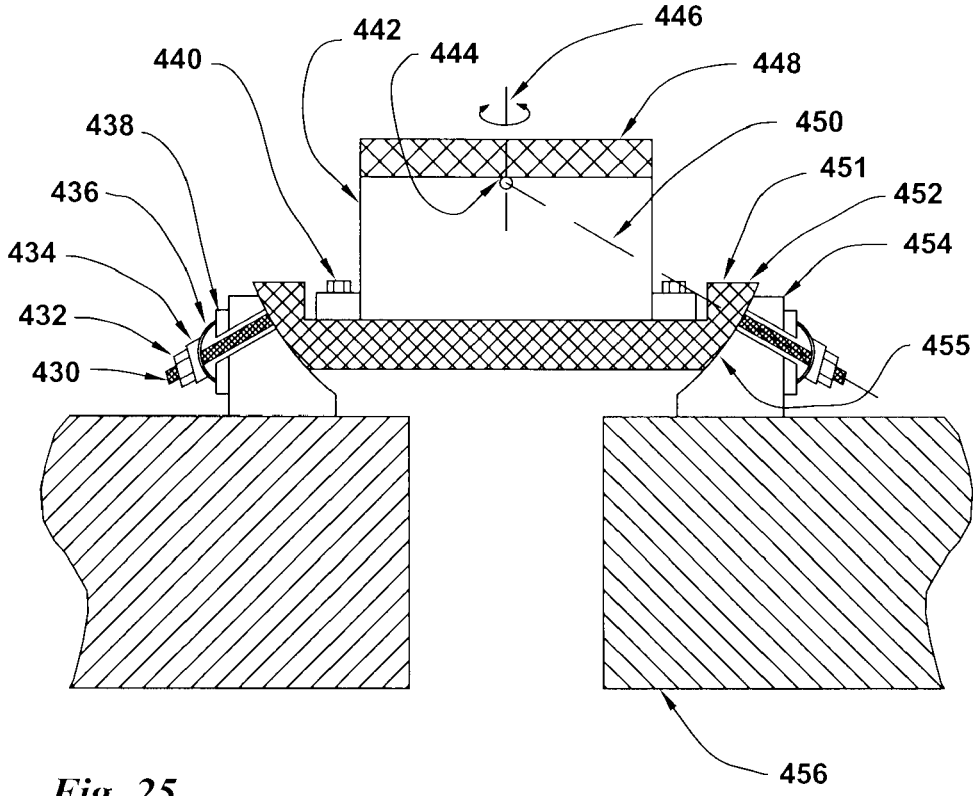
FIG. 25 is a cross section view of a spherical mounted spindle with mechanical fasteners.

FIG. 25 is a cross section view of a cylindrical rotatable spindle mounted on a spherical-action mount with mechanical fasteners. A rotatable workpiece flat surfaced spindle 442 having a cylindrical side is attached to a spherical-action mount 451 having a spherical-surfaced rotor 452 with fasteners 440. The spherical-surfaced surfaced rotor 452 is seated in a spherical-surfaced mount base 454 that has a matching spherical surface 455 that conformably contacts with the same-sized spherical surface of the rotor 452. The spherical-surfaced mount base 454 is attached to a granite base 456. Threaded rotor bolts 430 that are arranged around the periphery of the spherical-surfaced mount base 454 are attached to the spherical-surfaced rotor 452 and protrude through the body of the spherical-surfaced base 454 and threaded nuts 432 that contacts collars 434 having a curved side that contacts a curved flexible spring 436 that contacts a rigid spacer 438 having a cylindrical side that contacts the cylindrical surface of the spindle 442. The longitudinal axis 450 of the bolts 430 can intersect the spherical center 444 of the spherical-action mount 451 spherical surface 455.

The spindle 442 has a rotatable spindle-top 448 that can be rotated about a spindle axis 446 where the flat surface of the spindle-top 448 can be aligned to be co-planar with the flat surfaces of the spindle-tops 448 of other spindles 442 (not shown). The nuts 432 are carefully tightened to apply locking forces that locks the spherical-surfaced rotor 452 to the spherical-surfaced mount base 454 after the flat surfaces of the spindle-tops 448 of the spindles 442 are aligned to be precisely co-planar with each other. Care is taken not to tilt the spherical-surfaced rotor 452 that is seated in the spherical-surfaced mount base 454 when the nuts 432 are tightened. This co-planar alignment of the spindle-tops 448 is maintained even when the spindle-tops 448 are subjected to abrading forces during abrasive lapping operations.

Figure 26:
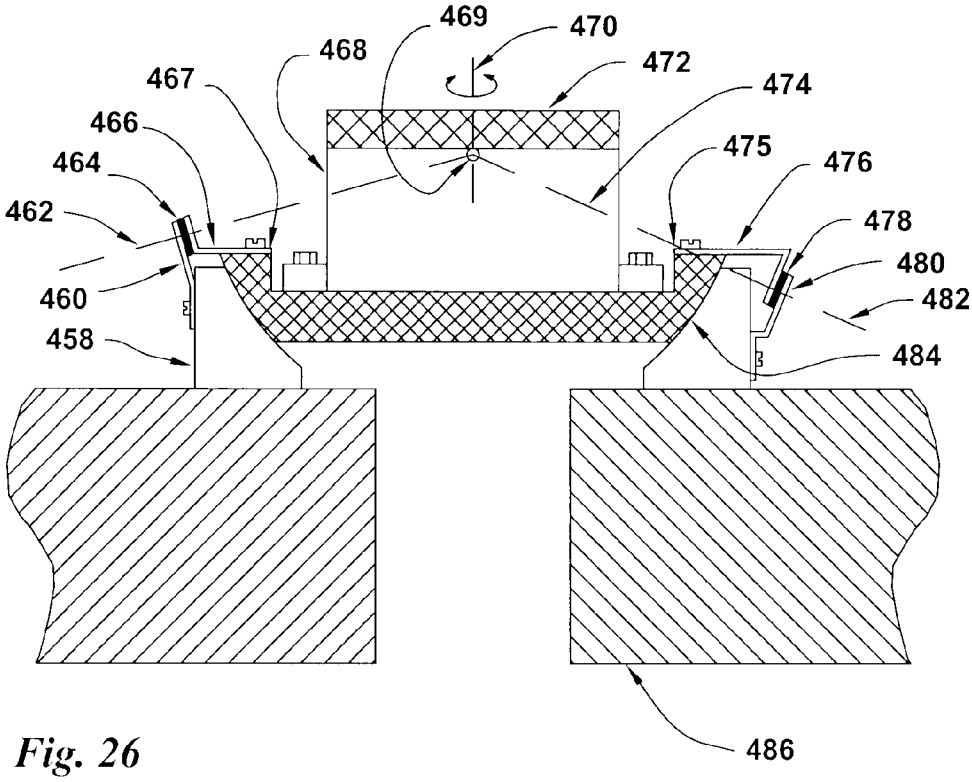
FIG. 26 is a cross section view of a spherical mounted spindle with adhesive tabs.

FIG. 26 is a cross section view of a cylindrical rotatable spindle mounted on a spherical-action mount having matching pairs of removable spindle mount adhesive locking tabs. Use of a structural adhesive to lock the spherical-action spindle mount 467 together avoids the use of mechanical locking devices (not shown) that can apply an undesirable tilt to the spindle rotor 475 relative to the spindle base 458 when the mechanical locking devices are tightened. A rotatable workpiece flat surfaced spindle 468 having a cylindrical side is attached to a spherical-action mount 467 having a spherical-surfaced rotor 475 with rotor 475 adhesive tabs 476 and 476. A spherical mount base 458 has adhesive locking tabs 460 and 480. A liquid adhesive 478 can be applied to the gaps between the rotor 475 downward adhesive tabs 476 and the spherical mount base 458 downward adhesive locking tabs 480. A liquid adhesive 464 can be applied to the gaps between the rotor 475 upward adhesive tabs 466 and the spherical mount base 458 adhesive upward locking tabs 460.

The spherical-surfaced rotor 475 is seated in the spherical mount base 458 that has a matching spherical surface 484 that conformably contacts with the same-sized spherical surface of the rotor 475. The spherical-surfaced mount base 458 is attached to a granite base 486. Pair sets of adhesive upward locking tabs 460 and 466 and downward adhesive tabs 476 and 480 are arranged around the periphery of the spherical-surfaced mount base 458. A perpendicular to the mutual gap area between the rotor 475 downward adhesive tabs 476 and the spherical-surfaced base 458 adhesive tabs 480 can intersect the spherical center 469 of the spherical-action spindle mount 467. A perpendicular to the mutual gap area between the rotor 475 upward adhesive tabs 466 and the spherical-surfaced base 458 adhesive tabs 460 can intersect the spherical center 469 of the spherical-action mount 467.

The spindle 468 has a rotatable spindle-top 472 that can be rotated about a spindle axis 470 where the flat surface of the spindle-top 472 can be aligned to be co-planar with the flat surfaces of the spindle-tops 472 of other spindles 468 (not shown). Liquid adhesive 464 and 478 is applied to the pair sets of adhesive upward locking tabs 460 and 466 and downward adhesive tabs 476 and 480 to lock the spherical-surfaced rotor 475 to the spherical-surfaced mount base 458 after the flat surfaces of the spindle-tops 472 of the spindles 468 are aligned to be precisely co-planar with each other. Care is taken not to tilt the spherical-surfaced rotor 475 that is seated in the spherical-surfaced mount base 458 after the adhesive 464 and 478 is applied. After solidification of the adhesive 464 and 478 this co-planar alignment of the spindle-tops 472 is maintained even when the spindle-tops 472 are subjected to abrading forces during abrasive lapping operations.

Use of a zero-shrink passive-action epoxy type adhesive (or other type of zero-shrink adhesive) 464 and 478 results in a stress-free locking of the spherical-surfaced rotor 475 to the spherical-surfaced mount base 458 when the adhesive 464 and 478 solidifies. Use of a shrink-type epoxy adhesive (or other shrink-type of adhesive) 464 and 478 results in intentional residual locking forces being applied by the shrinking adhesive where the spherical-surfaced rotor 475 is compressed against the spherical-surfaced mount base 458 when the adhesive 464 and 478 solidifies and shrinks The pair sets of the removable adhesive locking tabs 460 and 466 and the removable adhesive tabs 476 and 480 can be removed and discarded and replaced with new pair sets prior to re-aligning the flat surfaces of the spindle-tops 472 of the spindles 468 to be precisely co-planar with each other and applying new liquid adhesive 464 and 478 that solidifies.

Figure 27:
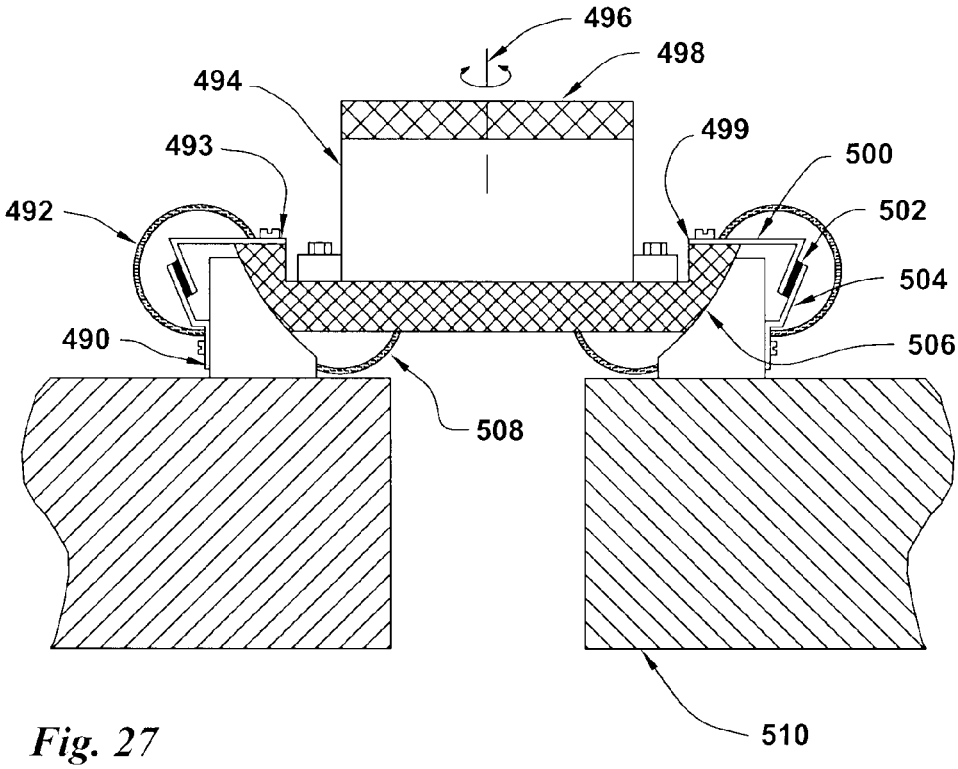
FIG. 27 is a cross section view of a spherical mounted spindle with debris protection boots.

FIG. 27 is a cross section view of a cylindrical rotatable spindle mounted on a spherical-action mount having matching pairs of removable spindle mount adhesive locking tabs where flexible protection boots protect the spherical-action mount. A structural adhesive is used to lock the spherical-action spindle mount 493 together by locking the spindle rotor 499 relative to the spindle base 490. A rotatable workpiece flat surfaced spindle 494 having a cylindrical side is attached to the spherical-action mount 493 having a spherical-surfaced rotor 499 with rotor 499 adhesive tabs 500. A spherical mount base 490 has adhesive locking tabs 504. A liquid adhesive 502 can be applied to the gaps between the rotor adhesive tabs 500 and the spherical mount base 490 adhesive locking tabs 504. The spindle 494 has a rotatable spindle-top 498 that can be rotated about a spindle axis 496 where the flat surface of the spindle-top 498 can be aligned to be co-planar with the flat surfaces of the spindle-tops 498 of other spindles 494 (not shown).

The spherical-surfaced rotor 499 is seated in the spherical mount base 490 that has a matching spherical surface 506 that conformably contacts with the same-sized spherical surface of the rotor 499. The spherical-surfaced mount base 490 is attached to a granite base 510. Pair sets of adhesive locking tabs 500 and 504 are arranged around the periphery of the spherical-surfaced mount base 490. Removable annular-shaped flexible boots 508 and 492 that extend around the peripheries of the spherical-surfaced rotor 499 and the spherical mount base 490 protect the spherical-surfaced rotor 499 and the spherical mount base 490 from debris generated in the abrasive lapping operation. These annular-shaped flexible boots 508 and 492 can be removed and replaced when the flat surfaces of the spindle-tops 498 re-aligned to be co-planar with the flat surfaces of the spindle-tops 498 of other spindles 494. The annular-shaped flexible boots 508 and 492 can be made from polymers, natural fibers or cloth materials, metals, composites or combinations thereof and they can be diaphragm shaped or have pleated shapes to provide durability, water and abrasive debris resistance and flexibility.

Figure 28:
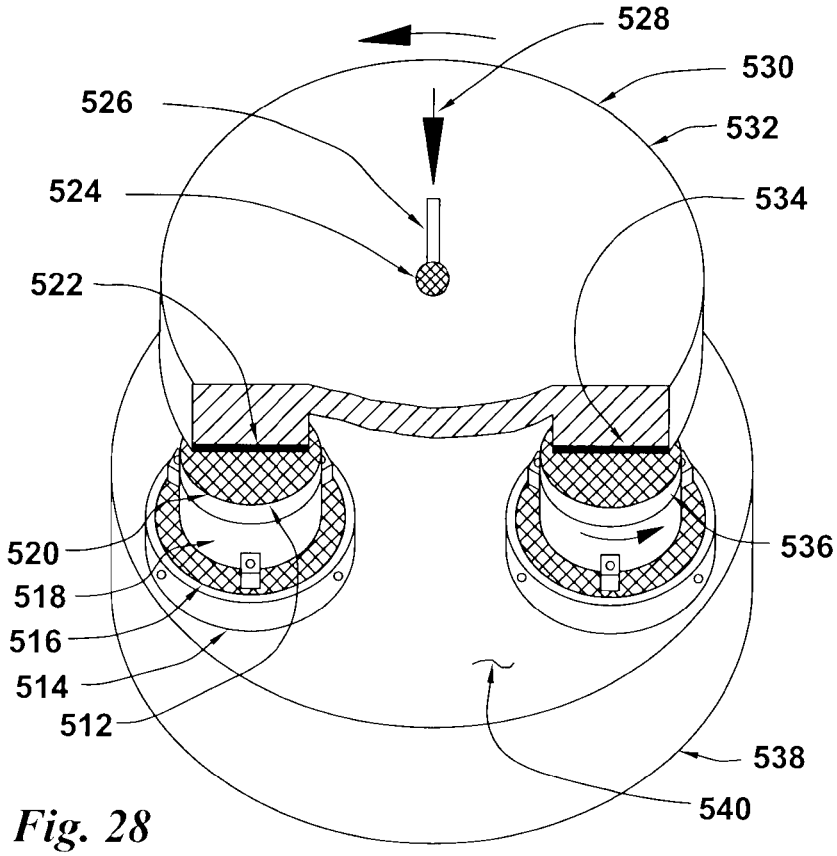
FIG. 28 is an isometric view of a floating platen machine with spherical spindle mounts.

FIG. 28 is an isometric view of a floating platen abrading system 532 having three-point fixed-position rotating workpiece spindles supporting a floating rotating abrasive platen.

Three evenly-spaced rotatable spherical-base mounted spindles 518 (one not shown) having rotating tops 536 that have attached workpieces 520 support a floating abrasive platen 530. The rotary spindles 518 are attached to spherical base rotors 516 that are mounted in spherical bases 514 where the spherical rotors 516 can have spherical rotation action when mounted in the spherical bases 514. The spindles 518 spherical bases 514 are attached to the nominally-flat surface 540 of the granite or epoxy-granite machine base 538. The platen 530 has a vacuum, or other, abrasive disk attachment device (not shown) that is used to attach an annular abrasive disk 534 to the precision-flat platen 530 abrasive-disk mounting surface 522. The abrasive disk 534 is in flat abrasive surface contact with all three of the workpieces 520. The rotating floating platen 530 is driven through a spherical-action universal-joint type of device 524 having a platen drive shaft 526 to which is applied an abrasive contact force 528 to control the abrading pressure applied to the workpieces 520. The three workpiece rotary spindles 518 have approximate-equal-heights which allows alignment of the flat top surfaces 512 of the three spindles 518 spindle-tops 536 to be co-planar and results in the co-planar surfaces of all of the flat-surfaced rotary workpiece spindles 518 spindle-tops 536 to be approximately co-planar with the nominally-flat surface 540 of the granite base 538. Here, the equal-thickness workpieces 520 are in the same plane and are abraded uniformly across each workpiece 520 surface by the platen 530 precision-flat planar abrasive disk 534 abrading surface. The planar abrading surface 522 of the floating platen 530 is approximately co-planar with the nominally-flat surface 540 of the granite base 538.

The spindles 518 rotating spindle-tops 536 can driven by different techniques comprising spindle 518 internal spindle shafts (not shown), external spindle 518 flexible drive belts (not shown), drive-wires (not shown) and spindle 518 internal drive motors (not shown). The spindle 518 spindle-tops 536 can be driven independently in both rotation directions and at a wide range of rotation speeds including very high speeds. Typically the spindles 518 are air bearing spindles that provide precision flat surfaces, near-equal heights, are very stiff to maintain high rigidity against abrading forces, have very low friction and can operate at very high rotational speeds. The spindles 518 can also use precision roller bearings that allow the spindle-tops 536 to rotate.

Abrasive disks (not shown) or other abrasive deices (not shown) can be attached to the spindle 518 spindle-tops 536 to abrade the platen 530 flat surface 522 by rotating the spindle-tops 536 while the platen 530 flat surface 522 is positioned in abrading contact with the spindle abrasive disks or other spindle-top 536 disk abrasive devices that are rotated in selected directions and at selected rotational speeds when the platen 530 is rotated at selected speeds and selected rotation directions when applying a controlled abrading force 528. The top flat surfaces 512 of the individual three-point spindle 518 rotating spindle-tops 536 can also be abraded by the platen 530 planar abrasive disk 534 by placing the platen 530 and the abrasive disk 534 in flat conformal contact with the spindle-tops 536 flat surfaces 512 of the rotary workpiece spindles 518 as both the platen 530 and the spindle-tops 536 are rotated in selected directions when a controlled abrading pressure force 528 is applied. The abrading force 528. is evenly distributed to the three spindles 518 spindle-tops 536 because of the three point support of the platen 530 by the three spindles 518 that are evenly spaced from each other around the circumference of the platen 530. The top surfaces 512 of the spindles 518 spindle-tops 536 are abraded by the abrasive disk 534 that is attached to the platen 530 results in all of the spindles 518 spindle-tops 536 top surfaces 512 being in a common plane.

The granite base 538 provides a time-stable nominally-flat surface 540 to which the precision-flat three-point spindles 518 can be mounted by use of the spherical base 514. The unique capability provided by this abrading system 532 is that the primary datum-reference is the fixed-position co-planar spindle-tops 536 flat surfaces 512. The spindles 518 spindle-tops 536 can be aligned to be mutually co-planar with each other without adjusting the heights of the individual spindles 518 because all the spindles 518 can rotate by spherical motion of the spherical rotors 516, after which the spherical rotors 516 can be attached to the spherical bases 514 with fasteners (not shown). The spindles 518 spindle-tops 536 co-planar alignment can be done with alignment devices (not shown) or even the planar flat abrading-surface 522 of the platen 530 can be placed in contact with the spindle-tops 536 to establish the co-planar alignment of the spindle-tops 536.

The abrading system can provide extremely flat rotary spindle 518 spindle-top 536 workpiece mounting surfaces 512 and extremely flat platen 530 abrading surfaces 522. The extreme flatness accuracy of the abrading system 532 provides the capability of abrading ultra-thin and large-diameter and high-value workpieces 520, such as semiconductor wafers, at very high abrading speeds. Also, the workpieces 520 and the abrasive disks 534 can be loaded and unloaded into the abrading system 532 by using fully automated robotic devices (not shown).

In addition, the system 532 can provide unprecedented system 532 machine component flatness and workpiece abrading accuracy by using the abrading system 532 to "abrasively dress" other of these same abrading machine system 532 critical components such as the spindle tops 536 and the platen 530 planar-surface 522. These precision-abraded spindle top 536 and the platen 530 planar surface 522 components can be assembled into a new abrading system 532 and it can be used to progressively bring other abrading system 532 critical components comprising the spindle tops 536 and the platen 530 planar abrading-surface 522 into a higher state of operational flatness perfection than existed when the initial abrading system 532 was initially assembled. This abrading system 532 self-dressing process is simple, easy to do and can be done as often as desired to reestablish ultra-precision flatness of the abrading system 532 critical components or to improve their flatness for specific high-precision abrading operations.

This single-sided abrading system 532 self-enhancement surface-flattening process is unique among conventional floating-platen abrasive systems. Other abrading systems use floating platens but these systems are double-sided abrading systems. These other systems comprise slurry lapping and micro-grinding (flat-honing) that have rigid bearing-supported rotated lower abrasive coated platens that have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) typically have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 532 described here is completely different than the other double-sided system (not-shown).

The fixed-spindle, floating platen 530 abrading system 532 performance is based on supporting a floating abrasive platen 530 on the top surfaces 512 of three-point spaced fixed-position rotary workpiece spindles 518 that are mounted on a stable machine base 538 flat surface 540 where the top surfaces 512 of the spindles 518 spindle-tops 536 are precisely located in a common plane. Also, the top surfaces 512 of the spindles 518 are typically approximately co-planar with the nominally-flat surface 540 of a rigid fixed-position granite, epoxy-granite or other material, base 538. The three-point support is required to provide a stable support for the floating platen 530 as rigid components, in general, only contact each other at three points.

This three-point workpiece spindle abrading system 532 can also be used for abrasive slurry lapping (not shown), for micro-grinding (flat-honing) (not shown) and also for chemical mechanical planarization (CMP) (not shown) abrading to provide ultra-flat abraded workpieces 520.

Figure 29:
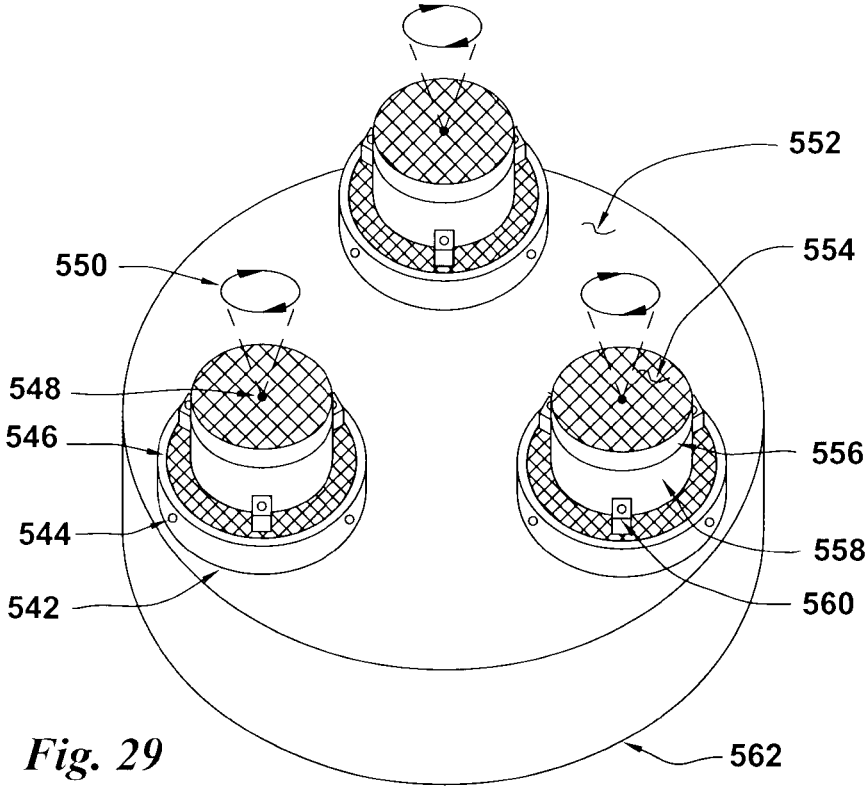
FIG. 29 is an isometric view of spindles on a granite base with spherical spindle mounts.

FIG. 29 is an isometric view of three-point fixed-position spindles mounted on a granite base with spherical spindle mounts. A granite base 562 has a nominally-flat top surface 552 that supports three attached workpiece spindles 558 that have rotatable driven spindle-tops 556 where flat-surfaced workpieces 554 are attached to the flat-surfaced spindle-tops 556. The spindles 558 have attached spindle legs 560 that allow the spindles 558 to be attached to spherical rotors 546 that are mounted in spherical-action bases 542 having matching spherical diameters to the respective spherical rotors 546 where the spherical rotors 546 can be attached to the spherical-action bases 542 with fasteners 544. after co-planar alignment of the flat surfaces of the spindle-tops 556. The spindle-tops 556 have a center of rotation 548 and the spherical rotor 546 allows the spindle 558 to have spherical rotation as shown by 550. The spherical bases 542 are attached to the nominally-flat surface 552 of the machine base 562.

Figure 30:
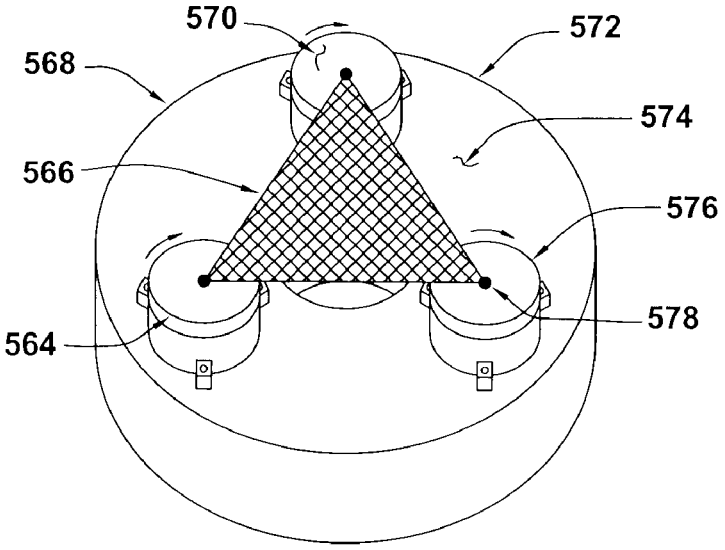
FIG. 30 is an isometric view of three-point co-planar aligned spindles on a granite base.

FIG. 30 is an isometric view of three-point co-planar aligned workpiece spindles that have a spindle-common plane where the spindles are mounted on a granite machine base. Three spindles 576 having rotary spindle-tops 564 that have spindle-top 564 rotational center points 578 where all of the spindle-tops 564 flat surfaces 570 are co-planar as represented by a planar surface 566. The spindles 576 are mounted on a machine base 568. The spindles 576 are attached to the flat surface 574 of a granite, or other base material, base 572.

Figure 31:
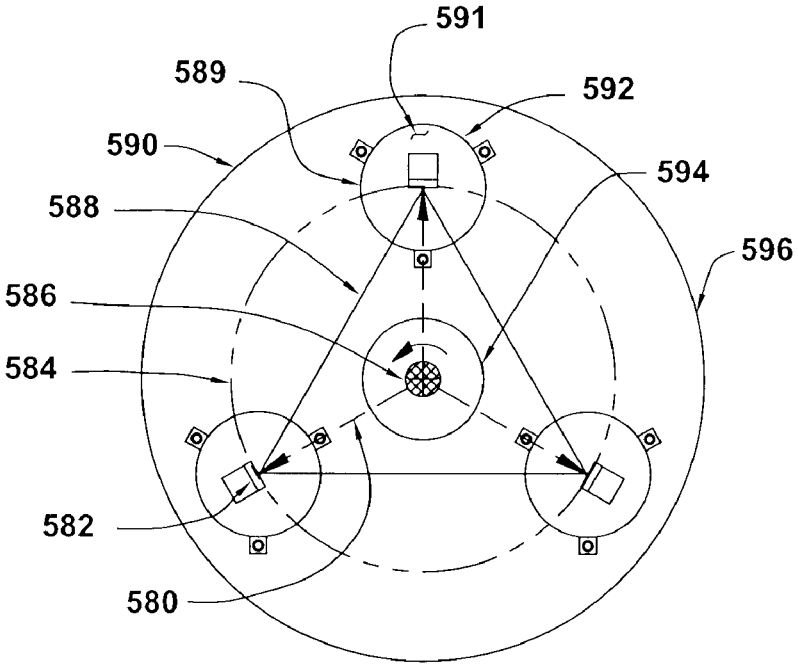
FIG. 31 is a top view of three-point center-position laser aligned spindles on a granite base.

FIG. 31 is a top view of three-point center-position laser aligned rotary workpiece spindles on a granite base. Three-point spindles 592 are mounted on a machine base 590 where a rotary laser device 594 having a rotary laser head 586 that sweeps a laser beam 580 in a laser plane circle 584. The rotary laser 594 is mounted on the machine base 590 at a central position between the three spindles 592 to minimize the laser beam 580 distance between the rotary laser head 586 and the reflective laser mirror targets 582 that are mounted on the spindles 592 spindle-top flat surfaces 591. The spindles 592 spindle-top 589 surfaces 591 are aligned to be co-planar with the use of the rotary-beam laser device 594 to form a spindle-top 589 alignment plane 588

Three fixed-position rotary workpiece spindles 592 hat are mounted on a granite base are shown being aligned with a L-740 Ultra Precision Leveling Laser 586 provided by Hamar Laser of Danbury, Conn. This laser device 586 has a flatness alignment capability that is approximately three times better than the desired 0.0001 inch (2.5 micron) co-planar spindle-top alignment that is required for high speed flat lapping. Reflective laser mirrors 582 are attached to the flat top surfaces 591 of the spindle-tops 589 to reflect a laser beam 580 that is emitted by the rotating laser head 586 back to a laser device 594 sensor (not shown) The rotary laser device 594 can be mounted at a central position between the three spindles 592 to minimize the distance between the reflective mirrors 582 and the rotating laser beam 580 laser device 594 laser head 586 source. Each spindle 592 is independently tilt-adjusted to attain this precision co-planar alignment of the spindle-tops 589 flat surfaces 591 prior to structurally attaching the spindles 592 to the granite base 596. The spindle-tops 589 alignments are retained for long periods of time because of the dimensional stability of the granite base 596. The spindles 592 can be attached directly to the granite base 596 or they can be attached to spindle 592 spherical-action spindle mounts (not shown) after the spindle-tops 589 are aligned to be co-planar to each other.

Three fixed-position rotary workpiece spindles can be mounted on a granite base that is not precisely flat-surfaced with the use of spindle spherical-action mounts. Using these spherical-action mounts, these spindles can easily be precisely aligned to have co-planar spindle-tops. Here, the individual workpiece spindles are attached to rotatable spherical rotors that are coupled to spherical bases where both the rotors and bases share the same spherical radii. The spherical bases are attached to the flat surface of the granite base.

In one instance, a floating platen having a precision-flat annular surface can be used as an alignment jig to precisely co-planar align the spindle-tops. This is done by simply contacting the top surfaces of the three-point platen support spindle-tops with the precision-flat platen surface. This precision-flat platen is already available to use as an alignment jig as it is a required integral component of the high speed flat lapper machine. To facilitate the intimate flat-surfaced contact of the platen with the three spaced spindle tops that support the platen, pressurized air can be applied to the spindle-tops. This pressurized air is supplied through the vacuum port-hole passageways that exist in the spindle-tops to attach the flat surfaced workpieces.

Pressurized air can also be supplied to the platen annular abrading surface, through selected platen abrasive disk attachment vacuum port holes, to minimize the friction between the platen and the spindle tops. Other vacuum port holes in the platen annular surface that are located in the spans between the spindle tops can be temporarily sealed with adhesive tape. With this pressurized air, very thin films of air then exists between the individual spindle tops and the platen surface. Here, there is essentially no friction between the spindle tops and the platen.

During the procedure where the platen flat surface contacts the spindle tops, pressurized air can also be supplied through passageways to the spherical gap that exists between the spherical rotors and the spherical bases. This pressurized air allows the spherical spindle mount to act as a frictionless air bearing device to eliminate the friction between the spherical-action rotor and the spherical-action base.

When all three of the spindle tops are in intimate flat-surfaced contact with the precision-flat surface of the platen annular abrading band, the air pressure supplied to the spindle tops and/or the platen surface can be interrupted. This interruption eliminates the small air films between the spindle tops and the platen flat surface. In addition, vacuum can now be applied to the same pressurized air passageways in the spindle tops and/or the platen where the platen becomes firmly and forcefully attached to all three spindle tops by the presence of this vacuum. At this time, all three flat-surfaced spindle tops have mutually assumed the same planar flatness of the platen annular flat surface. Each spindle top is also now aligned to be precisely co-planar with the other spindle tops.

Vibration can also be applied to the spindle tops and/or to the platen during the procedure to co-planar align the spindle-tops to enhance the intimate mutual face-surfaced contact of the precision-flat platen surface and the flat surfaces of the spindle tops.

The air pressure supplied to the spherical gap between the spherical rotors and the spherical bases can be then be interrupted to eliminate the small air film between the spherical rotors and the spherical bases. At this time the spherical rotors and the spherical bases are in mutual contact with each other. Vacuum can also be applied to the same pressurized air passageways connected to the spherical gap between the spherical rotors and the spherical bases to firmly and forcefully clamp the individual spherical rotors and the spherical bases together. After this mutual forced contact of the spherical rotors and the spherical bases, the spherical rotors are locked to the spherical bases using mechanical fasteners or adhesives. At this time, the platen can be separated from contact with the spindle tops and the precision and structurally stable co-planar alignment of the spindle-tops is established. The spindles are also now structurally attached to the granite machine base that provides long term dimensional stability to retain the precision co-planar alignment of all three spindle tops. The system can now be successfully used for high speed flat lapping.

The use of the spherical mounts allows inexpensive non-precision flat granite bases to be used as support for the spindles. Even though the granite base does not have an (expensive) precision flat surface, the granite still provides dimensionally stable support of the spindles. These spherical-action spindle mounts can be supplied by Nelson Air Corp, Milford N.H.

Laser alignment devices can also be used to co-planar align the spindle-tops of the workpiece spindles that are attached to the spherical mounts. The same techniques of alternatively applying pressurized air and vacuum to the spindles, the spherical mounts and the platen can be used for the co-planar laser alignment of the spindle tops.

Figure 32:
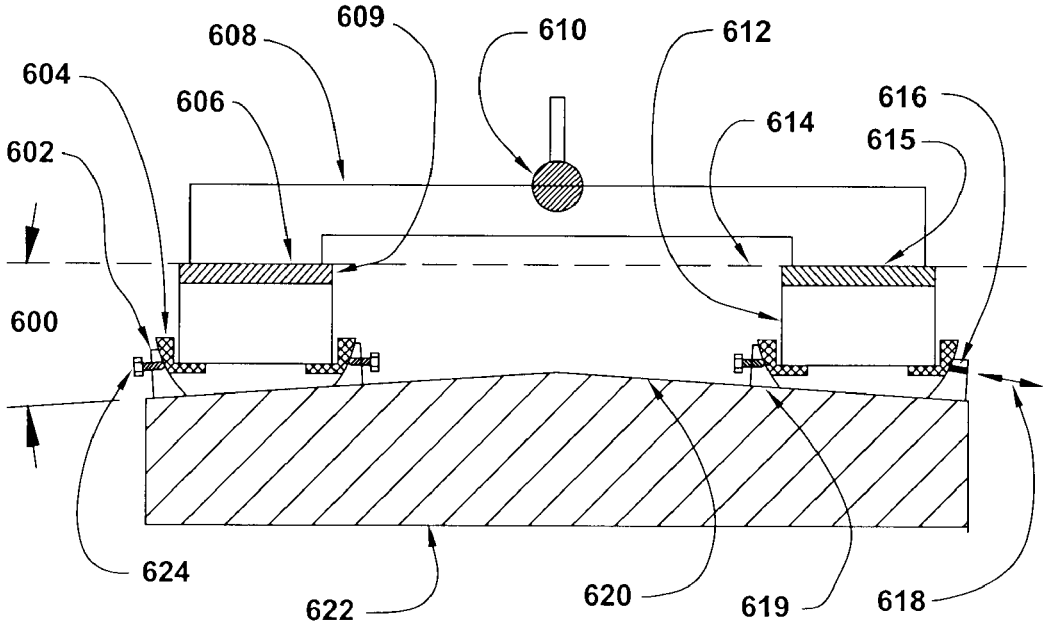
FIG. 32 is a cross section view of spherical mounted spindles contacting a flat platen.

FIG. 32 is a cross section view of spherical-mount attached spindles contacting a flat-surfaced floating platen that is used as an alignment jig for co-planar aligning the flat surfaces of rotary workpiece spindles. Three of the spindles are arranged in a circle to provide stable three-point support of the floating abrading platen that is used to abrasively flat-lap flat-surfaced workpiece that are attached to the top surfaces of the rotary spindles. The spindles are mounted in spherical-action spindle mounts that are attached to a non-flat granite machine base. The floating platen 608 has a nominally horizontal annular precision-flat abrading surface 606 that extends around the periphery of the circular shaped platen 608. A spherical-action device 610 allows the floating platen 608 to have spherical rotation and the spherical-action device 610 allows the platen 608 to be moved vertically and allows the contact pressure between the platen 608 abrading surface 606 and the rotary workpiece spindles (only two of the three shown) 612 spindle-tops 609 to be controlled. Each of the spindles 612 is attached to a spherical-action mount 619 that has a spherical-surfaced rotor 604 and a spherical-surfaced base 602 that is attached to a granite machine base 622 where the spherical mounts 619 allow spherical rotation of the spindles 612. Here, the spindles 612 are attached to the spherical-surfaced rotors 604 that are in intimate mutual spherical surface contact with the spherical-surfaced bases 602.

When the free-floating platen 608 mutually and intimately contacts the three spindle tops 609, all three of the spindle tops 609 top surfaces 615 assume a co-planar alignment due to the precision-flatness of the platen 608 abrading surface 606 that acts as an alignment jig. After co-planar alignment of the spindle-tops 609 top surfaces 615 is achieved, the spherical-surfaced rotor 604 is locked to the spherical-surfaced base 602 where the spindles 612 are thereby structurally attached to the granite base 622. Because of the spherical rotation capabilities of the spindles 612 spherical spindle mounts 619, the top surfaces 615 of the spindles-tops 609 can be precisely co-planar aligned into an alignment plane 614 even when the granite base 622 has a non-flat surface 620. The localized non-flat condition of the granite base 622 non-flat surface 620 with the alignment plane 614 is represented by the angle 600.

The spherical-surfaced rotors 604 can be locked to the spherical-surfaced bases 602 with the use of mechanical fasteners 624 or the spherical-surfaced rotors 604 can be locked to the spherical-surfaced bases 602 with the use of liquid adhesives (not shown) that are solidified after the co-planar alignment of the spindle-tops 609 top surfaces 615 is achieved. To aid in the co-planar alignment of the spindle-tops 609 top surfaces 615, pressurized air or vacuum 618 can be introduced in one or more passageways 616 that extend thought the body of the spherical-surfaced base 602 during the co-planar spindle-tops 609 top surfaces 615 co-planar alignment procedure.

Figure 33:
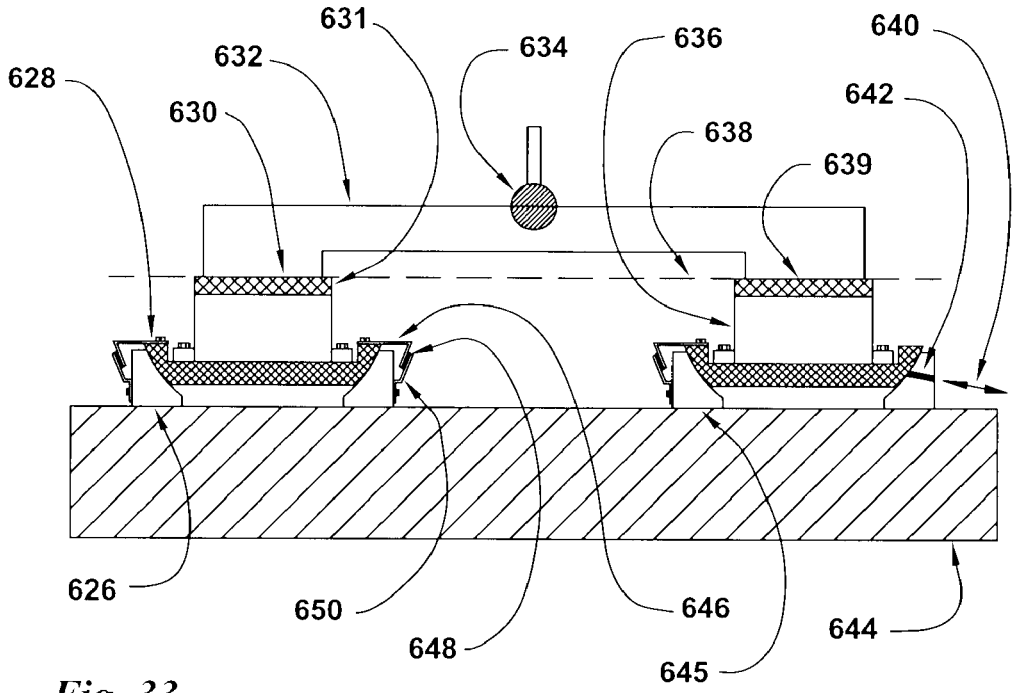
FIG. 33 is a cross section view of spherical mounted spindles with tabs contacting a platen.

FIG. 33 is a cross section view of spherical-mount attached spindles contacting a flat-surfaced floating platen that is used as an alignment jig for co-planar aligning rotary workpiece spindles where the spherical-mounts are locked with adhesive. Three of the spindles are arranged in a circle to provide stable three-point support of the floating abrading platen that is used to abrasively flat-lap flat-surfaced workpiece that are attached to the top surfaces of the rotary spindles. The spindles are mounted in spherical-action spindle mounts that are attached to a non-flat granite machine base. The floating platen 632 has a nominally horizontal annular precision-flat abrading surface 630 that extends around the periphery of the circular shaped platen 632. A spherical-action device 634 allows the floating platen 632 to have spherical rotation and the spherical-action device 634 allows the platen 632 to be moved vertically and allows the contact pressure between the platen 632 abrading surface 630 and the rotary workpiece spindles (only two of the three shown) 636 spindle-tops 631 to be controlled. Each of the spindles 636 is attached to a spherical-action mount 645 that has a spherical-surfaced rotor 628 and a spherical-surfaced base 626 that is attached to a granite machine base 644 where the spherical mounts 645 allow spherical rotation of the spindles 636. Here, the spindles 636 are attached to the spherical-surfaced rotors 628 that are in intimate mutual spherical surface contact with the spherical-surfaced bases 626.

When the free-floating platen 632 mutually and intimately contacts the three spindle tops 631, all three of the spindle tops 631 top surfaces 639 assume a co-planar alignment due to the precision-flatness of the platen 632 abrading surface 630 that acts as an alignment jig. After co-planar alignment of the spindle-tops 631 top surfaces 639 is achieved, the spherical-surfaced rotor 628 is locked to the spherical-surfaced base 626 where the spindles 636 are thereby structurally attached to the granite base 644. Because of the spherical rotation capabilities of the spindles 636 spherical spindle mounts 645, the top surfaces 639 of the spindles-tops 631 can be precisely co-planar aligned into an alignment plane 638 even when the granite base 644 has a non-flat surface (not shown).

The spherical-surfaced rotors 628 can be locked to the spherical-surfaced bases 626 with the use of liquid adhesives 648 that are applied in a gap between adhesive tabs 646 that are attached to the spherical-surface rotors 628 and adhesive tabs 650 that are attached to the spherical-surfaced bases 626. One or more pair sets of adhesive tabs 646 and 650 are attached around the periphery of the spherical-surfaced bases 626. The adhesives 648 are solidified after the co-planar alignment of the spindle-tops 631 top surfaces 639 is achieved. To aid in the co-planar alignment of the spindle-tops 631 top surfaces 639, pressurized air or vacuum 640 can be introduced in one or more passageways 642 that extend thought the body of the spherical-surfaced base 626 during the spindle-tops 631 top surfaces 639 co-planar alignment procedure.

Figure 34:
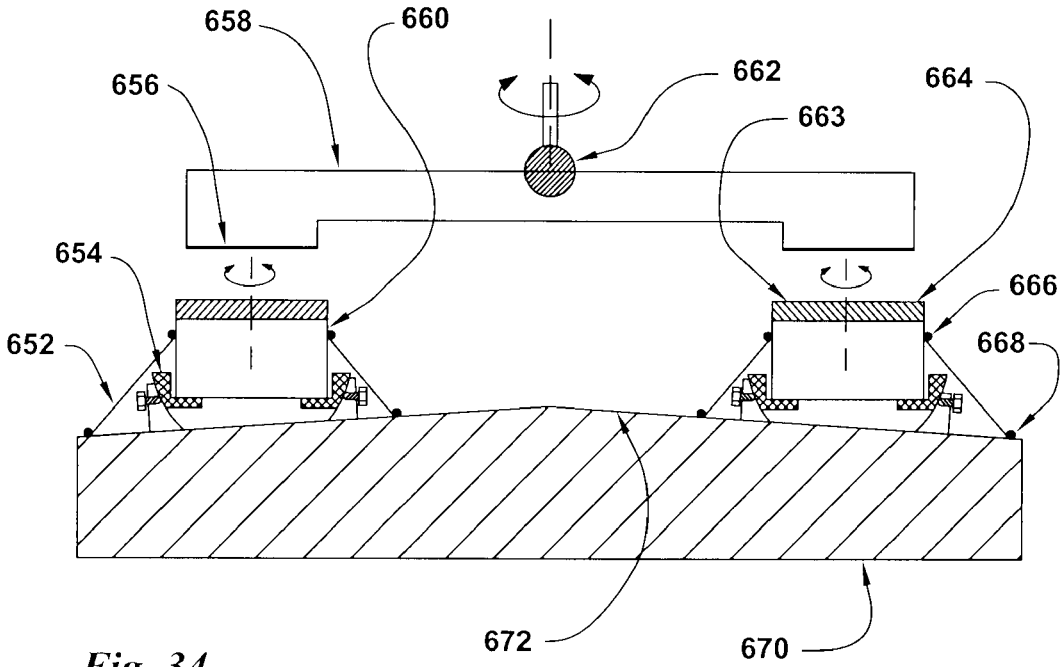
FIG. 34 is a cross section view of spherical mounted spindles with cone-type debris guards.

FIG. 34 is a cross section view of spherical-action mounted workpiece spindles that have cone-type debris guards. A floating rotational abrading platen 658 having a nominally horizontal annular flat abrading surface 656 is supported by a spherical action rotation device 662 that rotates the floating platen 658 and allows the floating platen 658 to be moved vertically. The platen 658 abrading surface 656 can be covered with abrasive materials (not shown) and the floating rotational platen 658 abrading surface 656 can contact the top flat surfaces 663 of the rotary spindles 660 rotatable spindle-tops 664. The workpiece rotary spindles 660 are supported by fastener-locked spherical-action two-piece spindle mounts 654 that are attached to a granite machine base 670 that has a non-flat surface 672. The two-piece spindle mounts 654 are protected from coolant water and abrasive debris by rigid or flexible cone-type debris guards 652.

The removable debris guards 652 are attached to the spindle 660 body with a sealant 666 that extends around a portion of the outer periphery of the spindle 660 body and the debris guards 652 are attached to the granite base 670 non-flat top surface 672 with a sealant 668. The sealants 666 and 668 are waterproof and prevent coolant water and abrading debris from contacting or contaminating the spherical-action spindle mounts 654. The removable sealants 666 and 668 include a wide variety of materials including silicone rubber adhesives that can be easily separated from the spindle 660 bodies and the granite base 670. The removable debris guards 652 are attached to the spindle 660 bodies and the granite base 670 non-flat top surface 672 after the flat surfaces 663 of the spindle-tops 664 have been aligned to be precisely co-planar with each other and the spherical-action two-piece spindle mounts 654 have been locked together with mechanical fasteners or other types of fastener devices such as adhesives (not shown). The rigid or flexible cone-type debris guards 652. can also be used where rotary workpiece spindles 660 are directly attached to a granite or other base material base 670 without the use of spherical-action two-piece spindle mounts 654.

Figure 35:
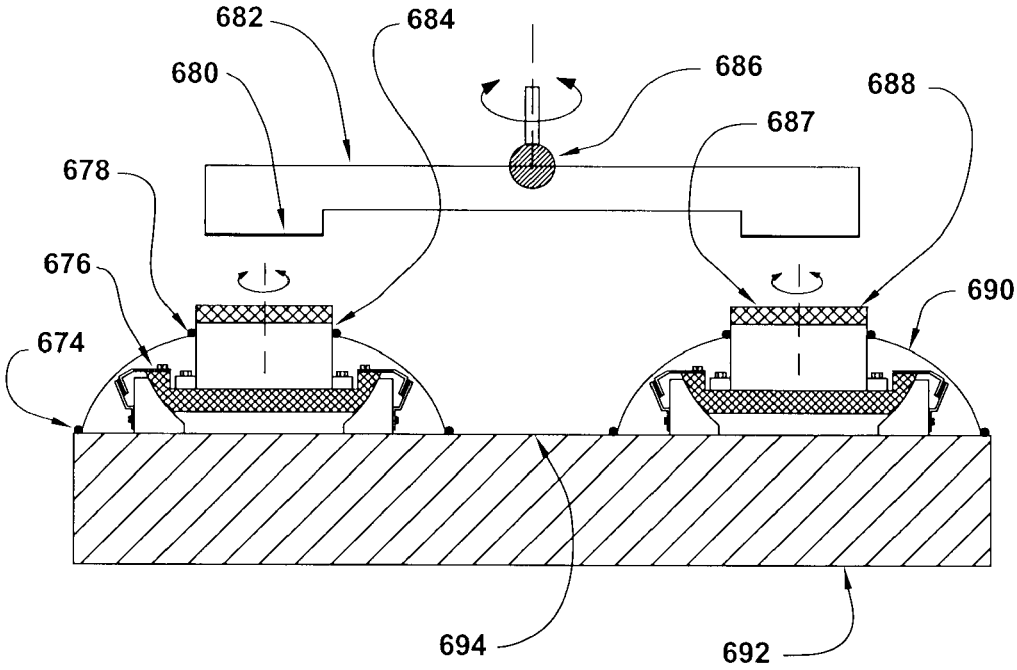
FIG. 35 is a cross section view of spherical mounted spindles with dome-type debris guards.

FIG. 35 is a cross section view of spherical-action mounted workpiece spindles that have dome-type debris guards. A floating rotational abrading platen 682 having a nominally horizontal annular flat abrading surface 680 is supported by a spherical action rotation device 686 that rotates the floating platen 682 and allows the floating platen 682 to be moved vertically. The platen 682 abrading surface 680 can be covered with abrasive materials (not shown) and the floating rotational platen 682 abrading surface 680 can contact the top flat surfaces 687 of the rotary spindles 684 rotatable spindle-tops 688. The workpiece rotary spindles 684 are supported by adhesive-locked spherical-action two-piece spindle mounts 676 that are attached to a granite machine base 692 that has a flat surface 694. The two-piece spindle mounts 676 are protected from coolant water and abrasive debris by rigid or flexible dome-type debris guards 690.

The removable debris guards 690 are attached to the spindle 684 body with a sealant 678 that extends around a portion of the outer periphery of the spindle 684 body and the debris guards 690 are attached to the granite base 692 flat top surface 694 with a sealant 674. The sealants 678 and 674 are waterproof and prevent coolant water and abrading debris from contacting or contaminating the spherical-action spindle mounts 676. The removable sealants 678 and 674 include a wide variety of materials including silicone rubber adhesives that can be easily separated from the spindle 684 bodies and the granite base 692 top surface 694. The removable debris guards 690 are attached to the spindle 684 bodies and the granite base 692 after the flat surfaces 687 of the spindle-tops 688 have been aligned to be precisely co-planar with each other and the spherical-action two-piece spindle mounts 676 have been locked together with adhesives or other types of fastener devices such as mechanical fasteners (not shown). The rigid or flexible dome-type debris guards 690. can also be used where rotary workpiece spindles 684 are directly attached to a granite or other base material base 692 without the use of spherical-action two-piece spindle mounts 676.

The fixed-spindle floating platen machine has a number of different characteristics that allow it to be configured in different ways and perform different tasks. These system characteristics and capabilities are described here.

A lapping machine is described is described that comprises:

a) at least three rotary spindles having circular rotatable flat-surfaced spindle-tops that each have a spindle-top axis of rotation at the center of a respective rotatable flat-surfaced spindle-top for respective rotary spindles;

b) wherein the at least three spindle-tops' axes of rotation are perpendicular to the respective spindle-tops' flat surfaces;

c) an abrading machine base having a horizontal nominally-flat top surface and a spindle-circle where the spindle-circle is coincident with the machine base nominally-flat top surface;

d) at least three rotary spindle two-piece spindle-mount devices comprising a rotatable spindle-mount spherical-action rotor and a stationary spindle-mount spherical-base where each respective spindle-mount spherical-action rotor and respective stationary spindle-mount spherical-base have a common-radius spherical-joint wherein each respective rotatable spindle-mount spherical-action rotor is mounted in common-radius spherical-joint surface contact with a respective stationary spindle-mount spherical-base and wherein the respective rotatable spindle-mount spherical-action rotors are supported by the respective stationary spindle-mount spherical-bases where each respective rotary spindle two-piece spindle-mount device allows the respective rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors;

e) wherein each of the at least three rotary spindle two-piece spindle-mount devices has at least one paired set of removable rotor mount tabs where each paired set of removable rotor mount tabs has a first removable tab that is attached to each respective spindle-mount spherical-action rotor and has an adjacent second removable spherical-base tab that is attached to each respective spindle-mount spherical-action spherical-base where a small gap exists between the respective first removable tab that is attached to each respective spindle-mount spherical-action rotor and the adjacent second removable spherical-base tab that is attached to each respective spindle-mount spherical-action spherical-base;

f) wherein the at least three rotary spindles are located with near-equal spacing between the respective at least three of the rotary spindles where the respective at least three spindle-tops' axes of rotation intersect the machine base spindle-circle and where the respective at least three rotary spindle two-piece spindle-mount devices' spindle-mount spherical-bases are mechanically attached to the machine base nominally-flat top surface to position the respective at least three rotary spindles at the near-equal spacing locations between the respective at least three rotary spindles;

g) wherein the at least three spindle-tops' flat surfaces can be aligned to be co-planar with each other by spherical rotation of the rotatable spindle-mount spherical-action rotors relative to the respective stationary spindle-mount spherical-bases;

h) wherein a liquid adhesive can be applied in the small gaps that exist between the respective paired sets of first removable rotor mount tabs and the adjacent second removable spherical-base tabs wherein the adhesive is solidified and structurally bonds the respective paired sets of first removable rotor mount tabs and the adjacent second removable spherical-base tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces;

i) a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

j) wherein the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and k) flexible abrasive disk articles having annular bands of abrasive coated surfaces that have an abrasive coated surface annular band radial width and an abrasive coated surface annular band inner radius and an abrasive coated surface annular band outer radius and where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than an inner radius of the attached flexible abrasive disk abrasive coated surface annular band and where an abrading platen precision-flat annular abrading-surface outer radius is greater than the outer radius of the attached flexible abrasive disk abrasive coated surface annular band;

l) wherein each flexible abrasive disk is attached in flat conformal contact with the abrading platen precision-flat annular abrading-surface by a disk attachment techniques selected from the group consisting of vacuum disk attachment techniques, mechanical disk attachment techniques and adhesive disk attachment techniques;

m) wherein equal-thickness workpieces having parallel opposed flat workpiece top surfaces and flat workpiece bottom surfaces are attached in flat-surfaced contact with the flat surfaces of the respective at least three spindle-tops where the workpiece bottom surfaces contact the flat surfaces of the respective at least three spindle-tops;

n) wherein the abrading platen can be moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen;

o) wherein the total abrading platen abrading contact force applied to workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops is controlled through the abrading platen spherical-action abrading platen rotation device to allow the total abrading platen abrading contact force to be evenly distributed to the workpieces attached to the respective at least three spindle-tops; and p) wherein the at least three spindle-tops having the attached equal-thickness workpieces can be rotated about the respective spindle-tops' rotation axes and the abrading platen having the attached flexible abrasive disk can be rotated about the abrading platen rotation axis to single-side abrade the equal-thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the equal-thickness workpieces that are attached to the respective at least three spindle-tops.

This machine also include at least one flat-surfaced circular device is selected from the group consisting of workpiece carriers, abrasive conditioning rings and abrasive disks is attached to the flat surfaces of the at least three spindle-tops where the selected flat-surfaced circular devices are attached to the at least three spindle-tops by attachment systems selected from the group consisting of vacuum attachment, mechanical attachment and adhesive attachment and wherein the attached flat-surfaced circular devices are concentric with the respective spindle-tops. It also includes a machine base structural material that is selected from the group consisting of granite and epoxy-granite and wherein the machine base structural material and the machine base structural material is either solid oris temperature controlled by a temperature-controlled fluid that circulates in fluid passageways internal to the machine base structural materials. Further, the machine includes where the at least three rotary spindles are air bearing rotary spindles.

Further, the machine allows the abrading platen flexible abrasive disk articles to be selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

In addition, the machine includes where auxiliary rotary spindles in excess of three rotary spindles, which are primary rotary spindles, are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where top surfaces of the rotary spindle respective spindle-tops of the auxiliary rotary spindles are precisely co-planar with the precisely co-planar top surfaces of the spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to structurally maintain the co-planar alignment of the auxiliary rotary spindles' spindle-tops' flat surfaces.

Also, there is a process of abrading flat-surfaced workpieces using an at least three-point fixed-spindle floating-platen abrading machine comprising:

a) providing at least three rotary spindles having circular rotatable flat-surfaced spindle-tops that each have a spindle-top axis of rotation at the center of a respective rotatable flat-surfaced spindle-top for respective rotary spindles;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing at least three rotary spindle two-piece spindle-mount devices comprising a rotatable spindle-mount spherical-action rotor and a stationary spindle-mount spherical-base where each respective spindle-mount spherical-action rotor and respective stationary spindle-rotors;

e) providing that each of the at least three rotary spindle two-piece spindle-mount devices has at least one paired set of removable rotor mount tabs where each paired set of removable rotor mount tabs has a first removable tab that is attached to each respective spindle-mount spherical-action rotor and has an adjacent second removable spherical-base tab that is attached to each respective spindle-mount spherical-action spherical-base where a small gap exists between the respective first removable tab that is attached to each respective spindle-mount spherical-action rotor and the adjacent second removable spherical-base tab that is attached to each respective spindle-mount spherical-action spherical-base;

f) providing that the at least three rotary spindles are located with near-equal spacing between the respective at least three of the rotary spindles where the respective at least three spindle-tops' axes of rotation intersect the machine base spindle-circle and where the respective at least three rotary spindle two-piece spindle-mount devices' spindle-mount spherical-bases are mechanically attached to the machine base nominally-flat top surface to position the respective at least three rotary spindles at the near-equal spacing locations between the respective at least three rotary spindles;

g) aligning the at least three spindle-tops' flat surfaces to be co-planar with each other by spherical rotation of the rotatable spindle-mount spherical-action rotors relative to the respective stationary spindle-mount spherical-bases;

h) applying a liquid adhesive in the small gaps that exist between the respective paired sets of first removable rotor mount tabs and the adjacent second removable spherical-base tabs wherein the adhesive is solidified and structurally bonds the respective paired sets of first removable rotor mount tabs and the adjacent second removable spherical-base tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces;

i) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

j) providing that the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and k) providing flexible abrasive disk articles having annular bands of abrasive coated surfaces that have an abrasive coated surface annular band radial width and an abrasive coated surface annular band inner radius and an abrasive coated surface annular band outer radius and where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than an inner radius of the attached flexible abrasive disk abrasive coated surface annular band and where an abrading platen precision-flat annular abrading-surface outer radius is greater than the outer radius of the attached flexible abrasive disk abrasive coated surface annular band;

l) Attaching a selected flexible abrasive disk in flat conformal contact with the abrading platen precision-flat annular abrading-surface by a disk attachment techniques selected from the group consisting of vacuum disk attachment techniques, mechanical disk attachment techniques and adhesive disk attachment techniques;

m) providing equal-thickness workpieces having parallel opposed flat workpiece top surfaces and flat workpiece bottom surfaces where the equal-thickness workpieces are attached in flat-surfaced contact with the flat surfaces of the respective at least three spindle-tops where the workpiece bottom surfaces contact the flat surfaces of the respective at least three spindle-tops;

n) providing that the abrading platen is moved vertically along the abrading platen rotation axis by the abrading platen spherical-action rotation device to allow the abrasive surface of the flexible abrasive disk that is attached to the abrading platen precision-flat annular abrading-surface to contact the top surfaces of the workpieces that are attached to the flat surfaces of the respective at least three spindle-tops wherein the at least three rotary spindles provide at least three-point support of the abrading platen;

o) applying a total abrading platen abrading contact force to the workpieces that are attached to the respective at least three spindle-top flat surfaces by contact of the abrasive surface of the flexible abrasive disk that is attached to the abrading platen precision-flat annular abrading-surface with the top surfaces of the workpieces that are attached to the flat surfaces of the respective at least three spindle-tops where the total abrading platen abrading contact force is controlled through the abrading platen spherical-action abrading platen rotation device to allow the total abrading platen abrading contact force to be evenly distributed to the workpieces attached to the respective at least three spindle-tops; and p) rotating the at least three spindle-tops having the attached equal-thickness workpieces about the respective spindle-tops' rotation axes and rotating the abrading platen having the attached flexible abrasive disk about the abrading platen rotation axis to single-side abrade the equal-thickness workpieces that are attached to the flat surfaces of the at least three spindle-tops while the moving abrasive surface of the flexible abrasive disk that is attached to the moving abrading platen precision-flat annular abrading-surface is in force-controlled abrading contact with the top surfaces of the equal-thickness workpieces that are attached to the respective at least three spindle-tops.

Also, the process of abrading flat-surfaced workpieces includes where flat-surfaced equal-thickness workpieces having top and bottom surfaces are provided where a workpiece top surface is a first workpiece surface and a workpiece bottom surface is a second workpiece surface and where the flat-surfaced equal-thickness workpieces are attached to the at least three spindle-tops, and the first workpiece surfaces are abraded by the flexible abrasive disk article that is attached to the abrading platen precision-flat annular abrading-surface when the second workpiece surfaces are attached to the at least three spindle-tops, and after the first workpiece surface is abraded, the flat-surfaced equal-thickness workpieces are removed from the at least three spindle-tops and the flat-surfaced equal-thickness workpieces are re-attached to the at least three spindle-tops where the abraded first workpiece surfaces are attached to the spindle-tops and the second workpiece surfaces are abraded by the flexible abrasive disk article that is attached to the abrading platen precision-flat annular abrading-surface workpiece.

Further, the process of abrading flat-surfaced workpieces includes where the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

The same process includes where auxiliary rotary spindles in excess of three rotary spindles which are primary rotary spindles are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where the top surfaces of the rotary spindle respective spindle-tops of the auxiliary rotary spindles are precisely co-planar with the precisely co-planar top surfaces of the spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to structurally maintain the co-planar alignment of the auxiliary rotary spindles' spindle-tops' flat surfaces.

Another process is described of abrading an abrading surface of a floating platen that is a component of a three-point fixed-spindle floating-platen abrading machine to recondition or reestablish the planar flatness of the platen abrading surface comprising:

a) providing at least three rotary spindles having circular rotatable flat-surfaced spindle-tops that each have a spindle-top axis of rotation at the center of a respective rotatable flat-surfaced spindle-top for respective rotary spindles;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing at least three rotary spindle two-piece spindle-mount devices comprising a rotatable spindle-mount spherical-action rotor and a stationary spindle-mount spherical-base where each respective spindle-mount spherical-action rotor and respective stationary spindle-mount spherical-base have a common-radius spherical-joint wherein each respective rotatable spindle-mount spherical-action rotor is mounted in common-radius spherical joint surface contact with a respective stationary spindle-mount spherical-base and wherein the respective rotatable spindle-mount spherical-action rotors are supported by the respective stationary spindle-mount spherical-bases where each respective rotary spindle two-piece spindle-mount device allows the respective rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors;

e) providing that each of the at least three rotary spindle two-piece spindle-mount devices has at least one paired set of removable rotor mount tabs where each paired set of removable rotor mount tabs has a first removable tab that is attached to each respective spindle-mount spherical-action rotor and has an adjacent second removable spherical-base tab that is attached to each respective spindle-mount spherical-action spherical-base where a small gap exists between the respective first removable tab that is attached to each respective spindle-mount spherical-action rotor and the adjacent second removable spherical-base tab that is attached to each respective spindle-mount spherical-action spherical-base;

f) providing that the at least three rotary spindles are located with near-equal spacing between the respective at least three of the rotary spindles where the respective at least three spindle-tops' axes of rotation intersect the machine base spindle-circle and where the respective at least three rotary spindle two-piece spindle-mount devices' spindle-mount spherical-bases are mechanically attached to the machine base nominally-flat top surface to position the respective at least three rotary spindles at the near-equal spacing locations between the respective at least three rotary spindles;

g) aligning the at least three spindle-tops' flat surfaces to be co-planar with each other by spherical rotation of the rotatable spindle-mount spherical-action rotors relative to the respective stationary spindle-mount spherical-bases;

h) applying a liquid adhesive in the small gaps that exist between the respective paired sets of first removable rotor mount tabs and the adjacent second removable spherical-base tabs wherein the adhesive is solidified and structurally bonds the respective paired sets of first removable rotor mount tabs and the adjacent second removable spherical-base tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces;

i) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

j) providing that the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and k) attaching flexible abrasive disks or abrasive conditioning rings having flat-surfaced abrasive coating surfaces to the flat surfaces of the at least three spindles' spindle-tops;

l) moving the floating rotatable abrading platen vertically along the floating rotatable abrading platen rotation axis by the spherical-action platen rotation device to allow the floating rotatable abrading platen abrading surface to contact the abrasive surfaces of the attached flexible abrasive disks or the attached abrasive conditioning rings that are attached to the spindle-top flat surfaces of the at least three spindles;

m) rotating the at least three spindle-tops having the attached abrasive disks or attached abrasive conditioning rings about the respective spindles' axes and rotating the floating rotatable abrading platen about the floating rotatable abrading platen rotation axis to abrade the abrading-surface of the floating rotatable abrading platen with the abrasive disks or abrasive conditioning rings that are attached to the at least three spindle-tops while the moving floating rotatable abrading platen abrading surface is in force-controlled abrading pressure with the selected abrasive disks or abrasive conditioning rings attached to the at least three spindle-tops.

The same of abrading an abrading surface of a floating platen is described where the abrading surface of the floating rotatable abrading platen is abraded to recondition or reestablish planar flatness of the floating rotatable abrading platen abrading surface using conditioning rings where circular-shaped conditioning rings having a flat-surfaced abrasive coated annular band are attached to the at least three spindle-tops, where the conditioning rings annular abrasive surfaces have equal heights above each spindle-top wherein the at least three spindle-tops having the attached conditioning rings are rotated about the respective spindles' axes while moving the floating rotatable abrading platen abrading surface in force-controlled abrading pressure with the spindle-top conditioning rings.

A further process is described of abrading an abrading surface of an abrasive disk that is attached to the abrading surface of a floating platen that is a component of a fixed-spindle floating platen abrading machine, wherein the abrading surface of the abrading platen is abraded to recondition or reestablish planar flatness of the abrading surface of the abrasive disk comprising:

a) providing at least three rotary spindles having circular rotatable flat-surfaced spindle-tops that each have a spindle-top axis of rotation at the center of a respective rotatable flat-surfaced spindle-top for respective rotary spindles;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing at least three rotary spindle two-piece spindle-mount devices comprising a rotatable spindle-mount spherical-action rotor and a stationary spindle-mount spherical-base where each respective spindle-mount spherical-action rotor and respective stationary spindle-mount spherical-base have a common-radius spherical-joint wherein each respective rotatable spindle-mount spherical-action rotor is mounted in common-radius spherical joint surface contact with a respective stationary spindle-mount spherical-base and wherein the respective rotatable spindle-mount spherical-action rotors are supported by the respective stationary spindle-mount spherical-bases where each respective rotary spindle two-piece spindle-mount device allows the respective rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors;

e) providing that each of the at least three rotary spindle two-piece spindle-mount devices has at least one paired set of removable rotor mount tabs where each paired set of removable rotor mount tabs has a first removable tab that is attached to each respective spindle-mount spherical-action rotor and has an adjacent second removable spherical-base tab that is attached to each respective spindle-mount spherical-action spherical-base where a small gap exists between the respective first removable tab that is attached to each respective spindle-mount spherical-action rotor and the adjacent second removable spherical-base tab that is attached to each respective spindle-mount spherical-action spherical-base;

f) providing that the at least three rotary spindles are located with near-equal spacing between the respective at least three of the rotary spindles where the respective at least three spindle-tops' axes of rotation intersect the machine base spindle-circle and where the respective at least three rotary spindle two-piece spindle-mount devices' spindle-mount spherical-bases are mechanically attached to the machine base nominally-flat top surface to position the respective at least three rotary spindles at the near-equal spacing locations between the respective at least three rotary spindles;

g) aligning the at least three spindle-tops' flat surfaces to be co-planar with each other by spherical rotation of the rotatable spindle-mount spherical-action rotors relative to the respective stationary spindle-mount spherical-bases;

h) applying a liquid adhesive in the small gaps that exist between the respective paired sets of first removable rotor mount tabs and the adjacent second removable spherical-base tabs wherein the adhesive is solidified and structurally bonds the respective paired sets of first removable rotor mount tabs and the adjacent second removable spherical-base tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces;

i) providing a floating, rotatable abrading platen having a precision-flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

j) providing that the abrading platen spherical-action rotation device allows spherical motion of the abrading platen about the abrading platen rotational center where the precision-flat annular abrading-surface of the abrading platen that is supported by the abrading platen spherical-action rotation device is nominally horizontal; and k) providing flexible abrasive disk articles having annular bands of abrasive coated surfaces that have an abrasive coated surface annular band radial width and an abrasive coated surface annular band inner radius and an abrasive coated surface annular band outer radius and where a selected flexible abrasive disk is attached in flat conformal contact with an abrading platen precision-flat annular abrading-surface such that the attached abrasive disk is concentric with the abrading platen precision-flat annular abrading-surface wherein the abrading platen precision-flat annular abrading-surface radial width is at least equal to the radial width of the attached flexible abrasive disk abrasive coated annular abrading band and wherein the abrading platen precision-flat annular abrading-surface provides conformal support of the full-abrasive-surface of the flexible abrasive disk abrasive coated surface annular band where the abrading platen precision-flat annular abrading-surface inner radius is less than an inner radius of the attached flexible abrasive disk abrasive coated surface annular band and where an abrading platen precision-flat annular abrading-surface outer radius is greater than the outer radius of the attached flexible abrasive disk abrasive coated surface annular band;

l) Attaching a selected flexible abrasive disk in flat conformal contact with the abrading platen precision-flat annular abrading-surface by a disk attachment techniques selected from the group consisting of vacuum disk attachment techniques, mechanical disk attachment techniques and adhesive disk attachment techniques;

k) attaching flexible abrasive disks or abrasive conditioning rings having flat-surfaced abrasive coating surfaces to the flat surfaces of the at least three spindles' spindle-tops;

l) moving the floating rotatable abrading platen vertically along the floating rotatable abrading platen rotation axis by the spherical-action platen rotation device to allow the floating rotatable abrading platen abrasive disk abrading surface to contact the abrasive surfaces of the attached flexible abrasive disks or the attached abrasive conditioning rings that are attached to the spindle-top flat surfaces of the at least three spindles;

m) rotating the at least three spindle-tops having the attached abrasive disks or attached abrasive conditioning rings about the respective spindles' axes and rotating the floating rotatable abrading platen about the floating rotatable abrading platen rotation axis to abrade the floating rotatable abrading platen abrasive disk abrading surface with the abrasive disks or abrasive conditioning rings that are attached to the at least three spindle-tops while the moving floating rotatable abrading platen abrading surface is in force-controlled abrading pressure with the selected abrasive disks or abrasive conditioning rings attached to the at least three spindle-tops.

The process of abrading an abrading surface of an abrasive disk is described where the machine base structural material is selected from the group consisting of granite and epoxy-granite and wherein the machine base structural material and the machine base structural material is either solid or is temperature controlled by a temperature-controlled fluid that circulates in fluid passageways internal to the machine base structural materials. The same process includes where the at least three rotary spindles are air bearing rotary spindles.

Further, the same process is described where the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

In addition, the process of abrading an abrading surface of an abrasive disk is described where auxiliary rotary spindles in excess of three rotary spindles, which are primary rotary spindles, are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where top surfaces of the rotary spindle respective spindle-tops of the auxiliary rotary spindles are precisely co-planar with the precisely co-planar top surfaces of the spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to structurally maintain the co-planar alignment of the auxiliary rotary spindles' spindle-tops' flat surfaces.

Also, a process is described of co-planar aligning the flat surfaces of spindle-tops and mechanically locking them in position using a flat surfaced floating platen planar abrading surface as an alignment device where the spindle-tops and the floating platen are components of a three-point fixed-spindle floating-platen abrading machine comprising:

a) providing at least three rotary spindles having circular rotatable flat-surfaced spindle-tops that each have a spindle-top axis of rotation at a center of respective rotatable flat-surfaced spindle-tops;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing rotary spindle two-piece spindle-mount devices comprising a rotatable spindle-mount spherical-action rotor and a stationary spindle-mount spherical-base where both have a common-radius spherical joint wherein the rotatable spindle-mount spherical-action rotors are mounted in common-radius spherical joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device locking devices are adapted to lock the respective rotatable spindle-mount spherical-action rotors to the respective stationary spindle-mount spherical-bases;

e) positioning the at least three rotary spindles with near-equal spacing between the at least three of the rotary spindles and the at least three spindle-tops' axes of rotation intersect the machine base spindle-circle and the respective at least three rotary spindle two-piece spindle-mount devices' spindle-mount spherical-bases are mechanically attached to the machine base nominally-flat top surface at respective at least three rotary spindles' spindle-circle locations;

f) providing a floating, rotatable abrading platen having an annular planar abrading-surface that has an annular planar abrading-surface radial width and an annular planar abrading-surface inner radius and an annular planar abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the rotatable abrading platen in a radial direction relative to the abrading platen axis of rotation and where the abrading platen axis of rotation is concentric with the machine base spindle-circle;

g) allowing the abrading platen spherical-action rotation device to have spherical motion of the abrading platen about the abrading platen rotational center where the flat planar annular planar abrading-surface of the abrading platen that is supported by the abrading platen spherical-action rotation device is nominally horizontal; and h) moving the abrading platen vertically along the abrading platen rotation axis by the abrading platen spherical-action rotation device to allow the abrading platen annular planar abrading-surface to be in full flat-surfaced contact with the flat surfaces of the respective at least three spindle-tops where each rotary spindle two-piece spindle-mount device allows the respective rotatable spindle-mount spherical-action rotors to be rotated through spherical angles relative to the respective stationary spindle-mount spherical-bases and wherein the flat surfaces of the respective at least three spindle-tops assume flat-surfaced contact with the abrading platen flat planar annular planar abrading-surface wherein the at least three spindle-tops' flat surfaces are aligned to be co-planar with each other; and i) engaging the rotary spindle two-piece spindle-mount device locking devices to lock the respective rotatable spindle-mount spherical-action rotors to the respective stationary spindle-mount spherical-bases to maintain the co-planar alignment of the at least three spindle-tops' flat surfaces.

Further, the process of co-planar aligning the flat surfaces of spindle-tops is described where rotary spindle two-piece spindle-mount device locking devices are threaded fasteners that are adapted to lock the respective rotatable spindle-mount spherical-action rotors to the respective stationary spindle-mount spherical-bases. This same process can also have rotary spindle two-piece spindle-mount device locking devices that are adhesive bonding locking devices by:

a) providing that each of the at least three rotary spindle two-piece spindle-mount devices has at least one paired set of removable spherical-action rotor adhesive tabs where each paired set of removable spherical-action rotor adhesive tabs has a first removable adhesive tab that is attached to each respective spindle-mount spherical-action rotor and has an adjacent second removable spherical-base adhesive tab that is attached to each respective spindle-mount spherical-action spherical-base where a small gap exists between the respective first removable adhesive tab that is attached to each respective spindle-mount spherical-action rotor and the adjacent second removable spherical-base adhesive tab that is attached to each respective spindle-mount spherical-action spherical-base; and b) applying a liquid adhesive in the small gaps that exist between the respective paired sets of first removable spherical-action rotor adhesive tabs and the adjacent second removable spherical-base adhesive tabs wherein the adhesive is solidified and structurally bonds the respective paired sets of first removable spherical-action rotor adhesive tabs and the adjacent second removable spherical-base adhesive tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces. In addition, the same process is described where the at least three rotary spindles are air bearing rotary spindles.

What is claimed:

1. An at least three-point, fixed-spindle floating-platen abrading machine comprising:

a) at least three rotary spindles having circular rotatable flat-surfaced spindle-tops that each have a spindle-top axis of rotation at the center of a respective rotatable flat-surfaced spindle-top for respective rotary spindles;

b) the at least three spindle-tops' axes of rotation are perpendicular to the respective spindle-tops' flat surfaces;

c) an abrading machine base having a horizontal nominally-flat top surface and a spindle-circle where the spindle-circle is coincident with the machine base nominally-flat top surface;

d) at least three rotary spindle two-piece spindle-mount devices each comprising a rotatable spindle-mount spherical-action rotor and a stationary spindle-mount spherical-base where each respective spindle-mount spherical-action rotor and respective stationary spindle-mount spherical-base have a common-radius spherical joint wherein each respective rotatable spindle-mount spherical-action rotor is mounted in common-radius spherical-joint surface contact with a respective stationary spindle-mount spherical-base and wherein the respective rotatable spindle-mount spherical-action rotors are supported by the respective stationary spindle-mount spherical-bases where each respective rotary spindle two-piece spindle-mount device allows the respective rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors;

e) each of the at least three rotary spindle two-piece spindle-mount devices has at least one paired set of removable spherical-action rotor adhesive tabs where each paired set of removable spherical-action rotor adhesive tabs has a first removable adhesive tab that is attached to each respective spindle-mount spherical-action rotor and an adjacent second removable spherical-base adhesive tab that is attached to each respective spindle-mount spherical-action spherical-base so that a small gap exists between the respective first removable adhesive tab that is attached to each respective spindle-mount spherical-action rotor and the adjacent second removable spherical-base adhesive tab that is attached to each respective spindle-mount spherical-action spherical-base;

f) the at least three rotary spindles are located with near-equal spacing between the respective at least three of the rotary spindles so that the respective at least three spindle-tops' axes of rotation intersect the machine base spindle-circle and the respective at least three rotary spindle two-piece spindle-mount devices' spindle-mount spherical-bases are mechanically attached to the machine base nominally-flat top surface to position the respective at least three rotary spindles at the near-equal spacing locations between the respective at least three rotary spindles;

g) the at least three spindle-tops' flat surfaces are aligned to be co-planar with each other;

h) a solidified liquid adhesive is present in the small gaps that exist between the respective paired sets of first removable spherical-action rotor adhesive tabs and the adjacent second removable spherical-base adhesive tabs wherein the solidified adhesive structurally bonds the respective paired sets of first removable spherical-action rotor adhesive tabs and the adjacent second removable spherical-base adhesive tabs together wherein the respective spindle-mount spherical-action rotors are structurally fixtured to the respective spindle-mount spherical-action spherical-bases such that the respective spindle-mount spherical-action rotors are prevented from moving relative to the respective spindle-mount spherical-action spherical-bases to maintain the co-planar alignment of the at least three spindle-tops' flat surfaces;

i) a floating, rotatable abrading platen having a flat annular abrading-surface that has an annular abrading-surface radial width and an annular abrading-surface inner radius and an annular abrading-surface outer radius and the abrading platen is supported by and is rotationally driven about an abrading platen rotation axis located at a rotational center of the abrading platen by a spherical-action rotation device located at the rotational center of the abrading platen and the abrading platen spherical-action rotation device restrains the abrading platen in a radial direction relative to the abrading platen axis of rotation and the abrading platen axis of rotation is concentric with the machine base spindle-circle;

j) wherein the abrading platen spherical-action rotation device allows spherical motion of the abrading platen about the abrading platen rotational center such that the flat annular abrading-surface of the abrading platen that is supported by the abrading platen spherical-action rotation device is nominally horizontal; and k) flexible abrasive disk articles having an abrasive coated surface comprising annular bands having an annular band radial width and an annular band radius and an annular band outer radius and a flexible abrasive disk is attached in flat conformal contact with an abrading platen flat annular abrading-surface such that the attached abrasive disk is concentric with the abrading platen flat annular abrading-surface and wherein the abrading platen flat annular abrading-surface radial width is at least equal to the radial width of the attached flexible abrasive disk abrasive coated annular abrading band and wherein the abrading platen flat annular abrading-surface provides conformal support of the full-abrasive-surface of the flexible abrasive disk abrasive coated surface annular band where the abrading platen flat annular band inner radius is less than an inner radius of the attached flexible abrasive disk abrasive coated surface annular band and where an abrading platen flat annular abrading-surface annular band outer radius is greater than the outer radius of the attached flexible abrasive disk abrasive coated surface annular band;

l) wherein each flexible abrasive disk is attached in flat conformal contact with the abrading platen flat annular abrading-surface by a disk attachment technique selected from the group consisting of vacuum disk attachment, mechanical disk attachment and adhesive disk attachment;

m) wherein equal-thickness workpieces have parallel opposed flat workpiece top surfaces and flat workpiece bottom surfaces are attached in flat-surfaced contact with the flat surfaces of the respective at least three spindle-tops where the workpiece bottom surfaces contact the flat surfaces of the respective at least three spindle-tops;

n) wherein the abrading platen is vertically moveable along the abrading platen rotation axis by the abrading platen spherical-action rotation device to allow the abrasive surface of the flexible abrasive disk that is attached to the abrading platen flat annular abrading-surface to contact the top surfaces of the workpieces that are attached to the flat surfaces of the respective at least three spindle-tops wherein the at least three rotary spindles provide at least three-point support of the abrading platen;

o) total abrading platen abrading contact force applied to workpieces that are attached to the respective at least three spindle-top flat surfaces by contact of the abrasive surface of the flexible abrasive disk that is attached to the abrading platen flat annular abrading-surface with the top surfaces of the workpieces that are attached to the flat surfaces of the respective at least three spindle-tops is controlled through the abrading platen spherical-action abrading platen rotation device to evenly distribute the total abrading platen abrading contact force to the workpieces attached to the respective at least three spindle-tops; and p) wherein the at least three spindle-tops having the attached equal-thickness workpieces can be rotated about the respective spindle-tops' rotation axes and the abrading platen having the attached flexible abrasive disk can be rotated about the abrading platen rotation axis to single-side abrade the equal-thickness workpieces that are attached to the flat surfaces of the at least three spindle-tops while the moving abrasive surface of the flexible abrasive disk that is attached to the moving abrading platen flat annular abrading-surface is in force-controlled abrading contact with the top surfaces of the equal-thickness workpieces that are attached to the respective at least three spindle-tops.

2. The machine of claim 1 wherein at least one flat-surfaced circular device is selected from the group consisting of workpiece carriers, abrasive conditioning rings and abrasive disks attached to the flat surfaces of the at least three spindle-tops, wherein the selected flat-surfaced circular devices are attached to the at least three spindle-tops by attachment systems selected from the group consisting of vacuum attachment, mechanical attachment and adhesive attachment and wherein the attached flat-surfaced circular devices are concentric with the respective spindle-tops.

3. The machine of claim 1 wherein the machine base structural material is selected from the group consisting of granite and epoxy-granite and wherein the machine base structural material is either solid or has fluid passageways internal to structural materials of the machine base wherein a temperature-controlled fluid is circulated in the fluid passageways to control temperature of the machine base structural material.

4. The machine of claim 1 wherein the at least three rotary spindles are air bearing rotary spindles.

5. The machine of claim 1 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

6. The machine of claim 1 where auxiliary rotary spindles in excess of the at least three rotary spindles, which are primary rotary spindles, are attached to the machine base flat surface using rotary spindle two-piece spindle-mount devices and the auxiliary rotary spindles are each positioned between adjacent primary rotary spindles, and the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where top surfaces of the rotary spindle respective spindle-tops of the auxiliary rotary spindles are co-planar with the co-planar top surfaces of the spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to structurally maintain the co-planar alignment of the auxiliary rotary spindles' spindle-tops' flat surfaces.

7. A process of abrading flat-surfaced workpieces using an at least three-point fixed-spindle floating-platen abrading machine comprising:

a) providing at least three rotary spindles having circular rotatable flat-surfaced spindle-tops that each have a spindle-top axis of rotation at the center of a respective rotatable flat-surfaced spindle-top for respective rotary spindles;

b) providing that the at least three spindle-tops' axes of rotation are perpendicular to the respective spindle-tops' flat surfaces;

c) providing an abrading machine base having a horizontal nominally-flat top surface and a spindle-circle so that the spindle-circle is coincident with the machine base nominally-flat top surface;

d) providing at least three rotary spindle two-piece spindle-mount devices comprising a rotatable spindle-mount spherical-action rotor and a stationary spindle-mount spherical-base where each respective spindle-mount spherical-action rotor and respective stationary spindle-mount spherical-base have a common-radius spherical joint wherein each respective rotatable spindle-mount spherical-action rotor is mounted in common-radius spherical-joint surface contact with a respective stationary spindle-mount spherical-base and wherein the respective rotatable spindle-mount spherical-action rotors are supported by the respective stationary spindle-mount spherical-bases so that each respective rotary spindle two-piece spindle-mount device allows the respective rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors;

e) providing on each of the at least three rotary spindle two-piece spindle-mount devices at least one paired set of removable spherical-action rotor adhesive tabs where each paired set of removable spherical-action rotor adhesive tabs has a first removable adhesive tab attached to each respective spindle-mount spherical-action rotor and an adjacent second removable spherical-base adhesive tab attached to each respective spindle-mount spherical-action spherical-base so that a small gap exists between the respective first removable adhesive tab that is attached to each respective spindle-mount spherical-action rotor and the adjacent second removable spherical-base adhesive tab that is attached to each respective spindle-mount spherical-action spherical-base;

f) positioning the at least three rotary spindles with near-equal spacing between the respective at least three of the rotary spindles where the respective at least three spindle-tops' axes of rotation intersect the machine base spindle-circle and mechanically attaching the respective at least three rotary spindle two-piece spindle-mount devices' spindle-mount spherical-bases to the machine base nominally-flat top surface to position the respective at least three rotary spindles at the near-equal spacing locations between the respective at least three rotary spindles;

g) aligning the at least three spindle-tops' flat surfaces to be co-planar with each other by spherical rotation of the rotatable spindle-mount spherical-action rotors relative to the respective stationary spindle-mount spherical-bases;

h) applying a liquid adhesive in the small gaps that exist between the respective paired sets of first removable spherical-action rotor adhesive tabs and the adjacent second removable spherical-base adhesive tabs and solidifying the adhesive to structurally bonds the respective paired sets of first removable spherical-action rotor adhesive tabs and the adjacent second removable spherical-base adhesive tabs together wherein the respective spindle-mount spherical-action rotors are structurally fixtured to the respective spindle-mount spherical-action spherical-bases so that the respective spindle-mount spherical-action rotors are prevented from moving relative to the respective spindle-mount spherical-action spherical-bases to maintain the co-planar alignment of the at least three spindle-tops' flat surfaces;

i) providing a floating, rotatable abrading platen having a flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

j) rotating the abrading platen spherical-action rotation device in a spherical motion of the abrading platen about the abrading platen rotational center such that the flat annular abrading-surface of the abrading platen that is supported by the abrading platen spherical-action rotation device is nominally horizontal; and k) providing flexible abrasive disk articles having annular bands of abrasive coated surfaces that have an abrasive coated surface annular band radial width and an abrasive coated surface annular band inner radius and an abrasive coated surface annular band outer radius and attaching a selected flexible abrasive disk in flat conformal contact with an abrading platen flat annular abrading-surface such that the attached abrasive disk is concentric with the abrading platen flat annular abrading-surface, and wherein the abrading platen flat annular abrading-surface radial width is at least equal to the radial width of the attached flexible abrasive disk abrasive coated annular abrading band and wherein the abrading platen flat annular abrading-surface provides conformal support of the full-abrasive-surface of the flexible abrasive disk abrasive coated surface annular band such that the abrading platen flat annular abrading-surface inner radius is less than an inner radius of the attached flexible abrasive disk abrasive coated surface annular band and such that an abrading platen flat annular abrading-surface outer radius is greater than the outer radius of the attached flexible abrasive disk abrasive coated surface annular band;

l) attaching a selected flexible abrasive disk in flat conformal contact with the abrading platen flat annular abrading-surface by a disk attachment techniques selected from the group consisting of vacuum disk attachment techniques, mechanical disk attachment techniques and adhesive disk attachment techniques;

m) attaching equal-thickness workpieces having parallel opposed flat workpiece top surfaces and flat workpiece bottom surfaces so that the equal-thickness workpieces are attached in flat-surfaced contact with the flat surfaces of the respective at least three spindle-tops where the workpiece bottom surfaces contact the flat surfaces of the respective at least three spindle-tops;

n) moving the abrading platen vertically along the abrading platen rotation axis by the abrading platen spherical-action rotation device to allow the abrasive surface of the flexible abrasive disk that is attached to the abrading platen flat annular abrading-surface to contact the top surfaces of the workpieces that are attached to the flat surfaces of the respective at least three spindle-tops wherein the at least three rotary spindles provide at least three-point support of the abrading platen;

o) applying a total abrading platen abrading contact force to the workpieces that are attached to the respective at least three spindle-top flat surfaces by contact of the abrasive surface of the flexible abrasive disk that is attached to the abrading platen flat annular abrading-surface with the top surfaces of the workpieces that are attached to the flat surfaces of the respective at least three spindle-tops where the total abrading platen abrading contact force is controlled through the abrading platen spherical-action abrading platen rotation device to allow the total abrading platen abrading contact force to be evenly distributed to the workpieces attached to the respective at least three spindle-tops; and p) rotating the at least three spindle-tops having the attached equal-thickness workpieces about the respective spindle-tops' rotation axes and rotating the abrading platen having the attached flexible abrasive disk about the abrading platen rotation axis to single-side abrade the equal-thickness workpieces that are attached to the flat surfaces of the at least three spindle-tops while the moving abrasive surface of the flexible abrasive disk that is attached to the moving abrading platen flat annular abrading-surface is in force-controlled abrading contact with the top surfaces of the equal-thickness workpieces that are attached to the respective at least three spindle-tops.

8. The process of claim 7 where flat-surfaced equal-thickness workpieces having top and bottom surfaces are provided such that a workpiece top surface is a first workpiece surface and a workpiece bottom surface is a second workpiece surface and where the flat-surfaced equal-thickness workpieces are attached to the at least three spindle-tops, and the first workpiece surfaces are abraded by the flexible abrasive disk article that is attached to the abrading platen flat annular abrading-surface when the second workpiece surfaces are attached to the at least three spindle-tops, and after the first workpiece surface is abraded, the flat-surfaced equal-thickness workpieces are removed from the at least three spindle-tops and the flat-surfaced equal-thickness workpieces are re-attached to the at least three spindle-tops where the abraded first workpiece surfaces are attached to the spindle-tops and the second workpiece surfaces are abraded by the flexible abrasive disk article that is attached to the abrading platen flat annular abrading-surface workpiece.

9. The process of claim 7 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads that are suitable for use with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

10. The process of claim 7 where auxiliary rotary spindles in excess of the at least three rotary spindles which are primary rotary spindles are attached to the machine base flat surface using rotary spindle two-piece spindle-mount devices and where the auxiliary rotary spindles are each positioned between adjacent primary rotary spindles, and where the auxiliary rotary spindles have circular rotatable flat-surfaced spindle-tops that each have spindle-top axis of rotation at a center of their respective auxiliary rotary spindle spindle-top and where the respective auxiliary rotary spindle spindle-tops' axes of rotation intersect the machine base spindle-circle and where the top surfaces of the rotary spindle respective spindle-tops of the auxiliary rotary spindles are precisely co-planar with the precisely co-planar top surfaces of the spindle-tops of the three primary rotary spindles and the rotary spindle two-piece spindle-mount device' locking devices are engaged to lock the auxiliary rotary spindles' respective rotatable spindle-mount spherical-action rotors to the respective stationary spindle-mount spherical-bases to structurally maintain the co-planar alignment of the auxiliary rotary spindles' spindle-tops' flat surfaces.

11. A process of abrading an abrading surface of a floating platen that is a component of a three-point fixed-spindle floating-platen abrading machine to recondition or reestablish the planar flatness of the platen abrading surface comprising:

a) providing at least three rotary spindles having circular rotatable flat-surfaced spindle-tops that each have a spindle-top axis of rotation at the center of a respective rotatable flat-surfaced spindle-top for respective rotary spindles;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing at least three rotary spindle two-piece spindle-mount devices comprising a rotatable spindle-mount spherical-action rotor and a stationary spindle-mount spherical-base where each respective spindle-mount spherical-action rotor and respective stationary spindle-mount spherical-base have a common-radius spherical joint wherein each respective rotatable spindle-mount spherical-action rotor is mounted in common-radius spherical-joint surface contact with a respective stationary spindle-mount spherical-base and wherein the respective rotatable spindle-mount spherical-action rotors are supported by the respective stationary spindle-mount spherical-bases where each respective rotary spindle two-piece spindle-mount device allows the respective rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors;

e) providing that each of the at least three rotary spindle two-piece spindle-mount devices has at least one paired set of removable spherical-action rotor adhesive tabs where each paired set of removable spherical-action rotor adhesive tabs has a first removable adhesive tab that is attached to each respective spindle-mount spherical-action rotor and has an adjacent second removable spherical-base adhesive tab that is attached to each respective spindle-mount spherical-action spherical-base where a small gap exists between the respective first removable adhesive tab that is attached to each respective spindle-mount spherical-action rotor and the adjacent second removable spherical-base adhesive tab that is attached to each respective spindle-mount spherical-action spherical-base;

f) providing that the at least three rotary spindles are located with near-equal spacing between the respective at least three of the rotary spindles where the respective at least three spindle-tops'axes of rotation intersect the machine base spindle-circle and where the respective at least three rotary spindle two-piece spindle-mount devices' spindle-mount spherical-bases are mechanically attached to the machine base nominally-flat top surface to position the respective at least three rotary spindles at the near-equal spacing locations between the respective at least three rotary spindles;

g) aligning the at least three spindle-tops' flat surfaces to be co-planar with each other by spherical rotation of the rotatable spindle-mount spherical-action rotors relative to the respective stationary spindle-mount spherical-bases;

h) applying a liquid adhesive in the small gaps that exist between the respective paired sets of first removable spherical-action rotor adhesive tabs and the adjacent second removable spherical-base adhesive tabs wherein the adhesive is solidified and structurally bonds the respective paired sets of first removable spherical-action rotor adhesive tabs and the adjacent second removable spherical-base adhesive tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces;

i) providing a floating, rotatable abrading platen having a flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

j) providing that the abrading platen spherical-action rotation device allows spherical motion of the abrading platen about the abrading platen rotational center where the flat annular abrading-surface of the abrading platen that is supported by the abrading platen spherical-action rotation device is nominally horizontal; and k) attaching flexible abrasive disks or abrasive conditioning rings having flat-surfaced abrasive coating surfaces to the flat surfaces of the at least three spindles' spindle-tops;

l) moving the floating rotatable abrading platen vertically along the floating rotatable abrading platen rotation axis by the spherical-action platen rotation device to allow the floating rotatable abrading platen abrading surface to contact the abrasive surfaces of the attached flexible abrasive disks or the attached abrasive conditioning rings that are attached to the spindle-top flat surfaces of the at least three spindles;

m) rotating the at least three spindle-tops having the attached abrasive disks or attached abrasive conditioning rings about the respective spindles' axes and rotating the floating rotatable abrading platen about the floating rotatable abrading platen rotation axis to abrade the abrading-surface of the floating rotatable abrading platen with the abrasive disks or abrasive conditioning rings that are attached to the at least three spindle-tops while the moving floating rotatable abrading platen abrading surface is in force-controlled abrading pressure with the selected abrasive disks or abrasive conditioning rings attached to the at least three spindle-tops.

12. The process of claim 11 where the abrading surface of the floating rotatable abrading platen is abraded to recondition or reestablish planar flatness of the floating rotatable abrading platen abrading surface using conditioning rings where circular-shaped conditioning rings having a flat-surfaced abrasive coated annular band are attached to the at least three spindle-tops, where the conditioning rings annular abrasive surfaces have equal heights above each spindle-top wherein the at least three spindle-tops having the attached conditioning rings are rotated about the respective spindles' axes while moving the floating rotatable abrading platen abrading surface in force-controlled abrading pressure with the spindle-top conditioning rings.

13. A process of abrading an abrading surface of an abrasive disk that is attached to the abrading surface of a floating platen that is a component of a fixed-spindle floating platen abrading machine, wherein the abrading surface of the abrading platen is abraded to recondition or reestablish planar flatness of the abrading surface of the abrasive disk comprising:

a) providing at least three rotary spindles having circular rotatable flat-surfaced spindle-tops that each have a spindle-top axis of rotation at the center of a respective rotatable flat-surfaced spindle-top for respective rotary spindles;

b) providing that the at least three spindle-tops' axes of rotation are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing at least three rotary spindle two-piece spindle-mount devices comprising a rotatable spindle-mount spherical-action rotor and a stationary spindle-mount spherical-base where each respective spindle-mount spherical-action rotor and respective stationary spindle-mount spherical-base have a common-radius spherical joint wherein each respective rotatable spindle-mount spherical-action rotor is mounted in common-radius spherical-joint surface contact with a respective stationary spindle-mount spherical-base and wherein the respective rotatable spindle-mount spherical-action rotors are supported by the respective stationary spindle-mount spherical-bases where each respective rotary spindle two-piece spindle-mount device allows the respective rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors;

e) providing that each of the at least three rotary spindle two-piece spindle-mount devices has at least one paired set of removable spherical-action rotor adhesive tabs where each paired set of removable spherical-action rotor adhesive tabs has a first removable adhesive tab that is attached to each respective spindle-mount spherical-action rotor and has an adjacent second removable spherical-base adhesive tab that is attached to each respective spindle-mount spherical-action spherical-base where a small gap exists between the respective first removable adhesive tab that is attached to each respective spindle-mount spherical-action rotor and the adjacent second removable spherical-base adhesive tab that is attached to each respective spindle-mount spherical-action spherical-base;

f) providing that the at least three rotary spindles are located with near-equal spacing between the respective at least three of the rotary spindles where the respective at least three spindle-tops' axes of rotation intersect the machine base spindle-circle and where the respective at least three rotary spindle two-piece spindle-mount devices' spindle-mount spherical-bases are mechanically attached to the machine base nominally-flat top surface to position the respective at least three rotary spindles at the near-equal spacing locations between the respective at least three rotary spindles;

g) aligning the at least three spindle-tops' flat surfaces to be co-planar with each other by spherical rotation of the rotatable spindle-mount spherical-action rotors relative to the respective stationary spindle-mount spherical-bases;

h) applying a liquid adhesive in the small gaps that exist between the respective paired sets of first removable spherical-action rotor adhesive tabs and the adjacent second removable spherical-base adhesive tabs wherein the adhesive is solidified and structurally bonds the respective paired sets of first removable spherical-action rotor adhesive tabs and the adjacent second removable spherical-base adhesive tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces;

i) providing a floating, rotatable abrading platen having a flat annular abrading-surface that has an annular abrading-surface radial width and an annular abrading-surface inner radius and an annular abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the abrading platen in a radial direction relative to the abrading platen axis of rotation and where the abrading platen axis of rotation is concentric with the machine base spindle-circle;

j) providing that the abrading platen spherical-action rotation device allows spherical motion of the abrading platen about the abrading platen rotational center where the flat annular abrading-surface of the abrading platen that is supported by the abrading platen spherical-action rotation device is nominally horizontal; and k) providing flexible abrasive disk articles having annular bands of abrasive coated surfaces that have an abrasive coated surface annular band radial width and an abrasive coated surface annular band inner radius and an abrasive coated surface annular band outer radius and where a selected flexible abrasive disk is attached in flat conformal contact with an abrading platen flat annular abrading-surface such that the attached abrasive disk is concentric with the abrading platen flat annular abrading-surface wherein the abrading platen flat annular abrading-surface radial width is at least equal to the radial width of the attached flexible abrasive disk abrasive coated annular abrading band and wherein the abrading platen flat annular abrading-surface provides conformal support of the full-abrasive-surface of the flexible abrasive disk abrasive coated surface annular band where the abrading platen flat annular abrading-surface inner radius is less than an inner radius of the attached flexible abrasive disk abrasive coated surface annular band and where an abrading platen flat annular abrading-surface outer radius is greater than the outer radius of the attached flexible abrasive disk abrasive coated surface annular band;

l) attaching a selected flexible abrasive disk in flat conformal contact with the abrading platen flat annular abrading-surface by a disk attachment techniques selected from the group consisting of vacuum disk attachment techniques, mechanical disk attachment techniques and adhesive disk attachment techniques;

k) attaching flexible abrasive disks or abrasive conditioning rings having flat-surfaced abrasive coating surfaces to the flat surfaces of the at least three spindles' spindle-tops;

l) moving the floating rotatable abrading platen vertically along the floating rotatable abrading platen rotation axis by the spherical-action platen rotation device to allow the floating rotatable abrading platen abrasive disk abrading surface to contact the abrasive surfaces of the attached flexible abrasive disks or the attached abrasive conditioning rings that are attached to the spindle-top flat surfaces of the at least three spindles;

m) rotating the at least three spindle-tops having the attached abrasive disks or attached abrasive conditioning rings about the respective spindles' axes and rotating the floating rotatable abrading platen about the floating rotatable abrading platen rotation axis to abrade the floating rotatable abrading platen abrasive disk abrading surface with the abrasive disks or abrasive conditioning rings that are attached to the at least three spindle-tops while the moving floating rotatable abrading platen abrading surface is in force-controlled abrading pressure with the selected abrasive disks or abrasive conditioning rings attached to the at least three spindle-tops.

14. The process of claim 13 wherein the machine base structural material is selected from the group consisting of granite and epoxy-granite and wherein the machine base structural material is temperature controlled by circulating a temperature-controlled fluid through fluid passageways internal to the machine base structural material.

15. The process of claim 13 wherein the at least three rotary spindles are air bearing rotary spindles.

16. The process of claim 13 wherein the abrading platen flexible abrasive disk articles are selected from the group consisting of: flexible abrasive disks, flexible raised-island abrasive disks, flexible abrasive disks with resilient backing layers, flexible abrasive disks with resilient backing layers having a vacuum-seal polymer backing layer, flexible abrasive disks having attached solid abrasive pellets, flexible chemical mechanical planarization resilient disk pads with liquid abrasive slurries, flexible chemical mechanical planarization resilient disk pads having nap covers, flexible shallow-island chemical mechanical planarization abrasive disks, flexible shallow-island abrasive disks with resilient backing layers having a vacuum-seal polymer backing layer, and flexible flat-surfaced metal or polymer disks.

17. A process of co-planar aligning the flat surfaces of spindle-tops and mechanically locking them in position using a flat surfaced floating platen planar abrading surface as an alignment device where the spindle-tops and the floating platen are components of a three-point fixed-spindle floating-platen abrading machine, the process comprising:

a) providing at least three rotary spindles having circular rotatable flat-surfaced spindle-tops that each have a spindle-top axis of rotation at a center of respective rotatable flat-surfaced spindle-tops;

b) providing the at least three spindle-tops' with axes of rotation that are perpendicular to the respective spindle-tops' flat surfaces;

c) providing an abrading machine base having a horizontal nominally-flat top surface and a spindle-circle where the spindle-circle is coincident with the machine base nominally-flat top surface;

d) providing rotary spindle two-piece spindle-mount devices comprising a rotatable spindle-mount spherical-action rotor and a stationary spindle-mount spherical-base where both have a common-radius spherical-joint wherein the rotatable spindle-mount spherical-action rotors are mounted in common-radius spherical-joint surface contact with respective stationary spindle-mount spherical-bases and wherein the rotatable spindle-mount spherical-action rotors are supported by the respective stationary spindle-mount spherical-bases where each rotary spindle two-piece spindle-mount device allows the rotatable spindle-mount spherical-action rotors to be rotated through spherical angles relative to the respective stationary spindle-mount spherical-bases and wherein the at least three rotary spindles are mechanically attached to respective at least three rotary spindle two-piece spindle-mount devices' rotatable spindle-mount spherical-action rotors and wherein rotary spindle two-piece spindle-mount device locking devices are adapted to lock the respective rotatable spindle-mount spherical-action rotors to the respective stationary spindle-mount spherical-bases;

e) positioning the at least three rotary spindles with near-equal spacing between the at least three of the rotary spindles and the at least three spindle-tops' axes of rotation intersect the machine base spindle-circle and the respective at least three rotary spindle two-piece spindle-mount devices' spindle-mount spherical-bases are mechanically attached to the machine base nominally-flat top surface at respective at least three rotary spindles' spindle-circle locations;

f) providing a floating, rotatable abrading platen having an annular planar abrading-surface that has an annular planar abrading-surface radial width and an annular planar abrading-surface inner radius and an annular planar abrading-surface outer radius and where the abrading platen is supported by and is rotationally driven about an abrading platen rotation axis located at a rotational center of the abrading platen by a spherical-action rotation device located at the rotational center of the abrading platen and where the abrading platen spherical-action rotation device restrains the rotatable abrading platen in a radial direction relative to the abrading platen axis of rotation and where the abrading platen axis of rotation is concentric with the machine base spindle-circle;

g) allowing the abrading platen spherical-action rotation device to have spherical motion of the abrading platen about the abrading platen rotational center where the flat planar annular planar abrading-surface of the abrading platen that is supported by the abrading platen spherical-action rotation device is nominally horizontal;

h) moving the abrading platen vertically along the abrading platen rotation axis by the abrading platen spherical-action rotation device to allow the abrading platen annular planar abrading-surface to be in full flat-surfaced contact with the flat surfaces of the respective at least three spindle-tops where each rotary spindle two-piece spindle-mount device allows the respective rotatable spindle-mount spherical-action rotors to be rotated through spherical angles relative to the respective stationary spindle-mount spherical-bases and wherein the flat surfaces of the respective at least three spindle-tops assume flat-surfaced contact with the abrading platen flat planar annular planar abrading-surface wherein the at least three spindle-tops' flat surfaces are aligned to be co-planar with each other; and i) engaging the rotary spindle two-piece spindle-mount device locking devices to lock the respective rotatable spindle-mount spherical-action rotors to the respective stationary spindle-mount spherical-bases to maintain the co-planar alignment of the at least three spindle-tops' flat surfaces.

18. The process of claim 17 wherein rotary spindle two-piece spindle-mount device locking devices are threaded fasteners that are adapted to lock the respective rotatable spindle-mount spherical-action rotors to the respective stationary spindle-mount spherical-bases.

19. The process of claim 17 wherein rotary spindle two-piece spindle-mount device locking devices are adhesive locking devices by:

a) providing each of the at least three rotary spindle two-piece spindle-mount devices with at least one paired set of removable spherical-action rotor adhesive tabs where each paired set of removable spherical-action rotor adhesive tabs has a first removable adhesive tab that is attached to each respective spindle-mount spherical-action rotor and has an adjacent second removable spherical-base adhesive tab that is attached to each respective spindle-mount spherical-action spherical-base where a small gap exists between the respective first removable adhesive tab that is attached to each respective spindle-mount spherical-action rotor and the adjacent second removable spherical-base adhesive tab that is attached to each respective spindle-mount spherical-action spherical-base; and b) applying a liquid adhesive in the small gaps that exist between the respective paired sets of first removable spherical-action rotor adhesive tabs and the adjacent second removable spherical-base adhesive tabs and solidifying the adhesive to structurally bond the respective paired sets of first removable spherical-action rotor adhesive tabs and the adjacent second removable spherical-base adhesive tabs together wherein the respective spindle-mount spherical-action rotors are structurally fixtured to the respective spindle-mount spherical-action spherical-bases where the respective spindle-mount spherical-action rotors are prevented from moving relative to the respective spindle-mount spherical-action spherical-bases to maintain the co-planar alignment of the at least three spindle-tops' flat surfaces.

20. The process of claim 17 wherein the at least three rotary spindles are air bearing rotary spindles.

* * * * *